US008763568B2

(12) United States Patent
Hamakawa et al.

(10) Patent No.: US 8,763,568 B2
(45) Date of Patent: Jul. 1, 2014

(54) COOLING STRUCTURE FOR INTERNAL COMBUSTION ENGINE

(75) Inventors: Takeru Hamakawa, Wako (JP); Eiji Takahashi, Wako (JP); Takuma Adachi, Wako (JP); Hisayuki Hashimoto, Wako (JP); Takenori Akiyoshi, Wako (JP); Makoto Andou, Wako (JP); Yoshihiro Akiyama, Wako (JP); Ichirou Ohmura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 560 days.

(21) Appl. No.: 12/941,769

(22) Filed: Nov. 8, 2010

(65) Prior Publication Data

US 2011/0114041 A1 May 19, 2011

(30) Foreign Application Priority Data

Nov. 19, 2009 (JP) ..... 2009-264148
Aug. 3, 2010 (JP) ..... 2010-174626
Aug. 3, 2010 (JP) ..... 2010-174627

(51) Int. Cl.
*F02F 1/14* (2006.01)
*F02F 1/16* (2006.01)
*F01P 3/02* (2006.01)

(52) U.S. Cl.
CPC . *F02F 1/163* (2013.01); *F01P 3/02* (2013.01); *F02F 1/14* (2013.01); *F01P 2003/021* (2013.01)
USPC ..... 123/41.79; 123/41.72; 123/41.21; 123/41.27; 123/41.74; 123/41.81

(58) Field of Classification Search
USPC ..... 123/41.72, 41.79, 41.21–41.27; 122/158
See application file for complete search history.

(56) References Cited

U.S. PATENT DOCUMENTS

| | | | | |
|---|---|---|---|---|
| 5,794,591 | A * | 8/1998 | Kalebjian et al. | 123/337 |
| 7,032,547 | B2 * | 4/2006 | Xin | 123/41.72 |
| 7,216,611 | B2 * | 5/2007 | Matsutani et al. | 123/41.72 |
| 7,398,596 | B2 * | 7/2008 | Okazaki et al. | 29/888.061 |
| 7,438,026 | B2 * | 10/2008 | Nakada et al. | 123/41.74 |
| 2002/0000210 | A1 * | 1/2002 | Shinpo et al. | 123/41.74 |
| 2005/0120653 | A1 | 6/2005 | Okazaki et al. | |

FOREIGN PATENT DOCUMENTS

| | | | |
|---|---|---|---|
| CN | 1648431 | A | 8/2005 |
| JP | 60-164645 | U | 11/1985 |
| JP | 2002-266695 | A | 9/2002 |
| JP | 2003-262155 | A | 9/2003 |
| JP | 2005-120944 | A | 5/2005 |

(Continued)

*Primary Examiner* — Lindsay Low
*Assistant Examiner* — Kevin Lathers
(74) *Attorney, Agent, or Firm* — Arent Fox LLP

(57) ABSTRACT

A spacer fitted inside a water jacket of a cylinder block in an internal combustion engine is set so that a space formed between an inner peripheral surface of the spacer and an inner wall surface of the water jacket is smaller than a space formed between an outer peripheral surface of the spacer and an outer wall surface of the water jacket. Accordingly, even if a position of the spacer is shifted in a radial direction, the inner peripheral surface of the spacer comes into abutment on the inner wall surface of the water jacket at first. Thereby, the abutment of the outer peripheral surface of the spacer on the outer wall surface of the water jacket is prevented completely. Therefore, hitting sounds of pistons can be blocked by the space between the outer peripheral surface of the spacer and the outer wall surface of the water jacket.

14 Claims, 28 Drawing Sheets

(56) References Cited

FOREIGN PATENT DOCUMENTS

| | | | |
|---|---|---|---|
| JP | 4017584 | B2 | 12/2007 |
| JP | 2008-64054 | A | 3/2008 |
| JP | 2009-243414 | A | 10/2009 |
| JP | 2009-264286 | A | 11/2009 |

* cited by examiner

SECTIONAL VIEW TAKEN ALONG LINE A-A

PRESENT EMBODIMENT

COMPARATIVE EXAMPLE

SECTIONAL VIEW TAKEN ALONG LINE B-B

ENLARGED VIEW OF PART C

SECTIONAL VIEW TAKEN ALONG LINE E-E

SECTIONAL VIEW TAKEN ALONG LINE D-D

COOLING STRUCTURE FOR INTERNAL COMBUSTION ENGINE

BACKGROUND OF THE INVENTION

1. Field of the Invention

The present invention relates to a cooling structure for an internal combustion engine in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer.

2. Description of the Related Art

Japanese Patent Application Laid-open No. 2008-64054 has made publicly known such a cooling structure for an internal combustion engine in which: the inner peripheral surface of the spacer is put in contact with the inner wall surface of the water jacket of the cylinder block in one side where cooling water is introduced into the water jacket, while the inner peripheral surface of the spacer is kept away from the inner wall surface of the water jacket in the opposite side; and thereby, the temperature of the cylinder bores is made uniform throughout their entire peripheries.

Meanwhile, the sliding of the pistons inside the cylinder bores has a problem that: side thrusts acting on the pistons cause hitting sounds; and noises are caused by the propagation of the hitting sounds to the outer surface of the cylinder block via the water jacket. In particular, in a case where the spacer is fitted inside the water jacket, the noises are likely to increase because the hitting sounds of the pistons are transmitted via the spacer thereby to easily pass through the water jacket. However, the above-mentioned conventional cooling structure for an internal combustion engine has no specific measures against the problem that the attachment of the spacer increases the noises made by the hitting sounds of the pistons.

SUMMARY OF THE INVENTION

The present invention has been made in view of the foregoing situation. An object of the present invention is to make hitting sounds of pistons less likely to be propagated to an outer surface of a cylinder block while maintaining a spacer's effect of reducing friction between the pistons and respective cylinder bores.

In order to achieve the object, according to a first feature of the present invention, there is provided a cooling structure for an internal combustion engine in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer, wherein a space formed between an inner peripheral surface of the spacer and an inner wall surface of the water jacket is smaller than a space formed between an outer peripheral surface of the spacer and an outer wall surface of the water jacket.

According to the above-described configuration, the spacer is fitted inside the water jacket formed to surround the periphery of the cylinder bore of the cylinder block in the internal combustion engine. For this reason, the cylinder bore is thermally insulated by regulating the flow of the cooling water in the water jacket by use of the spacer. Thereby, the friction between the cylinder bore and a piston can be reduced by thermally expanding the cylinder bore. Because the space formed between the inner peripheral surface of the spacer and the inner wall surface of the water jacket is set smaller than the space formed between the outer peripheral surface of the spacer and the outer wall surface of the water jacket, even if the position of the spacer inside the water jacket is shifted, the inner peripheral surface of the spacer comes into abutment on the inner wall surface of the water jacket at first. Thereby, the abutment of the outer peripheral surface of the spacer on the outer wall surface of the water jacket is prevented completely. For this reason, even if the hitting sound of the piston is transmitted from the cylinder bore to the spacer, the propagation of the hitting sound to the outer surface of the cylinder block can be prevented by blocking the hitting sound between the outer peripheral surface of the spacer and the outer wall surface of the water jacket.

According to a second feature of the present invention, in addition to the first feature, the inner peripheral surface of the spacer is provided with a protruding part which protrudes toward the inner wall surface of the water jacket.

According to the above-described configuration, the protruding part which protrudes toward the inner wall surface of the water jacket is provided on the inner peripheral surface of the spacer. For this reason, when the spacer deforms due to swelling and thermal expansion, it is possible to prevent the entire inner peripheral surface of the spacer from coming into close contact with the inner wall surface of the water jacket by making the protruding part abut on the inner wall surface of the water jacket.

According to a third feature of the present invention, in addition to the second feature, as said cylinder bore there are provided two cylinder bores and the protruding part is provided near an area where the two cylinder bores are close to each other.

According to the above-described configuration, the protruding part of the spacer is provided in the vicinity of each area where the corresponding two of the cylinder bores are close to each other. For this reason, even if the protruding part of the spacer comes into abutment on the inner wall surface of the water jacket, it is possible to prevent the hitting sounds of the pistons from being propagated, as noises, to the outer surface of the cylinder block because the hitting sounds of the pistons in the portion are originally small.

According to a fourth feature of the present invention, in addition to the first feature, the spacer is provided with abutment means which abuts on at least one of the inner wall surface and the outer wall surface in each of positions on one and the other of opposite sides in a direction of a cylinder axis.

According to the above-described configuration, the spacer is provided with the abutment means, which abuts on at least one of the inner wall surface and the outer wall surface of the water jacket, in each of one side position and the other side position in the cylinder axis direction. The spacer is made to abut thereon at least two points in the cylinder axis direction by use of the abutment means. Thereby, the behavior of the spacer can be stabilized by avoiding the rotational movement of the spacer. Note that the "abutment" in this respect does not necessarily means a full-time contact of the abutment means with at least one of the inner wall surface or the outer wall surface of the water jacket, but includes restriction on a range of the rotational movement (sliding movement) of the spacer by narrowing a space-out distance (space, clearance) between the abutment means and any one of the inner wall surface and the outer wall surface. The present invention hereinafter will use the term "abutment" to express the same meaning and contents.

According to a fifth feature of the present invention, in addition to the fourth feature, the abutment means is a protruding part which protrudes from a spacer main body part, which forms a main body part of the spacer, toward the wall surface of the water jacket.

According to the above-described configuration, the abutment means is the protruding part which protrudes from the spacer main body part toward the wall surface of the water jacket. For this reason, even in a case where the wall surface of the water jacket is formed in a complicated shape, the spacer can be preferably held and fixed by making the protruding part abut thereon.

According to a sixth feature of the present invention, in addition to the fourth feature, the spacer includes a spacer main body part covering only an intermediate position of the water jacket in a depth direction, and the abutment means is provided to the spacer main body part.

According to the above-described configuration, the spacer includes the spacer main body part for covering only the intermediate position of the water jacket in the depth direction, and the abutment means is provided to the spacer main body part. Thereby, a passage in which the cooling water flows is formed in each of the two sides of the spacer main body part in the depth direction. In this case, the abutment means is provided to the spacer main body part, excluding the two sides of the spacer main body part in the depth direction, in which the respective passages are formed. For this reason, the abutment means can preferably exert a cooling effect without obstructing the flow of the cooling water.

According to a seventh feature of the present invention, in addition to the fourth feature, as said cylinder bore there are provided a plurality of cylinder bores and the water jacket is formed around the plurality of cylinder bores disposed in a straight line, the abutment means on the one side in the cylinder axis direction are provided so as to oppose to connecting areas between the adjacent cylinder bores, and the abutment means on the other side are provided so as to oppose to opposite end portions of the plurality of the cylinder bores in a direction of a cylinder row line.

According to the above-described configuration, it is desirable that: the water jacket should be formed around the multiple cylinder bores disposed in a straight line; the abutment means on the one side in the cylinder axis direction should be provided so as to oppose to the respective connecting areas between the adjacent cylinder bores; and the abutment means on the other side should be provided so as to oppose to the respective opposite end portions in the cylinder row line direction. In other words, the spacer is supported in the opposite end portions in the cylinder row line direction and the connecting areas between the adjacent cylinder bores, which are orthogonal to the cylinder row line direction. Thereby, it is possible to securely avoid the rotational movement of the spacer.

According to an eighth feature of the present invention, in addition to any one of the first to seventh features, the spacer is provided with a material introduction part used when the spacer is produced, the material introduction part being opposed to a connecting area between the adjacent cylinder bores, and jutting parts protruding toward the inner wall surface of the water jacket are provided respectively on opposite sides of the material introduction part in a direction of a cylinder row line.

According to above-described configuration, the jutting parts protruding toward the inner wall surface of the water jacket are provide on the opposite sides of the material introduction part of the spacer in the cylinder row line direction. These jutting parts support the spacer at their respective two points by abutting on the inner wall surface. Thereby, the looseness of the spacer can be inhibited. As a result, it is possible to stabilize the behavior of the spacer inserted in the water jacket. Note that the "abutment" in this respect does not necessarily means a full-time contact of the jutting parts with the inner wall surface of the water jacket, but includes restriction on a range of the rotational movement (sliding movement) of the spacer by narrowing the space-out distance (space, clearance) between the jutting parts and the inner wall surface. The present invention hereinafter will use the term "abutment" to express the same meaning and contents. Furthermore, it is difficult to make a dimension of the protrusion toward the inner wall surface equal among the material introduction parts. For this reason, the spacer can be supported in a predetermined position with higher precision by making the jutting parts abut on the inner wall surface than by making the material introduction parts abut on the inner wall surface.

According to a ninth feature of the present invention, in addition to the eighth feature, the jutting parts are provided closer to the inner wall surface of the water jacket than the material introduction part is.

According to the above-described configuration, the jutting parts are provided closer to the inner wall surface of the water jacket than the material introduction part is. Thereby, the jutting parts can be made to abut on the inner wall surface ahead of the material introduction part. For this reason, even if the material introduction part protrudes to some extent, its influence can be reduced.

According to a tenth feature of the present invention, in addition to the eighth feature, an opposing surface is formed between the jutting parts, the opposing surface extending substantially in parallel with the cylinder row line direction and being opposed to the connecting area, and the material introduction part is protrudingly provided on the opposing surface.

According to the above-described configuration, the opposing surface is formed between the jutting parts, the opposing surface extending substantially in parallel with the cylinder row line direction and being opposed to the connecting area, and the material introduction part is protrudingly provided on the opposing surface. Thereby, the inclination and looseness of the spacer can be preferably inhibited by making the jutting parts, which are disposed on the opposite sides of the opposing surface in the cylinder row line direction, evenly abut on the cylinder bore-side inner surface. Moreover, the opposing surface between the paired jutting parts is extended substantially in parallel with the cylinder row line direction across a gate which functions as an inlet port through which to inject a molding material. Thereby, the opposing surface is formed of a flat surface continuing in a straight line. When the spacer is produced, the flow of the material from the material introduction part to the jutting parts can be made better by forming the opposing surface as the flat surface than by forming the opposing surface between the paired jutting parts, for example, in a complicated shape including dents. Thus, the spacer can be supported more stable by forming the shapes of the jutting parts with higher precision.

The above description, other objects, characteristics and advantages of the present invention will be clear from detailed descriptions which will be provided for the preferred embodiment referring to the attached drawings.

BRIEF DESCRIPTION OF THE DRAWINGS

FIGS. 1 to 12C show a first embodiment of the present invention:

FIG. 1 is a perspective view of a cylinder block of an internal combustion engine with four cylinders mounted in a straight line;

FIG. 2 is a perspective view of a spacer;

FIG. 3 is a view seen from a direction of an arrow 3 in FIG. 1;

FIG. 4 is a view seen from a direction of an arrow 4 in FIG. 3;

FIG. 5 is a sectional view taken along a line 5-5 in FIG. 3;

FIG. 6 is an enlarged view of a part indicated by an arrow 6 in FIG. 5;

FIG. 7 is a sectional view taken along a line 7-7 in FIG. 3;

FIG. 8 is a sectional view taken along a line 8-8 in FIG. 3;

FIG. 9 is a sectional view taken along a line 9-9 in FIG. 3;

FIG. 10 is a sectional view taken along a line 10-10 in FIG. 3;

FIG. 12C is a sectional view taken along a line C-C in FIG. 12B.

In addition, FIGS. 13 to 28 show a second embodiment of the present invention:

FIG. 13 is a schematic perspective view of an internal combustion engine in which a spacer is fitted;

FIG. 14 is an exploded perspective view of a cylinder block and the spacer which constitute a part of the internal combustion engine;

FIG. 16 is a plan view of the cylinder block shown in FIG. 13;

FIG. 17 is a longitudinal sectional view taken along a line A-A in FIG. 16;

FIG. 18 is a see-through side view of the spacer inserted inside a water jacket in the cylinder block;

FIG. 20 is a perspective view of a spacer according to a modification of the embodiment;

FIG. 22 is a longitudinal sectional view taken along a line B-B in FIG. 16;

FIG. 24 is a longitudinal sectional view taken along a line E-E in FIG. 23A;

FIG. 25 is a longitudinal sectional view taken along a line D-D in FIG. 16;

FIG. 26 is an explanatory drawing showing a process for producing the spacer by hardening a molten resin material which has been injected in cavities of a molding die;

FIG. 28 is a partially-broken enlarged perspective view showing a tapered surface formed in an inner wall surface of the water jacket.

BRIEF DESCRIPTION OF THE DRAWINGS

Descriptions will be hereinbelow provided for a first embodiment of the present invention on the basis of FIGS. 1 to 12C.

Figure 1:
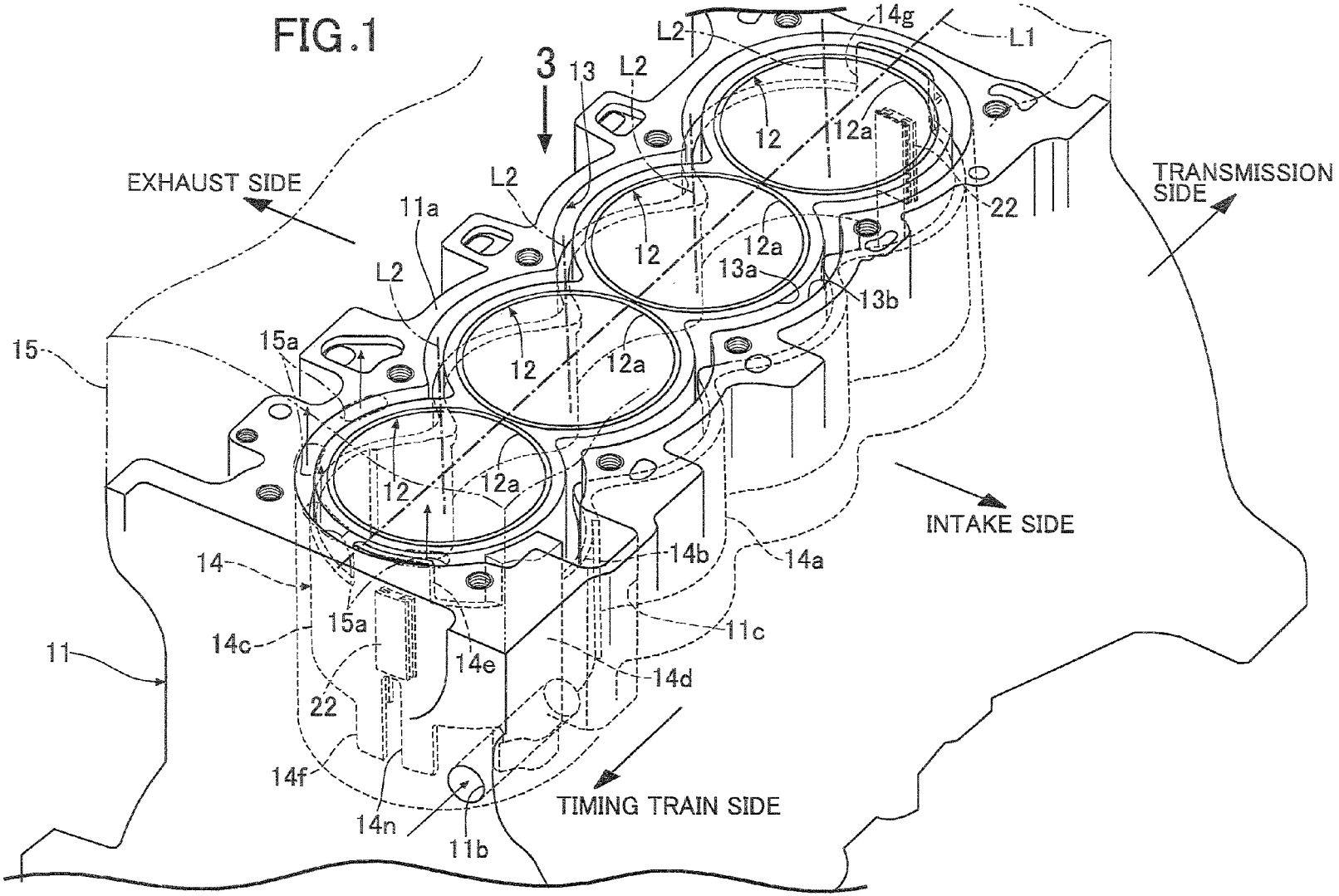

As shown in FIG. 1, four cylinder sleeves 12 are embedded along a cylinder row line L1 in a cylinder block 11 of an internal combustion engine with four cylinders mounted in a straight line. A water jacket 13 is formed to surround the outer peripheral surfaces of the respective cylinder sleeves 12. The cylinder block 11 according to this embodiment is of a Siamese type, and no portion of the water jacket 13 is formed between each neighboring two of the cylinder sleeves 12. Thereby, the shortening of the dimension of the internal combustion engine in the cylinder row line L1 direction is achieved. The water jacket 13 opened in a deck surface 11*a* of the cylinder block 11 extends downward from the deck surface 11*a* toward a crankcase up to a certain depth. A spacer 14 made of a synthetic resin is arranged in an interstice between an inner wall surface 13*a* and an outer wall surface 13*b* of the water jacket 13. The spacer 14 is inserted in the interstice therebetween from the opening in the deck surface 11*a* of the cylinder block 11.

Note that with regard to an "up-and-down direction" in this description, the cylinder head side in a cylinder axis line L2 direction is defined as "upper," and the crankcase side in the cylinder axis line L2 direction is defined as "lower."

As clear from FIGS. 1 to 5, the spacer 14 includes a spacer main body part 14*a*, a cooling water inlet port part 14*b* and a cooling water outlet port part 14*c*. The entire peripheries of four cylinder bores 12*a* in the cylinder bock 11 are surrounded by the spacer main body part 14*a*, the cooling water inlet port part 14*b* and the cooling water outlet port part 14*c*. The cooling water inlet port part 14*b* surrounds an intake-side portion of one cylinder bore 12*a* which is situated on a first end side in the cylinder row line L1 direction (on a timing train side). The cooling water outlet port part 14*c* surround the first end-side portion of the cylinder bore 12*a* in the cylinder row line L1 direction and an exhaust side-portion of the cylinder bore 12*a*. A partition wall 14*d* is integrally provided in a position which is slightly offset from the first end-side portion of the spacer 14 in the cylinder row line L1 direction to the intake-side portion of the space 14, and which intervenes between the cooling water inlet port part 14*b* and the cooling water outlet port part 14*c*. The partition wall 14*d* is formed thicker than the spacer main body part 14*a*, and projects upward from the upper edges of the cooling water inlet port part 14*b* and the cooling water outlet port part 14*c*, and downward from the lower edges of the cooling water inlet port part 14*b* and the cooling water outlet port part 14*c*.

Inside the water jacket 13, an upper cooling water passage 13*c* surrounding the peripheries of the respective four cylinder bores 12*a* is formed between the upper edge of the spacer main body part 14*a* and an undersurface of a cylinder head 15. In addition, a lower cooling water passage 13*d* surrounding the peripheries of the respective four cylinder bores 12*a* is formed between the lower edge of the spacer main body part 14*a* and the bottom portion of the water jacket 13.

An upper support leg 14*e* and a lower support leg 14*f* project to the insides of the upper cooling water passage 13*c* and the lower cooling water passage 13*d*, respectively, from a position at which the cylinder row line L1 intersects the cooling water outlet port part 14*c* on its first end side. In addition, an upper support leg 14*g* and a lower support leg 14*h* project to the insides of the upper cooling water passage 13*c* and the lower cooling water passage 13*d*, respectively, from a position at which the cylinder row line L1 intersects the spacer main body part 14*a* on its second end side (on the side closer to a transmission). For this reason, when the spacer 14 is attached to the inside of the water jacket 13, the lower ends of the respective paired lower support legs 14*f*, 14*h* are in contact with the bottom portion of the water jacket 13, and the upper ends of the respective paired upper support legs 14*e*, 14*g* are in contact with the undersurface of a gasket 16 held between the cylinder block 11 and the cylinder head 15, in the opposite end portions in the cylinder row line L1 direction. Thereby, the spacer 14 is positioned in the up-and-down direction.

Pistons 18 connected to a crankshaft 17 are slidably fitted in the respective cylinder bores 12*a*. Top rings 19, second rings 20 and oil rings 21 are attached to top parts 18*a* of the pistons 18, respectively.

Descriptions will be hereinbelow provided for the detailed structure of the spacer 14 sequentially.

Figure 3:
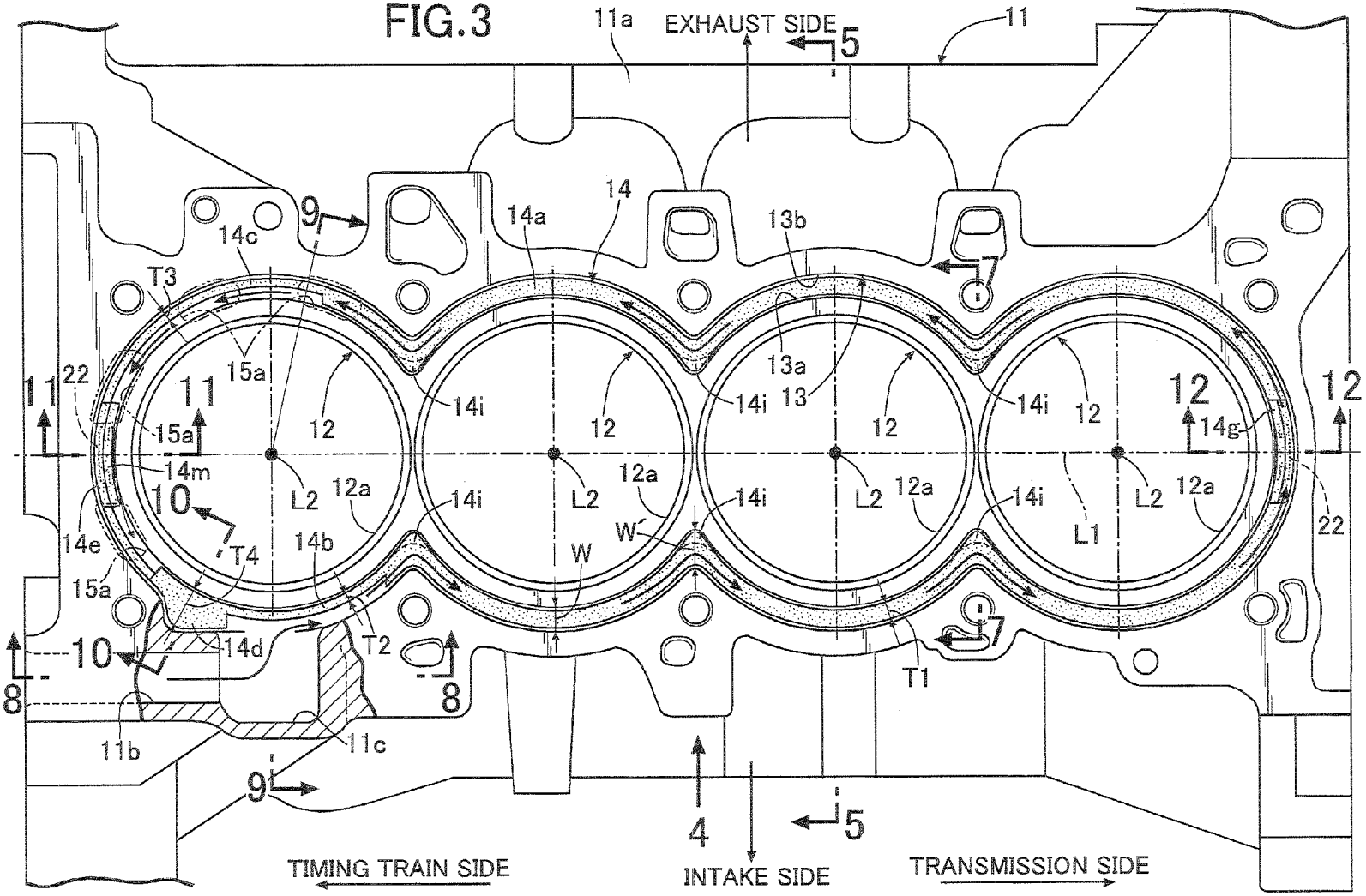
Figure 4:
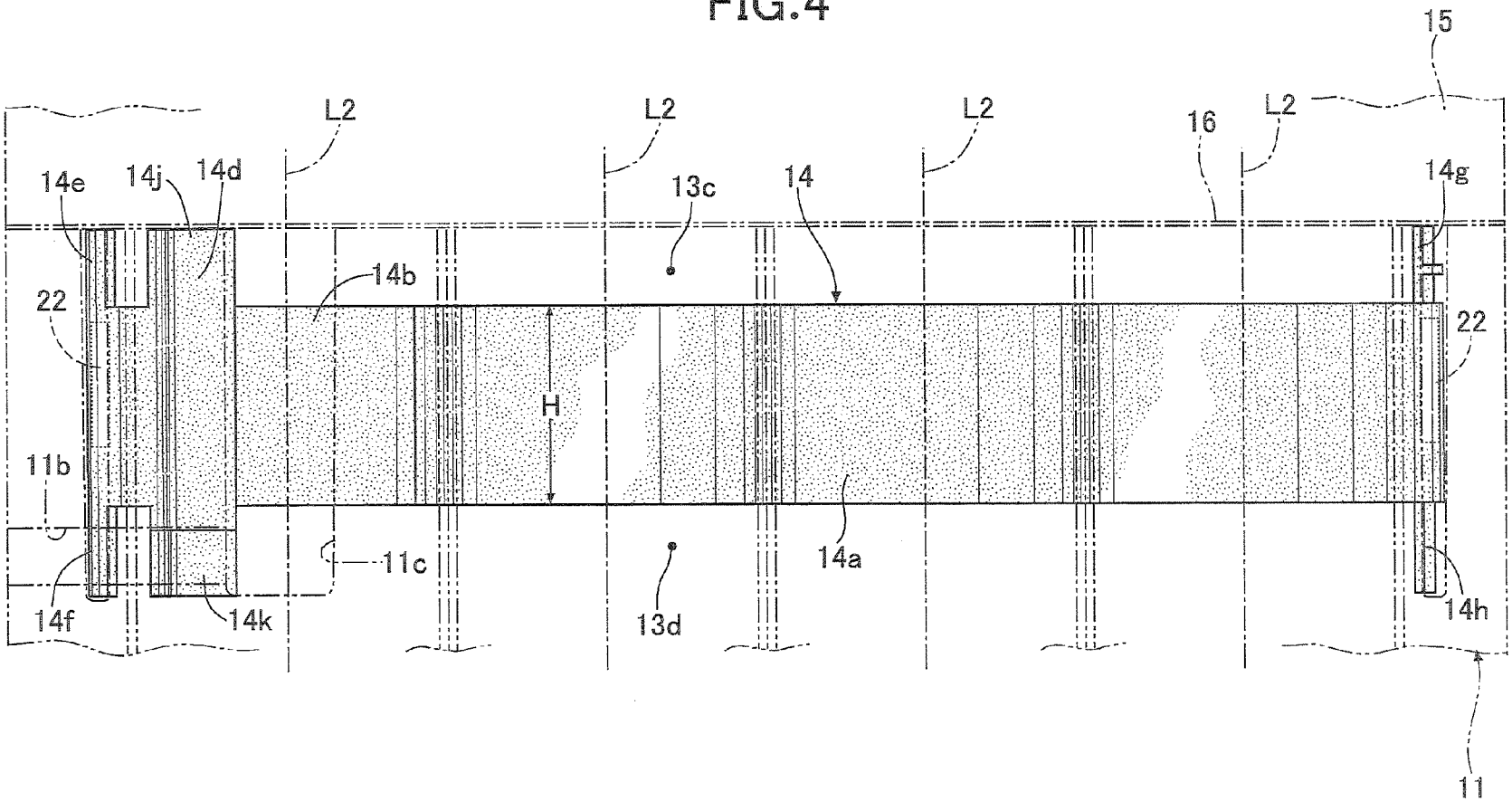

As clear from FIG. 4, the heights of the spacer main body part 14*a*, the cooling water inlet port part 14*b* and the cooling water outlet port part 14*c* of the spacer 14 in a cylinder axis line L2 direction are constant H throughout peripheries thereof. As clear from FIGS. 2 and 3, the thickness T1 of the spacer main body part 14*a* is basically constant. However, the thickness T2 of the cooling water inlet port part 14*b* is thinner than the thickness T1 of the spacer main body part 14*a*, and the thickness T3 of the cooling water outlet port part 14*c* is thinner than the thickness T1 of the spacer main body part 14*a*. In addition, the thickness T4 of the partition wall 14*d* is thicker than the thickness T1 of the spacer main body part 14*a*. The inner peripheral surface of the cooling water inlet port part 14*b* is flush with the inner peripheral surface of the spacer main body part 14*a*. The outer peripheral surface of the cooling water inlet port part 14*b* is offset inward in a radial direction from the outer peripheral surface of the spacer main body part 14*a* by a step. Furthermore, the outer peripheral surface of the cooling water outlet port part 14*c* is flush with the outer peripheral surface of the spacer main body part 14*a*. The inner peripheral surface of the cooling water outlet port part 14*c* is offset outward in the radial direction from the inner peripheral surface of the spacer main body part 14*a* by a step.

Figure 5:
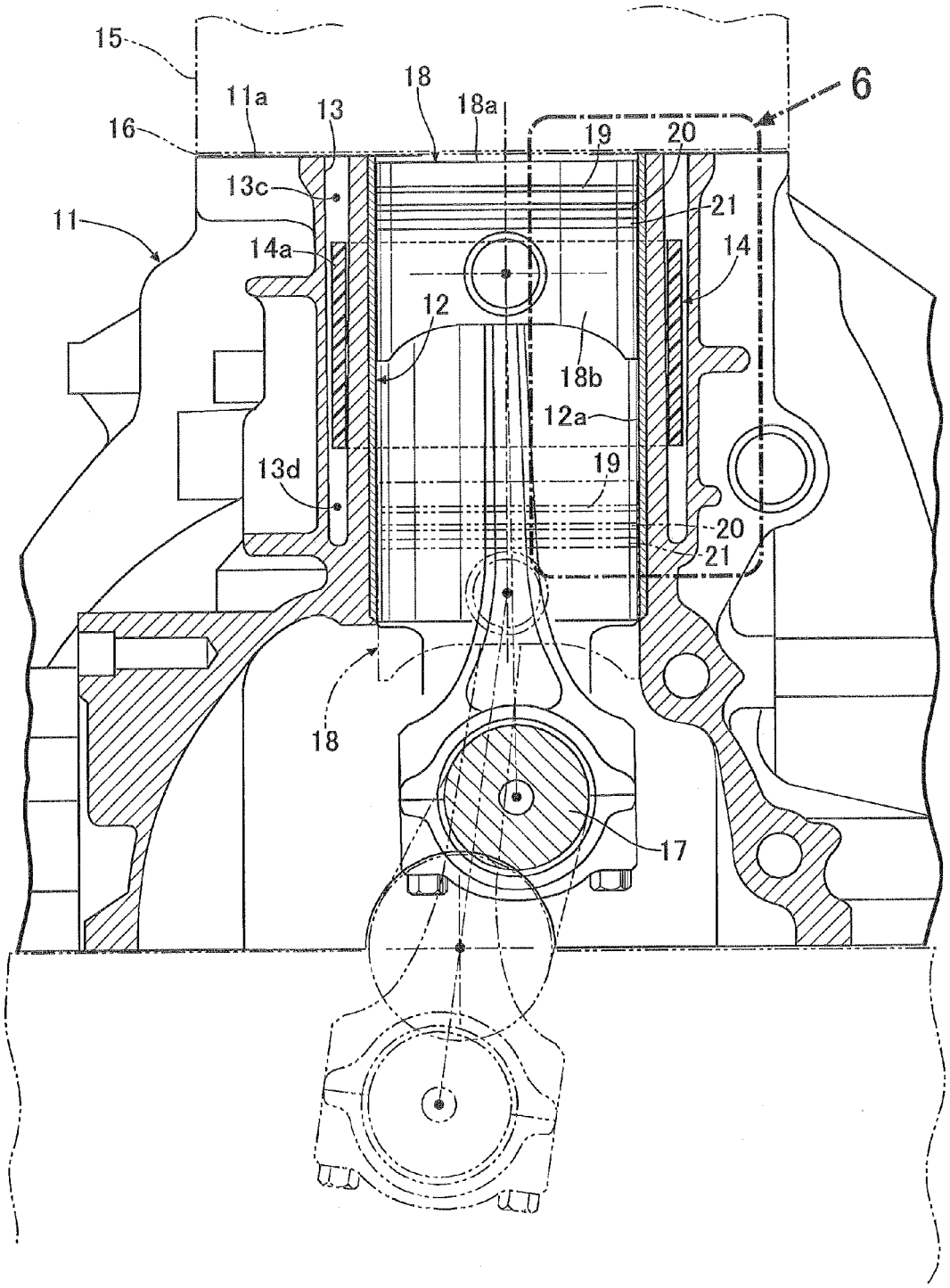

As clear from FIG. 5, while the pistons 18 are moving in the respective cylinder bores 12*a* up and down in response to rotation of the crankshaft 17, side thrusts acting between the pistons 18 and the cylinder bores 12*a* change periodically. Each side thrust reaches a maximum when the corresponding one of the pistons 18 reaches a position of the expansion stroke which is indicated by the continuous line (for example, a position where the crank angle is at 15° after the compression top dead center). The up-and-down position of the spacer 14 inside the water jacket 13 is set in such a way that the top ring 19, the second ring 20 and the oil ring 21 of each of the pistons 18 are located above the upper edge of the spacer 14, and a skirt part 18*b* of the piston 18 is located below the upper edge of the spacer 14 when the piston 18 is located at the position maximizing the side thrust. Furthermore, the up-and-down position of the spacer 14 inside the water jacket 13 is set in such a way that the top ring 19, the second ring 20 and the oil ring 21 of each of the pistons 18 are located below the lower edge of the spacer 14 when the piston 18 is located at the bottom dead center position indicated by the chain line.

Figure 6:
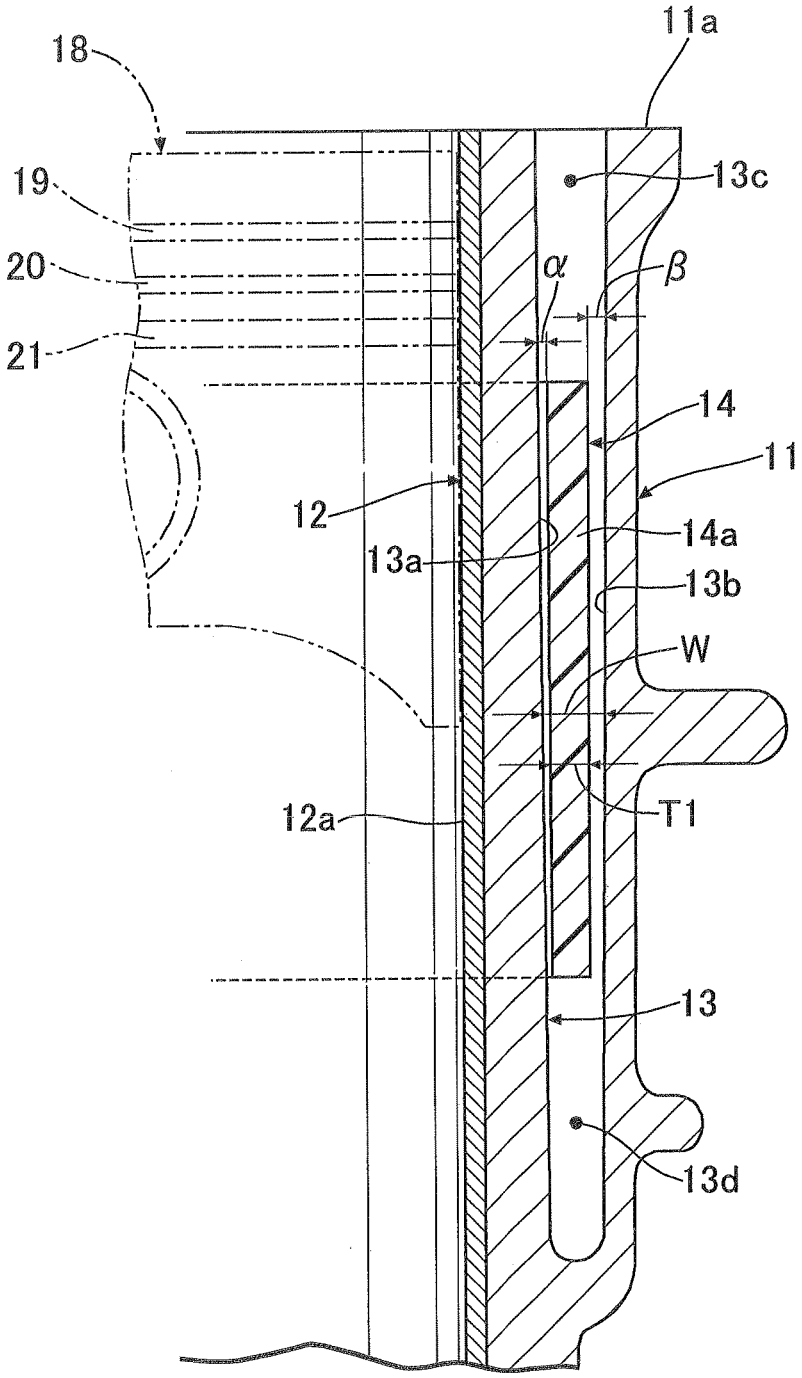

As clear from FIG. 6, the thickness T1 of the spacer main body part 14*a* is set slightly less than the width W of the water jacket 13 in which the spacer main body part 14*a* is fitted. The reason for this is to prevent the assemblability from deteriorating due to friction of the spacer 14 with the inner wall surface 13*a* and the outer wall surface 13*b* of the water jacket 13 resulting from the fact that the dimensional precision of the inner wall surface 13*a* and the outer wall surface 13*b* of the water jacket 13, which have been subjected to no process since casted, is not high. Accordingly, when the spacer 14 is assembled inside the water jacket 13, a space $\alpha$ is formed between the inner peripheral surface of the spacer main body part 14*a* and the inner wall surface 13*a* of the water jacket 13, and a space $\beta$ is formed between the outer peripheral surface of the spacer main body part 14*a* and the outer wall surface 13*b* of the water jacket 13. The spacer main body part 14*a* is arranged therein in such a way that the space $\alpha$ is set smaller than the space $\beta$, that is to say, the spacer main body part 14*a* is closer to the inner wall surface 13*a* of the water jacket 13 than to the outer wall surface 13*b* thereof.

Figure 7:
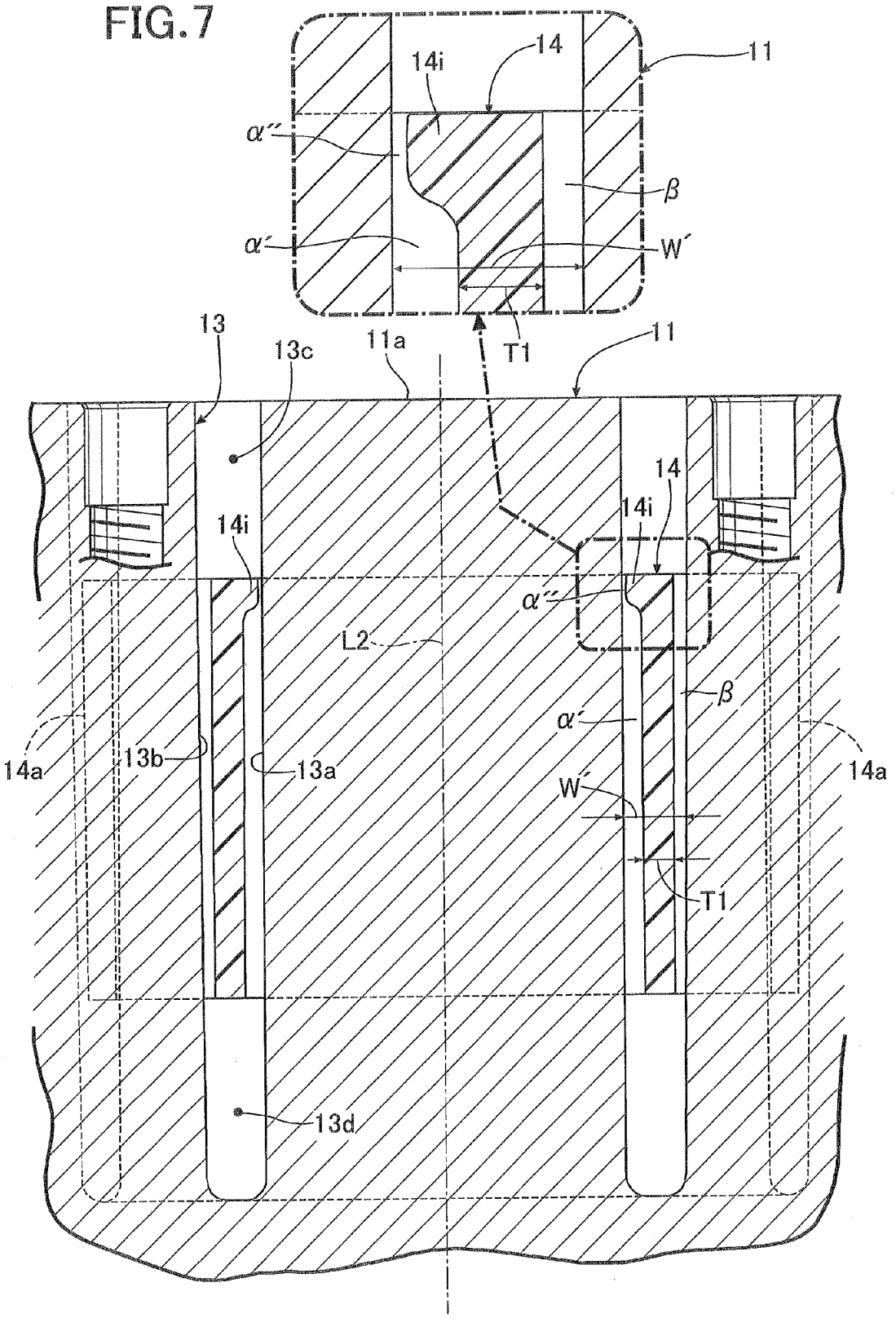
Figure 8:
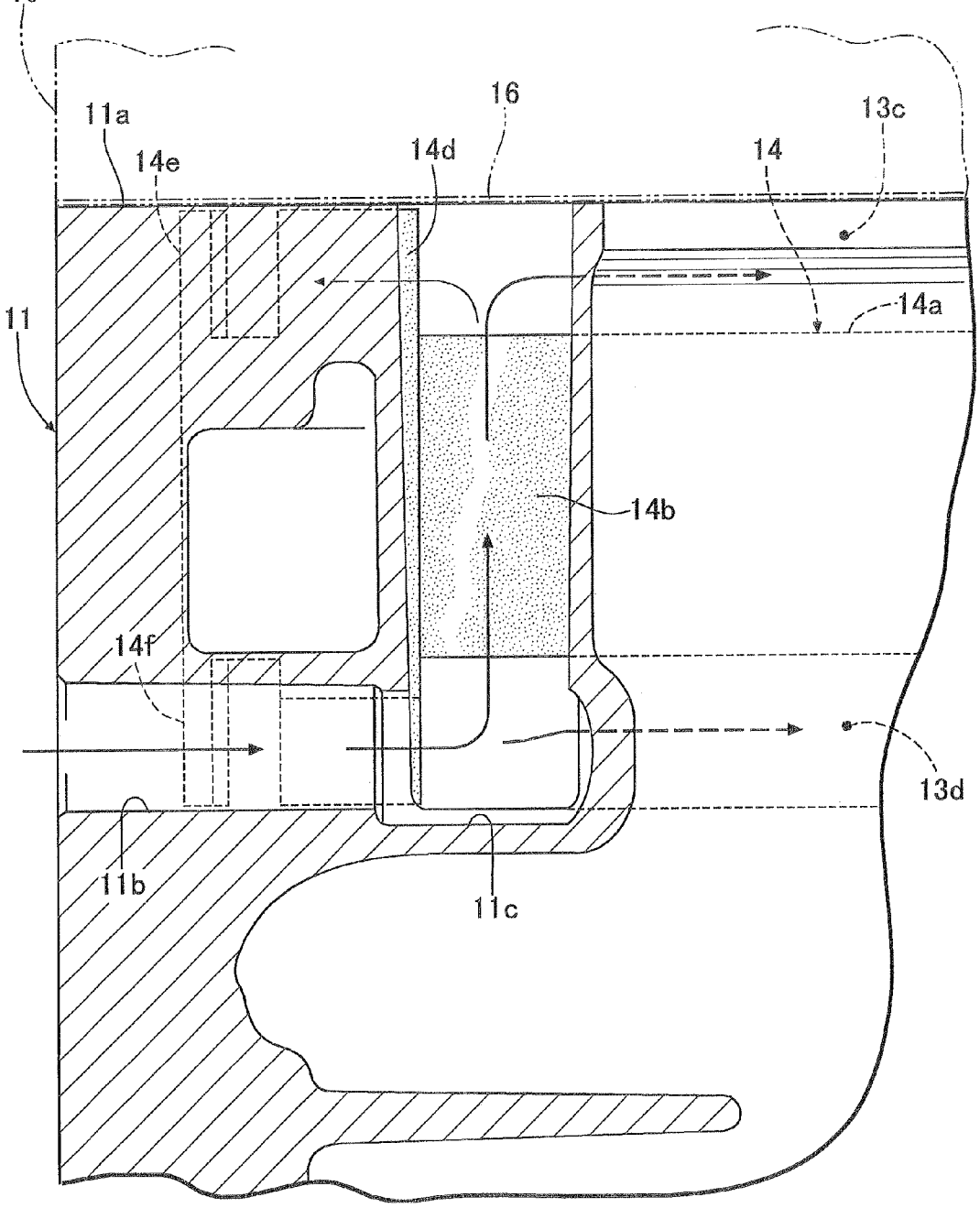
Figure 9:
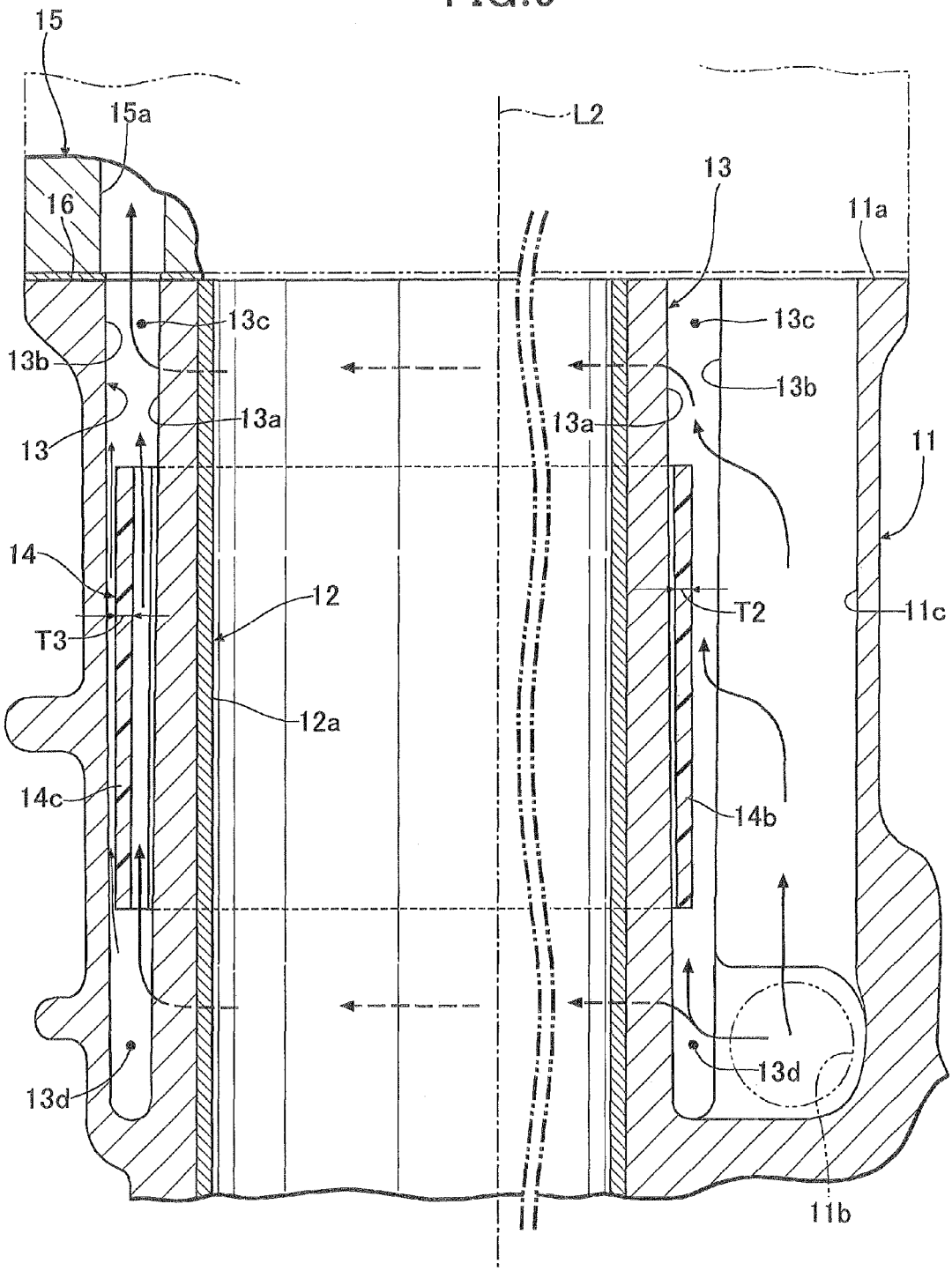
Figure 10:
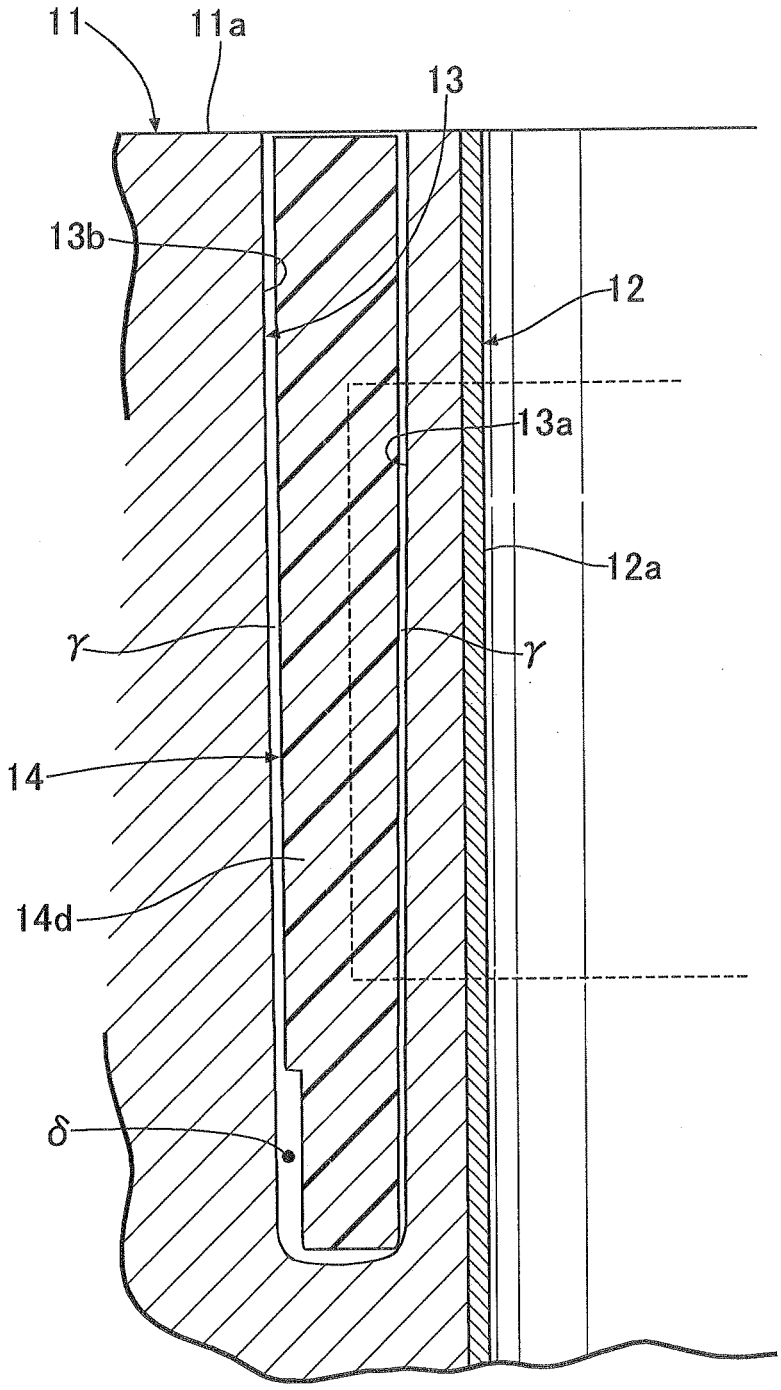
Figure 11B:
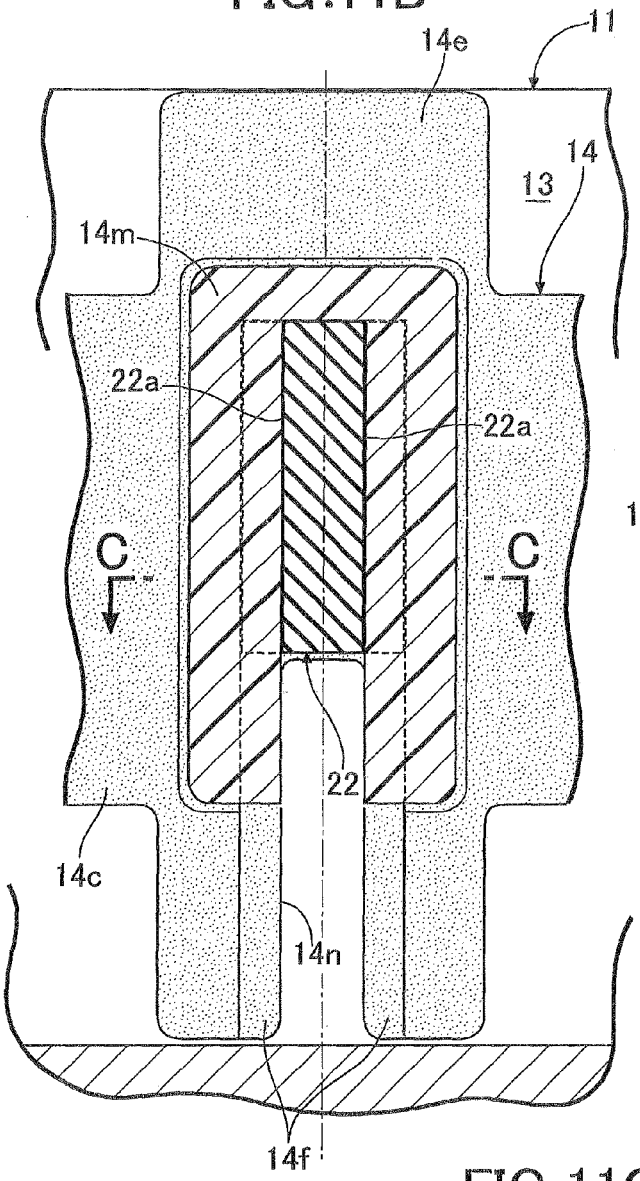
FIG. 11B is a sectional view taken along a line B-B in FIG. 11A.
Figure 11A:
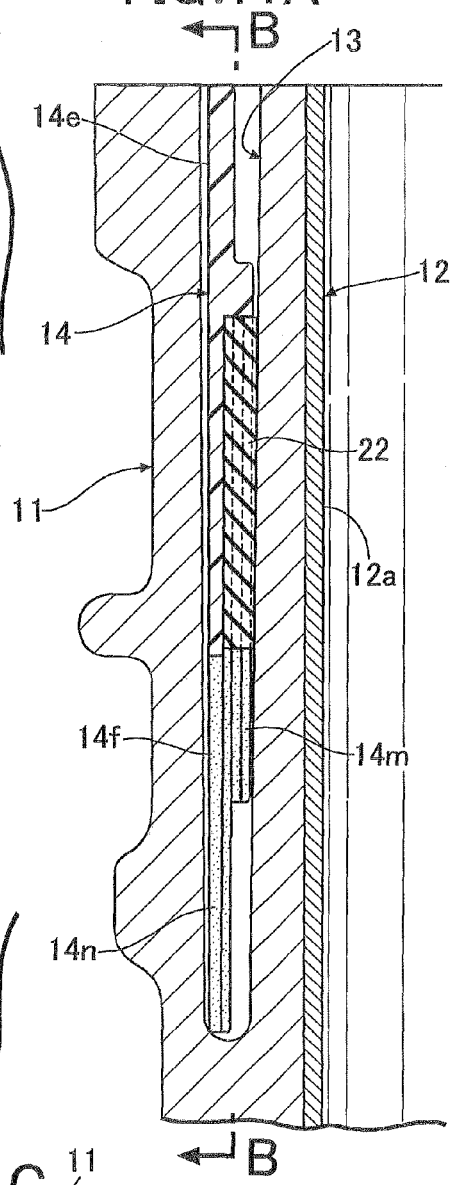
FIG. 11A is a sectional view taken along a line 11-11 in FIG. 3.
Figure 11C:
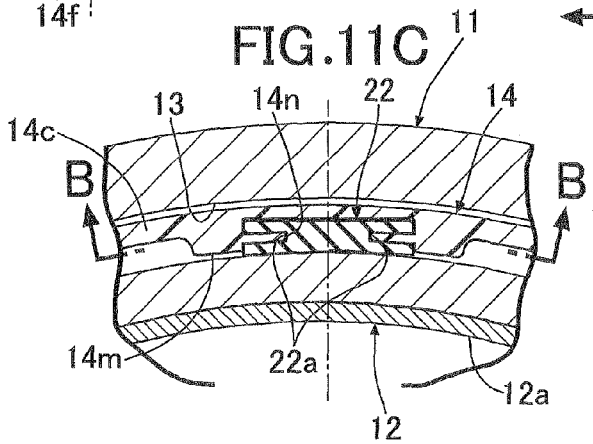
FIG. 11C is a sectional view taken along a line C-C in FIG. 11B.
Figure 12B:
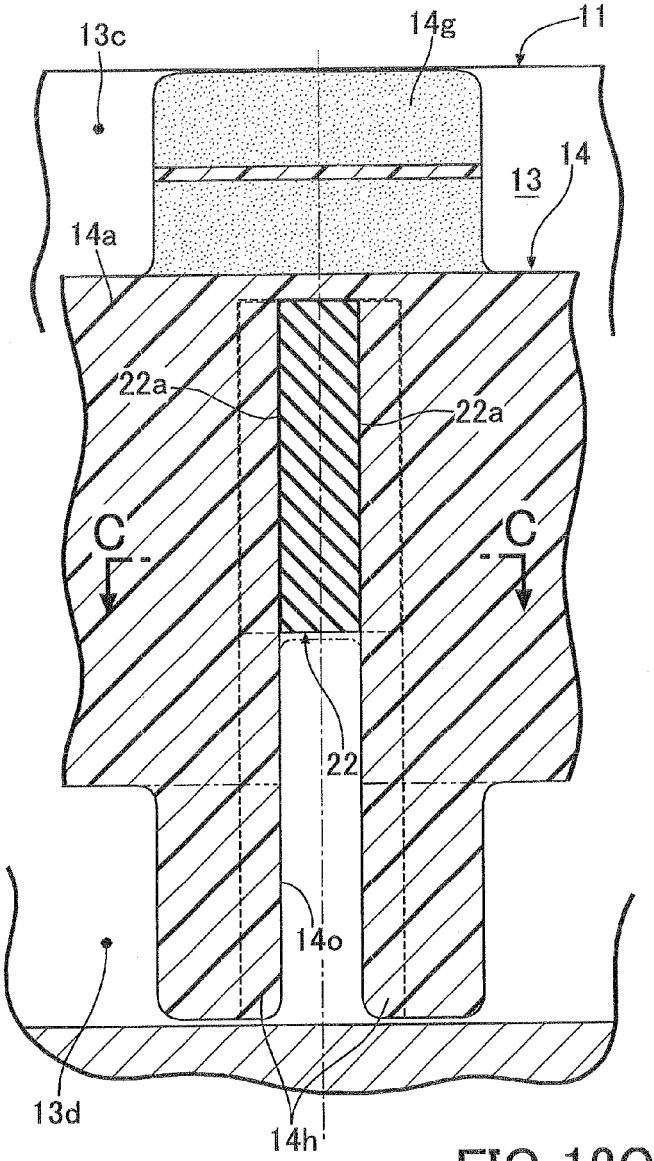
FIG. 12B is a sectional view taken along a line B-B in FIG. 12A.
Figure 12A:
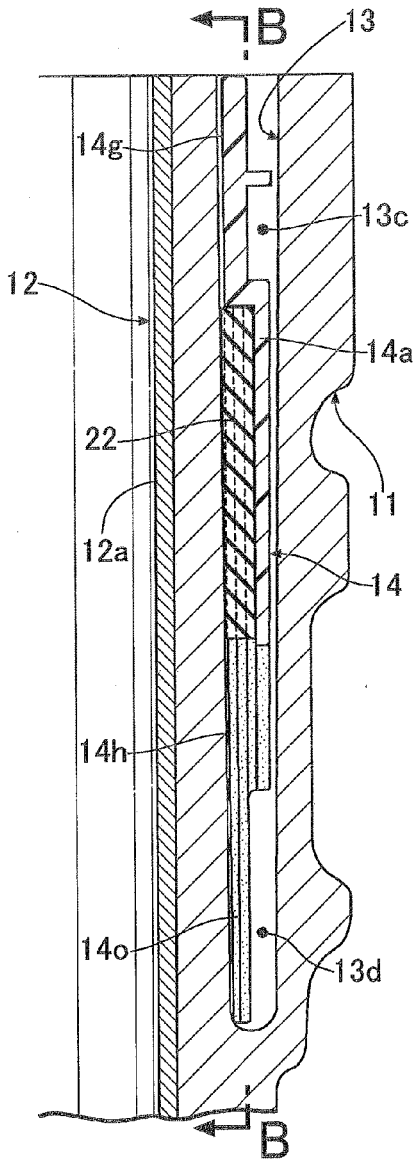
FIG. 12A is a sectional view taken along a line 12-12 in FIG. 3.
Figure 12C:
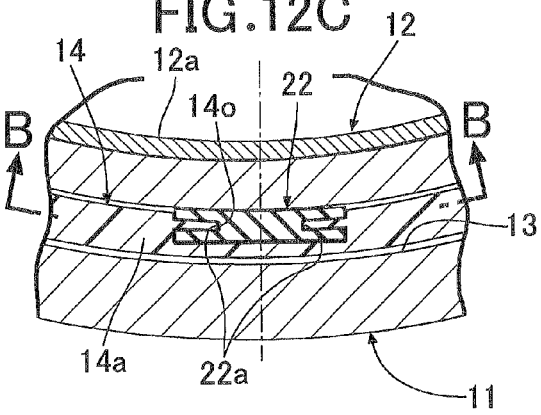

As clear from FIGS. 3 and 7, portions of the water jacket 13 which respectively surround the corresponding two adjacent cylinder sleeves 12, 12 intersect at an acute angle in each inter-bore portion in the cylinder block 11, which is a position at which the corresponding two cylinder sleeves 12, 12 are close to each other. For this reason, a width W' of a portion of the water jacket 13 in a direction orthogonal to the cylinder row line L1 is wider than the width W of any other portion of the water jacket 13. On the other hand, a thickness of a portion of the spacer main body part 14*a* in each inter-bore portion is equal to T1 which is the thickness of any other portion of the spacer main body part 14*a*. For this reason, a space $\alpha'$ between the inner peripheral surface of the spacer main body part 14*a* and the inner wall surface 13*a* of the water jacket 13 in each inter-bore portion is exceptionally larger than the space $\alpha$ therebetween in any other portion.

Nevertheless, in each inter-bore portion in which the corresponding two cylinder sleeves 12, 12 are closer to each other, projection parts 14*i* are formed in an upper end of the spacer main body part 14*a*. A space $\alpha''$ between the tip end portion of each projection part 14*i* and the inner wall surface 13*a* of the water jacket 13 is set smaller than the space $\alpha$.

As clear from FIGS. 1 to 3, 8 and 9, a cooling water supplying passage 11*b* extends from the timing train-side end surface of the cylinder block 11 toward the transmission. A cooling water supplying chamber 11*c* communicating with a downstream end of this cooling water supplying passage 11*b* faces the cooling water inlet port part 14*b* of the spacer 14 which is accommodated in the water jacket 13.

As clear from FIGS. 1 to 3 and FIG. 9, four communication holes 15*a* which are opened in the undersurface of a water jacket (not illustrated) formed in the cylinder head 15 face the upper portion of the cooling water outlet port part 14*c* of the spacer 14 accommodated in the water jacket 13. If the spacer main body part 14*a* would be extended to the position of the cooling water outlet part 14*c*, the position of the cooling water outlet port part 14*c* would roughly overlap the spacer main body part 14*a* thus extended.

As clear from FIGS. 1 to 3 and FIG. 10, the partition wall 14*d* interposed between the cooling water inlet port part 14*b* and the cooling water outlet port part 14*c* of the spacer 14 has a minimum microspace γ (refer to FIG. 10), which enables the spacer 14 to be assembled, between the inner wall surface 13*a* and the outer wall surface 13*b* of the water jacket 13. A microspace δ through which the cooling water can pass is formed between the lower end portion of the partition wall 14*d* and the outer wall surface 13*b* of the water jacket 13. Like the upper support legs 14*e*, 14*g* and the lower support legs 14*f*, 14*h*, the upper end portion and the lower end portion of the partition wall 14*d* has a function of positioning the spacer 14 inside the water jacket 13 in the up-and-down direction.

As clear from FIG. 2 and FIGS. 11A to 11C, a portion interposed between the upper support leg 14*e* and the lower support leg 14*f* in the timing train-side end portion of the spacer 14 (a portion corresponding to the cooling water outlet port part 14*c*) is a thickness part 14*m* which is as thick as the spacer main body part 14*a*. A slit 14*n* extending in the up-and-down direction is formed ranging from the lower end of the lower support leg 14*f* to the upper end of the thickness part 14*m*. A slit 22*a* of a rubber-made fixing member 22 having an H-shaped horizontal cross section is fitted in and thus attached to the slit 14*n*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*n* which is exposed to the lower support leg 14*f* aims at enhancing the assemblability by decreasing the resistance of pressure-insertion of the fixing member 22.

As clear from FIG. 2 and FIGS. 12A to 12C, a slit 14*o* extending in the up-and-down direction from the lower end of the lower support leg 14*h* to the lower end of the upper support leg 14*g* is formed in the transmission-side end portion of the spacer main body part 14*a*. Another rubber-made fixing member 22 having an H-shaped horizontal cross section is attached to the slit 14*o*. The fixing member 22 is attached thereto in a range of the height in the up-and-down-direction of the spacer main body part 14*a*. Although the outer peripheral surface of the fixing member 22 is not exposed to the outer peripheral surface of the spacer 14, the inner peripheral surface of the fixing member 22 is exposed to the inner peripheral surface of the spacer 14, and thus elastically abuts on the inner wall surface 13*a* of the water jacket 13. A portion of the slit 14*o* which is exposed to the lower support leg 14*h* aims at enhancing the assemblability by decreasing the resistance of pressure-insertion of the fixing member 22.

The two fixing members 22, 22 both are arranged on the cylinder row line L1. Accordingly, the intake side portion and the exhaust side portion of the spacer 14 are basically symmetrical with respect to a line joining the two fixing members 22, 22 (in other words, the cylinder row line L1).

The slits 14*n*, 14*o* are opened downward. The fixing members 22, 22 are upward fitted in the slits 14*n*, 14*o*, respectively. For these reasons, when the spacer 14 to which the fixing members 22, 22 are attached is inserted inside the water jacket 13, the fixing members 22, 22 are unlikely to come off the slits 14*n*, 14*o* even if the fixing members 22, 22 are pushed upward by friction forces acting between the fixing members 22, 22 and the inner wall surface 13*a* of the water jacket 13.

Next, descriptions will be provided for the operation of the embodiment of the present invention having the foregoing configuration.

Before the cylinder head 15 is assembled to the deck surface 11*a* of the cylinder block 11, the water jacket 13 is opened to surround the outer peripheries of the cylinder bores 12*a* of the four cylinder sleeves 12 exposed to the deck surface 11*a*, respectively. The spacer 14 is inserted inside the water jacket 13 from the opening. Thereafter, the cylinder head 15 is fastened to the cylinder block 11 with the gasket 16 overlapping the deck surface 11*a* of the cylinder block 11.

When this spacer 14 is assembled therein, the lower ends of the lower support legs 14*f*, 14*h* and the lower end of a lower protrusion 14*k* of the partition wall 14*d* is in contact with the bottom portion of the water jacket 13, as well as the upper ends of the upper support legs 14*e*, 14*g* and the upper end of an upper protrusion 14*j* of the partition wall 14*d* are in contact with the undersurface of the gasket 16. Thereby, the spacer 14 is positioned in the cylinder axis line L2 direction. At this time, the inner peripheral surface of the spacer main body part 14*a* of the spacer 14 is arranged close to the inner wall surface 13*a* of the water jacket 13. However, because the dimensional precision of the inner wall surface 13*a* of the water jacket 13 which has been subjected no process since casted is not high, the slight space α (refer to FIG. 6) is formed between the inner peripheral surface of the spacer main body part 14*a* and the inner wall surface 13*a* of the water jacket 13 for the purpose of preventing the assemblability from deteriorating due to friction of the spacer 14 with the inner wall surface 13*a* of the water jacket 13.

If the spacer 14 moves in the up-and-down direction inside the water jacket 13 due to vibrations and the like during the operation of the internal combustion engine, there is a possibility that the upper ends of the upper support legs 14*e*, 14*g* and the upper end of the upper protrusion 14*j* of the partition wall 14*d* may damage the undersurface of the gasket 16. However, the two fixing members 22, 22 provided on the respective opposite ends in the cylinder row line L1 direction fix the spacer 14 to the water jacket 13 in order that the spacer 14 cannot move relative to the water jacket 13. This prevents haphazard movement of the spacer 14 from damaging the gasket 16.

At this time, not only can the spacer 14 be firmly fixed to the inside of the water jacket 13 because the fixing member 22, 22 are provided in the respective two highly-rigid end portions of the spacer 14 in the cylinder row line L1 direction, but also the influence of heat on the rubber-made fixing members 22, 22 attached to the respective opposite end portions of the cylinder block 11 in the cylinder row line L1 direction can be suppressed to a minimum because the opposite end portions of the cylinder block 11 are lower in temperature than the intake-side and exhaust-side side surfaces of the cylinder block 11.

In addition, because the fixing members 22, 22 are provided in the respective intermediate portions of the spacer 14 in the cylinder axis line L2 direction, in other words, in the range of the height of the spacer main body part 14*a*, it is possible to prevent the blockage of the flow of the cooling water in the upper cooling water passage 13*c* and in the lower cooling water passage 13*d* by the fixing members 22, 22, which would otherwise occur. In addition, because the timing train-side fixing member 22 of the spacer 14 is provided in the cooling water outlet port part 14*c*, the fixing member 22 does not affect the flow of the cooling water in the upper cooling water passage 13*c* and in the lower cooling water passage 13*d*. Furthermore, the flow speed of the cooling water decreases due to the U-turn of the cooling water in the transmission-side end portion of the water jacket 13. Accordingly, the influence of the fixing member 22 on the flow of the cooling water can be made smaller when the fixing member 22 is provided in the transmission-side end portion of the water jacket 13 than when the fixing member 22 is provided in the intake-side and exhaust-side side wall of the water jacket 13.

The timing train-side upper support leg 14*e* and lower support leg 14*f* of the spacer 14 are formed thinner in the radial direction than the thickness T1 of the spacer main body part 14*a*, and are arranged offset toward the outer wall surface 13*b* of the water jacket 13 inside the upper cooling water passage 13*c* and the lower cooling water passage 13*d*. In addition, the transmission-side upper support leg 14*g* and the lower support leg 14*h* of the spacer 14 are formed thinner in the radial direction than the thickness T1 of the spacer main body part 14*a*, and are arranged offset toward the inner wall surface 13*a* of the water jacket 13 inside the upper cooling water passage 13*c* and the lower cooling water passage 13*d*. Thereby, the influence of the upper support legs 14*e*, 14*g* and the lower support legs 14*f*, 14*h* on the flow of the cooling water in the upper cooling water passage 13*c* and in the lower cooling water passage 13*d* can be suppressed to a minimum. In addition, the upper support legs 14*e*, 14*g* and the lower support legs 14*f*, 14*h* are curved in the shape of an arc along the forms of the inner wall surface 13*a* and the outer wall surface 13*b* of the water jacket 13. Accordingly, the influence on the flow of the cooling water can be made much smaller.

Furthermore, out of the four cylinder bores 12*a*, their portions situated outermost in the cylinder row line L1 direction are less susceptible to heat from the other cylinder bores 12*a*. For this reason, the temperature of such portions is relatively low. On the other hand, out of the four cylinder bores 12*a*, portions situated on the intake side and exhaust side with respect to the cylinder row line L1 are susceptible to heat from their adjacent cylinder bores 12*a*. For this reason, the temperature of such portions is relatively high. In the present embodiment, the upper support legs 14*e*, 14*g* and the lower support legs 14*f*, 14*h* are provided in the outermost positions in the cylinder row line L1 direction in which the temperature of the cylinder bores 12*a* is relatively low. For this reason, even if the flow of the cooling water in the water jacket 13 is more or less blocked by the upper support legs 14*e*, 14*g* and the lower support legs 14*f*, 14*h*, the influence can be suppressed to a minimum, and the temperatures of the respective cylinder bores 12*a* can be made uniform.

In particular, the transmission-side upper support leg 14*g* and lower support leg 14*h* are arranged along the inner wall surface 13*a* of the water jacket 13 which faces the transmission-side lower-temperature portion of the corresponding cylinder bore 12*a*. For this reason, it is possible to make the cooling water less likely to come into contact with the inner wall surface 13*a* of the water jacket 13 by use of the upper support leg 14*g* and the lower support leg 14*h*, and to thermally insulate the cylinder bore 12*a*, whose temperature is relatively low. This makes it possible to make the temperatures of the respective cylinder bores 12*a* much more uniform.

The fixing members 22, 22 are made of the rubber, as well as are fitted in and fixed to the slits 14*n*, 14*o* of the spacer 14. For this reason, the fixing members 22, 22 can be fixed to the spacer 14 without any specialized members, such as bolts. In addition, the positions at which the fixing members 22, 22 are provided are immediately above the lower support legs 14*f*, 14*h*. For this reason, it is possible to prevent the spacer 14 from deforming in a twisted manner when: the spacer 14 is downward pushed into the inside of the water jacket 13 while putting the fixing members 22, 22 in pressure contact with the inner wall surface 13*a* of the water jacket 13; the lower ends of the lower support legs 14*f*, 14*h* subsequently come in contact with the bottom portion of the water jacket 13; and the spacer 14 receives an upward force.

During the operation of the internal combustion engine, the cooling water supplied from a water pump (not illustrated) provided to the cylinder block 11 flows into the water jacket 13 from the cooling water supplying passage 11*b*, which is provided in the timing train-side end portion of the cylinder block 11, through the cooling water supplying chamber 11*c*. The spacer 14 is arranged inside the water jacket 13. The thickness T2 of the cooling water inlet port part 14*b* of the spacer 14, which faces the cooling water supplying chamber 11*c*, is thinner than the thickness T1 of the spacer main body part 14*a*. In addition, the cooling water inlet port part 14*b* is offset inward in the radial direction. For these reasons, the flow of the cooling water bifurcates into upper and lower streams along the radial-direction outer surface of the cooling water inlet port part 14*b*, and the cooling water thus smoothly flows into the upper cooling water passage 13*c* and the lower cooling water passage 13*d* of the water jacket 13.

The cooling water having flown into the upper cooling water passage 13*c* and the lower cooling water passage 13*d* of the water jacket 13 tends to bifurcate in the left and right directions. However, the flow of the cooling water is once blocked by the partition wall 14*d* existing on the left of the cooling water inlet port part 14*b*. For this reason, the direction of the flow of the cooling water is turned to the right. Subsequently, the cooling water flows counterclockwise in the upper cooling water passage 13*c* and the lower cooling water passage 13*d* in almost full length. Finally, the cooling water is discharged to the communication holes 15*a* in the cylinder head 15 from the cooling water outlet port part 14*c* which is situated on the opposite side of the partition wall 14*d* from the cooling water inlet port part 14*b*. While the cooling water is flowing in the water jacket 13, the cooling water flowing in the upper cooling water passage 13*c* and the cooling water flowing in the lower cooling water passage 13*d* hardly ever mingle with each other, because the upper cooling water passage 13*c* and the lower cooling water passage 13*d* are partitioned vertically by the spacer main body part 14*a* whose thickness T1 is slightly thinner than the width W of the water jacket 13.

When the cooling water having flown in the water jacket 13 is discharged to the water jacket (not illustrated) in the cylinder head 15 through the communication holes 15*a* opened to the undersurface of the cylinder head 15, the cooling water having flown in the lower cooling water passage 13*d* passes the cooling water outlet port part 14*c* of the spacer 14 from its lower part to its upper part, and thus joins the cooling water having flown in the upper cooling water passage 13*c*. Thereafter, the confluent cooling water flows into the communication holes 15*a* in the cylinder head 15.

At this time, not only can loss of the pressure of the cooling water upward passing the cooling water outlet port part 14*c* be suppressed to a minimum, but also the cooling effect can be secured even in a vicinity of the cooling water outlet port part 14*c*, in which the cooling effect decreases due to reduction in the flow rate of the cooling water, by causing as much cooling water as possible to intervene between the cooling water outlet port part 14*c* and the inner wall surface 13*a* of the water jacket 13. That is because: the cooling water outlet port part 14*c* is offset toward the outer wall surface 13*b* of the water jacket 13 with the thickness T3 of the cooling water outlet port part 14*c* being less than the thickness T1 of the spacer main body part 14*a* and with the outer peripheral surface being flush with the outer peripheral surface of the spacer main body part 14*a*.

In addition, the cooling water having come out of the downstream end of the upper cooling water passage 13*c* joins the cooling water having changed its flow direction upward after coming out of the downstream end of the lower cooling water passage 13*d*. Accordingly, the direction of the cooling water having come from the upper cooling water passage 13*c* can be changed upward by the cooling water having coming from the lower cooling water passage 13*d*, and the cooling water having come from the upper cooling water passage 13*c* can be made to flow into the communication holes 15*a* smoothly.

When the cooling water having flown in the upper cooling water passage 13*c* and the lower cooling water passage 13*d* is discharged from the communication holes 15*a* after changing its direction upward at the cooling water outlet port part 14*c*, there is a possibility that: swirls of the cooling water may occur; and the smooth direction change may be hindered. However, the flow of the cooling water into the communication holes 15*a* can be achieved by preventing the occurrence of the swirls, because a portion of the cooling water in the cooling water inlet port part 14*b* flows into the cooling water outlet port part 14*c* after passing the space δ (refer to FIG. 10) in the lower end portion of the partition wall 14*d*.

The inner peripheral surface of the spacer main body part 14*a* of the spacer 14 is close to the inner wall surface 13*a* at the intermediate portion of the water jacket 13 in the cylinder axis lines L2 direction. Accordingly, only a less amount of the cooling water comes into contact with the inner wall surface 13*a*, and the cooling is suppressed. As a result, the intermediate portions of the cylinder bores 12*a* in the cylinder axis lines L2 direction, which are opposed to the spacer main body part 14*a*, become higher in temperature than the other portions thereof, and thermally expand to have larger clearances between the cylinder bores 12*a* and their corresponding pistons 18. As a consequence, frictions between the pistons 18 and the cylinder bores 12*a* are reduced, particularly when large side thrusts are applied to the respective pistons 18 during the compression process and the expansion process. Accordingly, it is possible to contribute to improving fuel efficiency of the internal combustion engine. Furthermore, because the intermediate portions of the cylinder bores 12*a* in the cylinder axis lines L2 direction become higher in temperature than any other portions thereof, the temperature of the oil lubricating such portions rises, and the viscosity of the oil decreases. For this reason, the effect of friction reduction is enhanced more.

On the other hand, the upper portions and lower portions of the cylinder bores 12*a* in the cylinder axis lines L2 direction are sufficiently cooled by the cooling water flowing in the upper cooling water passage 13*c* and the lower cooling water passage 13*d* above and under the spacer 14. Accordingly, it is possible to secure the cooling performances of the top parts 18*a* and the skirt parts 18*b* of the pistons 18 slidably fitted in the cylinder bores 12*a* and to prevent their overheat, although the temperatures of the top parts 18*a* and the skirt parts 18*b* would otherwise tend to rise. Moreover, not only does the upper portions of the cylinder bores 12*a* directly receive heat of a combustion chamber, but also the upper portions thereof tend to raise their temperatures due to their reception of heat transmitted through the top rings 19, the second rings 20 and the oil rings 21 from the heated pistons 18 which stay at the vicinities of their top dead centers for long time due to the change in their movement directions. However, because no spacer 14 is made to face the upper portions of the cylinder bores 12*a*, their cooling performances can be secured. In addition, the skirt parts 18*b* of the pistons 18 are places which are most tightly put in sliding contact with the cylinder bores 12*a*, thereby causing friction therebetween. However, because the cylinder bores 12*a* with which the skirt parts 18*b* are put in sliding contact are covered with the spacer 14 and the diameters of the cylinder bores 12*a* is increased by thermal expansion, the friction can be reduced.

As indicated by the continuous line in FIG. 5, the up-and-down position of the spacer 14 is set in such a way that the top rings 19, the second rings 20 and the oil rings 21 are situated above the upper edge of the spacer main body part 14*a*, when the side thrusts of the respective pistons 18 reach their maximum during the expansion process, in other words, when the friction between the pistons 18 and the cylinder bores 12*a* reaches its maximum. For this reason, the cooling performance of the pistons 18 can be secured by: reducing the friction by increasing the inner diameters of the cylinder bores 12*a* by use of the spacer 14; and concurrently making the heat of the top parts 18*a* of the heated pistons 18 whose temperature tend to be higher, escape to the upper cooling water passage 13*c* of the water jacket 13 from the highly heat-conductive top rings 19, second rings 20 and oil rings 21 through the cylinder bores 12*a*.

At this time, because the spacer main body part 14*a* of the spacer 14 is close to the inner wall surface 13*a* of the water jacket 13 with the minimum space α being interposed in between, it is possible to suppress the amount of cooling water intervening between the spacer main body part 14*a* and the inner wall surface 13*a* of the water jacket 13 to a minimum, and thus to thermally insulate the up-and-down-direction intermediate portions of the cylinder bores 12*a* effectively, as well as to enlarge the diameters of the cylinder bores 12*a*.

In addition, at the bottom dead centers indicated by the chain line in FIG. 5, the quantity of heat transmitted to the cylinder bores 12*a* from the pistons 18 through the top rings 19, the second rings 20 and the oil rings 21 is larger because the speeds at which the pistons 18 move decrease. However, when the pistons 18 reaches their bottom dead centers, the top rings 19, the second rings 20 and the oil rings 21 are situated below the lower edge of the spacer main body part 14*a*. For this reason, it is possible to make the heat of the pistons 18 escape to the cylinder bores 12*a* without being obstructed by the spacer 14, and to secure the cooling performances of the pistons 18.

Moreover, when the spacer 14 is assembled inside the water jacket 13, the space α between the inner peripheral surface of the spacer main body part 14*a* and the inner wall surface 13*a* of the water jacket 13 is set smaller than the space β between the outer peripheral surface of the spacer main body part 14*a* and the outer wall surface 13*b* of the water jacket 13. For this reason, the outer peripheral surface of the spacer main body part 14*a* is designed not to come in contact with the outer wall surface 13*b* of the water jacket 13, even though: the spacer 14 may deviate in the radial direction due to the assembling error and its deformation; and the inner peripheral surface of the spacer main body part 14*a* may come into contact with the inner wall surface 13*a* of the water jacket 13.

Because, as described above, the space is always secured between the outer peripheral surface of the spacer main body part 14*a* and the outer wall surface 13*b* of the water jacket 13, the following operation/working effects are exerted. To put it specifically, if unlike the present embodiment, the outer peripheral surface of the spacer main body part 14*a* would come in contact with the outer wall surface 13*b* of the water jacket 13, the hitting sounds of the pistons 18 would be propagated via pathways from the cylinder bores 12*a*, the bottom portion of the water jacket 13, the lower support legs 14*f*, 14*h* of the spacer 14, the spacer main body part 14*a* to the outer wall surface 13*b* of the water jacket 13, and accordingly would constitute the cause of noises, because the lower support legs 14*f*, 14*h* of the spacer 14 are in contact with the bottom portion of the water jacket 13. Meanwhile, in the present embodiment, although hitting sounds of the pistons 18 are propagated from the cylinder bores 12*a* to the spacer main body part 14*a*, the hitting sounds are blocked in the spacer main body part 14*a* because the spacer main body part 14*a* does not abut on the outer wall surface 13*b* of the water jacket 13, thereby reducing noises.

If the spacer 14 deforms due to its swelling resulting from its contact with the cooling water and its thermal expansion, there is a possibility that the inner peripheral surface of the spacer 14 may be tightly fitted to the inner wall surface 13*a* of the water jacket 13. However, because the projection parts 14*i* provided on the spacer main body part 14*a* are opposed to the inner wall surface 13*a* of the water jacket 13 to come in contact with the inner wall surface 13*a* thereof, it is possible to prevent the inner peripheral surface of the spacer main body part 14*a* and the inner wall surface 13*a* of the water jacket 13 from coming into intimate contact with each other throughout their surfaces. Note that if the projection parts 14*i* come in contact with the inner wall surface 13*a* of the water jacket 13, there is a possibility that the hitting sounds may be propagated through the projection parts 14*i*. Basically, however, hitting sounds largely occur in the intake-side and exhaust-side portions of the outer peripheral surface of the pistons 18 which are distant from the cylinder row line L1, and hitting sounds hardly ever occur in portions close to the cylinder row line L1 in which the projection parts 14*i* are provided. For this reason, the propagation of hitting sounds through the projection parts 14*i* substantially does not matter.

Figure 2:
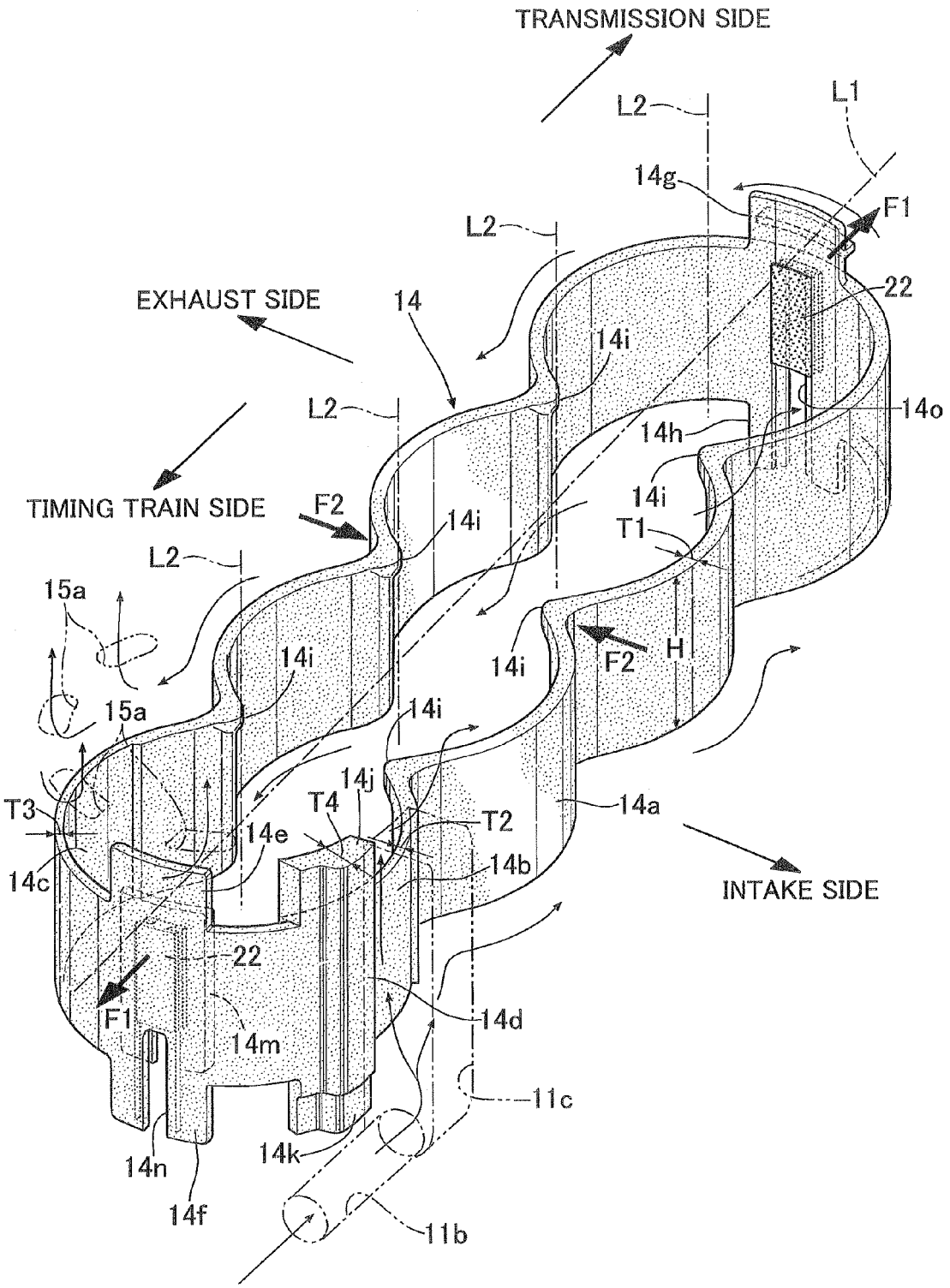

In addition, as shown in FIG. 2, the spacer 14 is stretched in the cylinder row line L1 direction by the reaction forces F1, F1, because the fixing members 22, 22 provided in the respective opposite end portions of the spacer 14 in the cylinder row line L1 direction elastically contact the inner wall surface 13*a* of the water jacket 13. As a result, the intake-side and exhaust-side side surfaces of the spacer main body part 14*a* deform by receiving loads F2, F2 working in a direction in which the intake-side and exhaust-side side surfaces thereof come closer to each other. For this reason, the inner peripheral surface of the spacer main body part 14*a* comes closer to the inner wall surface 13*a* of the water jacket 13, and the space $\alpha$ between the inner peripheral surface of the spacer main body part 14*a* and the inner wall surface 13*a* of the water jacket 13 decreases accordingly. Thereby, the amount of cooling water intervening between the spacer main body part 14*a* and the inner wall surface 13*a* of the water jacket 13 can be reduced more, and the up-and-down-direction intermediate portions of the cylinder bores 12*a* thus can be thermally insulated more effectively, as well as the diameters thereof can be enlarged.

At this time, the two fixing members 22, 22 both are arranged on the cylinder row line L1, and the intake-side portion and exhaust-side portion of the spacer 14 are basically symmetrical with respect to the cylinder row line L1. For this reason, the loads F2, F2 which cause the intake-side and exhaust-side side surfaces of the spacer main body part 14*a* to come closer to each other can be made uniform, and the amount of deformation of the intake-side portion of the spacer 14 and the amount of deformation of the exhaust-side portion of the spacer 14 can be made uniform.

Furthermore, because the fixing members 22, 22 are attached to the spacer main body part 14*a* in a way not to cut into the upper cooling water passage 13*c* or the lower cooling water passage 13*d*, the fixing members 22, 22 do not obstruct the flow of the cooling water. In addition, because the fixing member 22, 22 are attached to the spacer main body part 14*a* in a way not to interfere with the upper support legs 14*e*, 14*g* or the lower support legs 14*f*, 14*h* of the spacer 14, the spacer main body part 14*a* can be efficiently deformed with the resilient forces of the fixing members 22, 22.

Next, descriptions will be provided for a second embodiment of the present invention on the basis of FIGS. 13 to 28. Note that: the reference numerals used for the second embodiment are independent of those used for the first embodiment; and the same reference numerals do not necessarily denote the same members.

Figure 13:
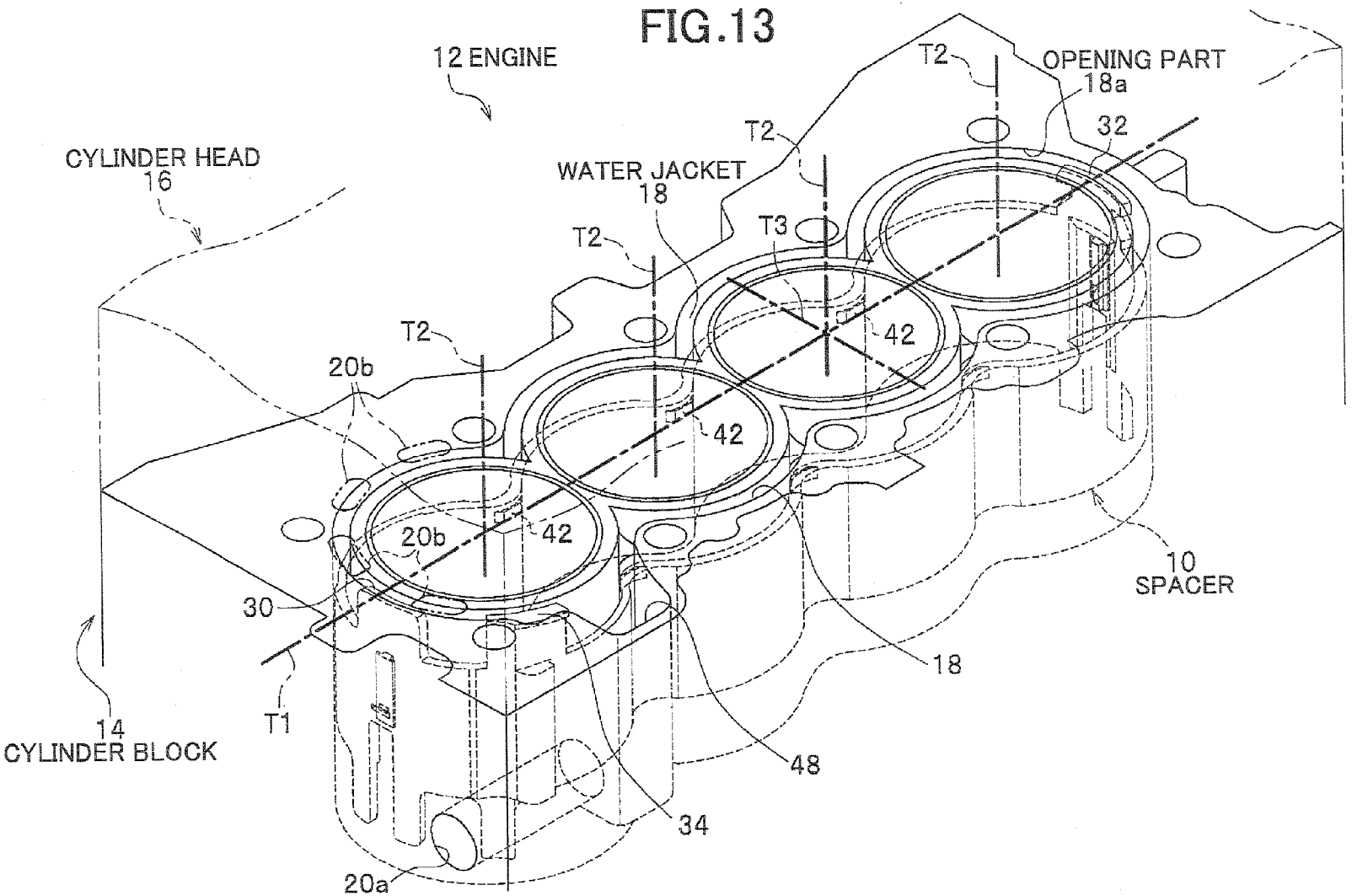
Figure 14:
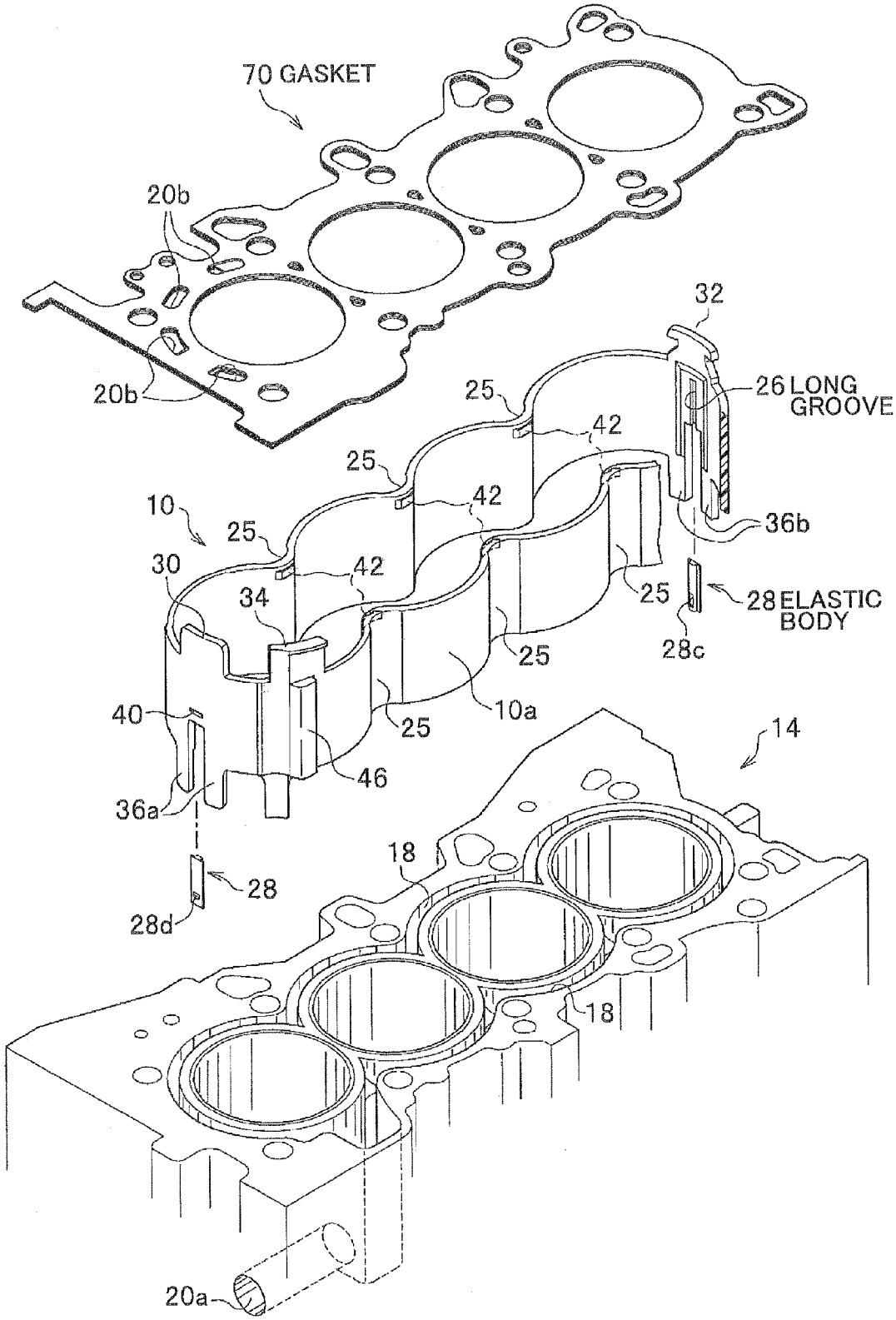
Figure 15A:
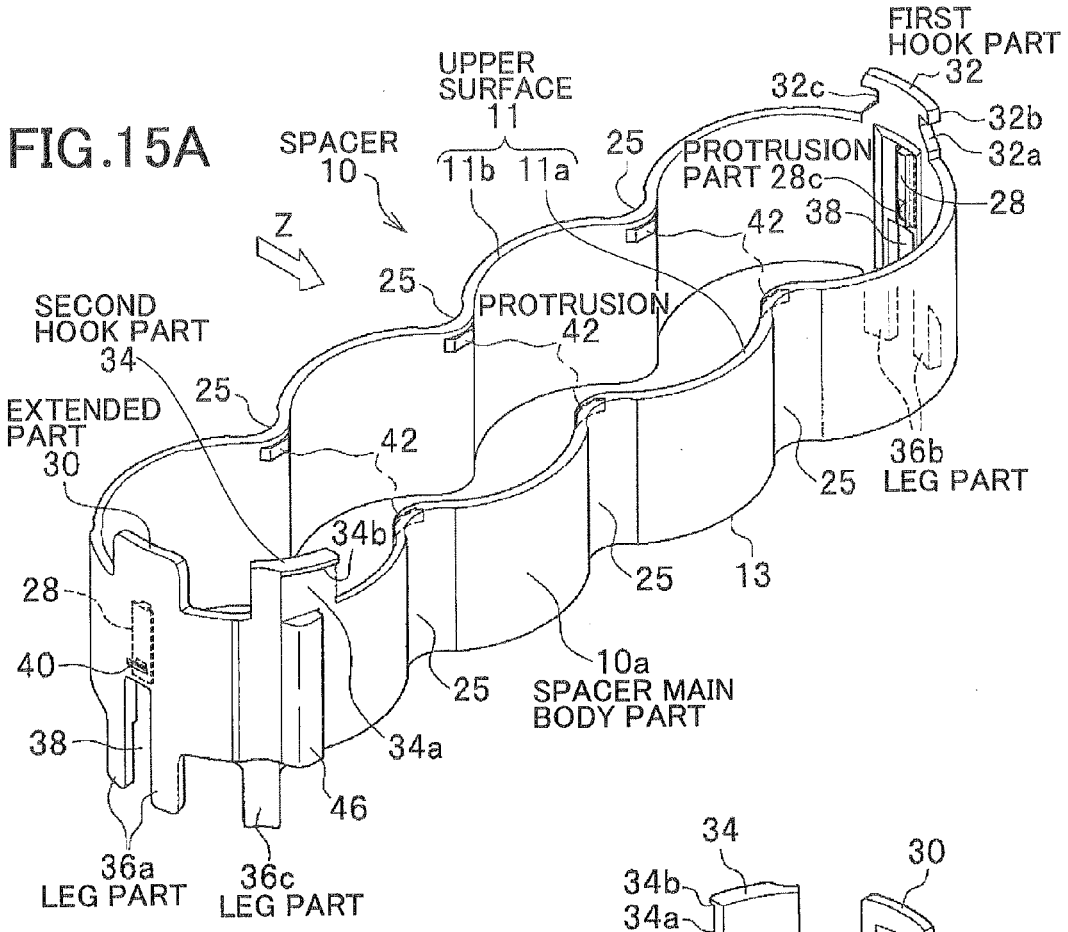
FIG. 15A is a perspective view of the spacer shown in FIG. 13.
Figure 15B:
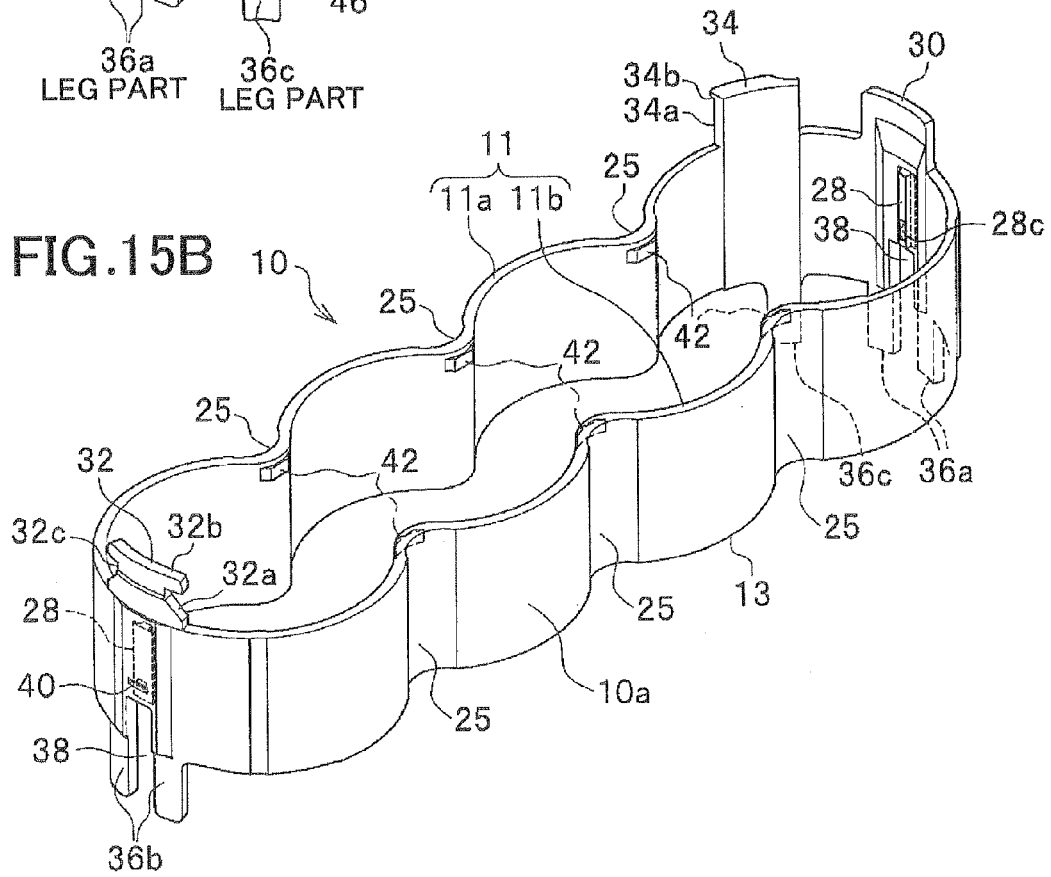
FIG. 15B is a perspective view of the spacer viewed from a side indicated by an arrow Z in FIG. 15A.
Figure 16:
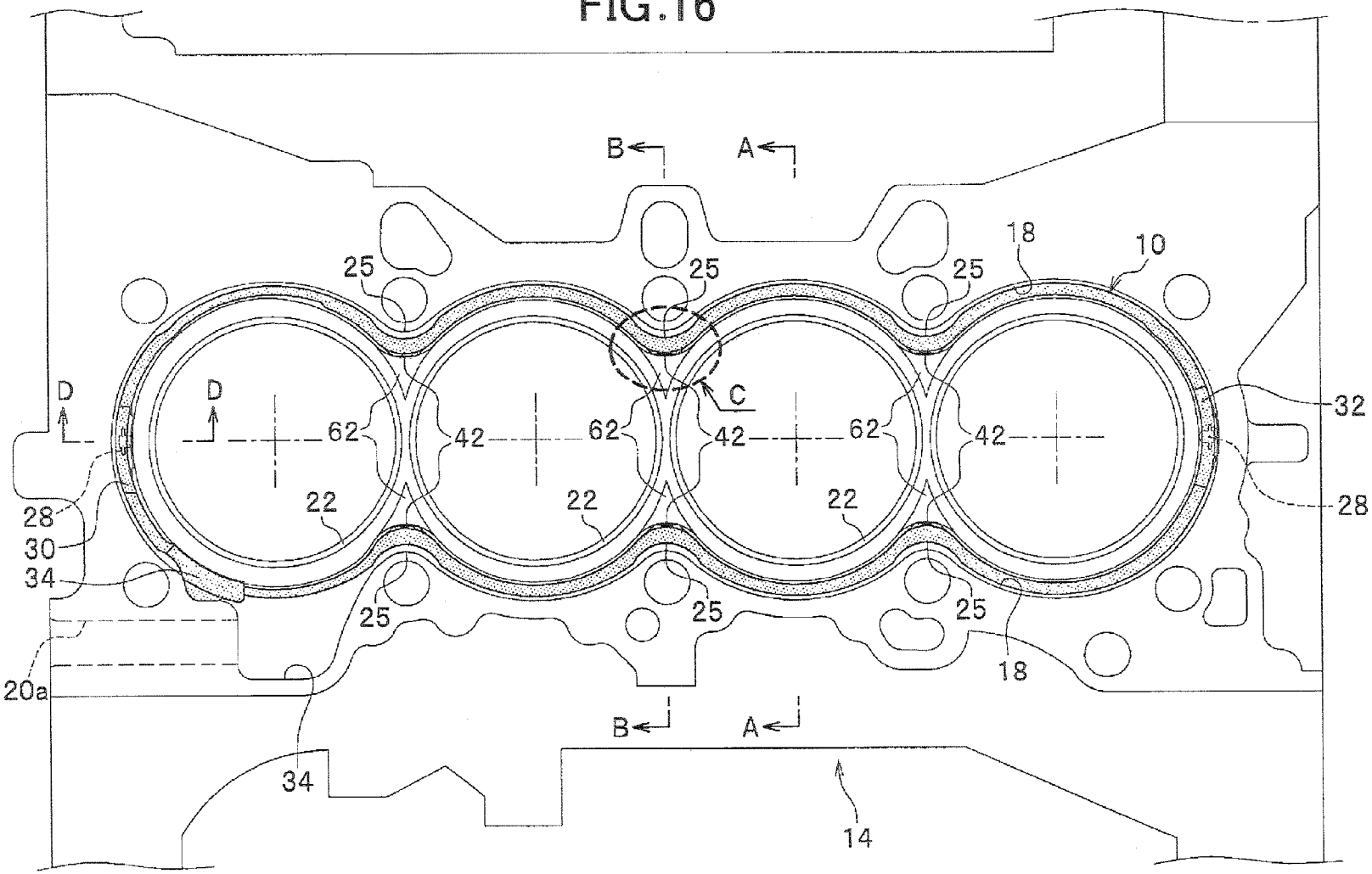

FIG. 13 is a schematic perspective view of an internal combustion engine in which a spacer according to this embodiment is fitted. FIG. 14 is an exploded perspective view of a cylinder block and a spacer which constitute a part of the internal combustion engine. FIG. 15A is a perspective view of the spacer shown in FIG. 13, and FIG. 15B is a perspective view of the spacer viewed from a side indicated by an arrow Z in FIG. 15A. FIG. 16 is a plan view of the cylinder block shown in FIG. 13.

As shown in FIG. 13, the internal combustion engine 12 in which the spacer 10 according to this embodiment is fitted is an in-line 4-cylinder internal combustion engine in which four cylinders (cylinder bores) are disposed in a straight line in a cylinder row line direction (see a dot and dash line T1 in FIG. 13), and is installed inside a vehicle engine room (not illustrated). This internal combustion engine 12 is formed from: a cylinder block 14 made, for example, of an aluminum alloy; a cylinder head 16 made, for example, of an aluminum alloy and attached to the top of the cylinder block 14; and a head cover (not illustrated) which is attached to the top of the cylinder head 16.

Note that, although this embodiment will be hereinbelow described by taking the in-line 4-cylinder internal combustion engine as an example, the embodiment is not limited to the in-line 4-cylinder internal combustion engine. This embodiment can be applied to V-type multi-cylinder internal combustion engines each with multiple cylinders being disposed in each of the banks arranged in a V-shaped form, flat internal combustion engines, and the like, for example. In addition, the application is not hindered by whether the internal combustion engines have a single cylinder or multiple cylinders, or how many cylinders the internal combustion engines have. In a single-cylinder internal combustion engine, the dot and dash line T1 in FIG. 13 indicates a direction in parallel with the crankshaft.

The following descriptions will be provided with an "up-and-down direction" defined as a "cylinder axis line direction" (see a dot and dash line T2 in FIG. 13), and with "upper" defined as "near the cylinder head 16." In addition, an "inward direction" is defined as a "direction leading to the dot and dash line T2 which indicates the cylinder axis line direction," and an "outward direction" is defined as a "direction leaving from the dot and dash line T2." Furthermore, a "peripheral direction" is defined as a "direction circling around the dot and dash line T2 or the cylinder bore(s)." Moreover, a "bore orthogonal direction" (see a dot and dash line T3 in FIG. 13) is defined as a "direction orthogonal to both the cylinder row line direction (T1) and the cylinder axis line direction (T2).

A water jacket 18 in which cooling water flows is provided inside each of the cylinder block 14 and the cylinder head 16 (although the illustration of the water jacket inside the cylinder head 16 is omitted). In addition, a cooling water inlet port 20*a* and multiple cooling water outlet ports 20*b* are provided in one end side of the cylinder block 14 in the cylinder row line direction. Through the cooling water inlet port 20*a*, the cooling water having been poured forth from a radiator (not illustrated) by a water pump (not illustrated) is supplied into the water jacket 18. Through the multiple cooling water outlet ports 20*b*, the cooling water having been introduced through the cooling water inlet port 20*a* is guided out to the water jacket (not illustrated) in the cylinder head 16 after the cooling water makes a circuit around the multiple cylinders along the water jacket 18. Note that the multiple cooling water outlet ports 20*b* are formed from hole portions made in a gasket 70 (see FIG. 14), which will be described later.

As shown in FIG. 16 (see FIG. 14 together), the water jacket 18 in the cylinder block 14 is formed so that, when viewed in a plan view, the water jacket 18 continues to substantially surround the outer peripheries of the respective four cylinder bores arranged in the cylinder row line direction, and makes a circuit around the cylinder bores. The water jacket 18 is formed so that, with respect to the up-and-down direction of the cylinder block 14, the upper end portion of the water jacket 18 is opened while the lower end portion (bottom wall) of the water jacket 18 is closed inside the cylinder block 14.

Figure 17:
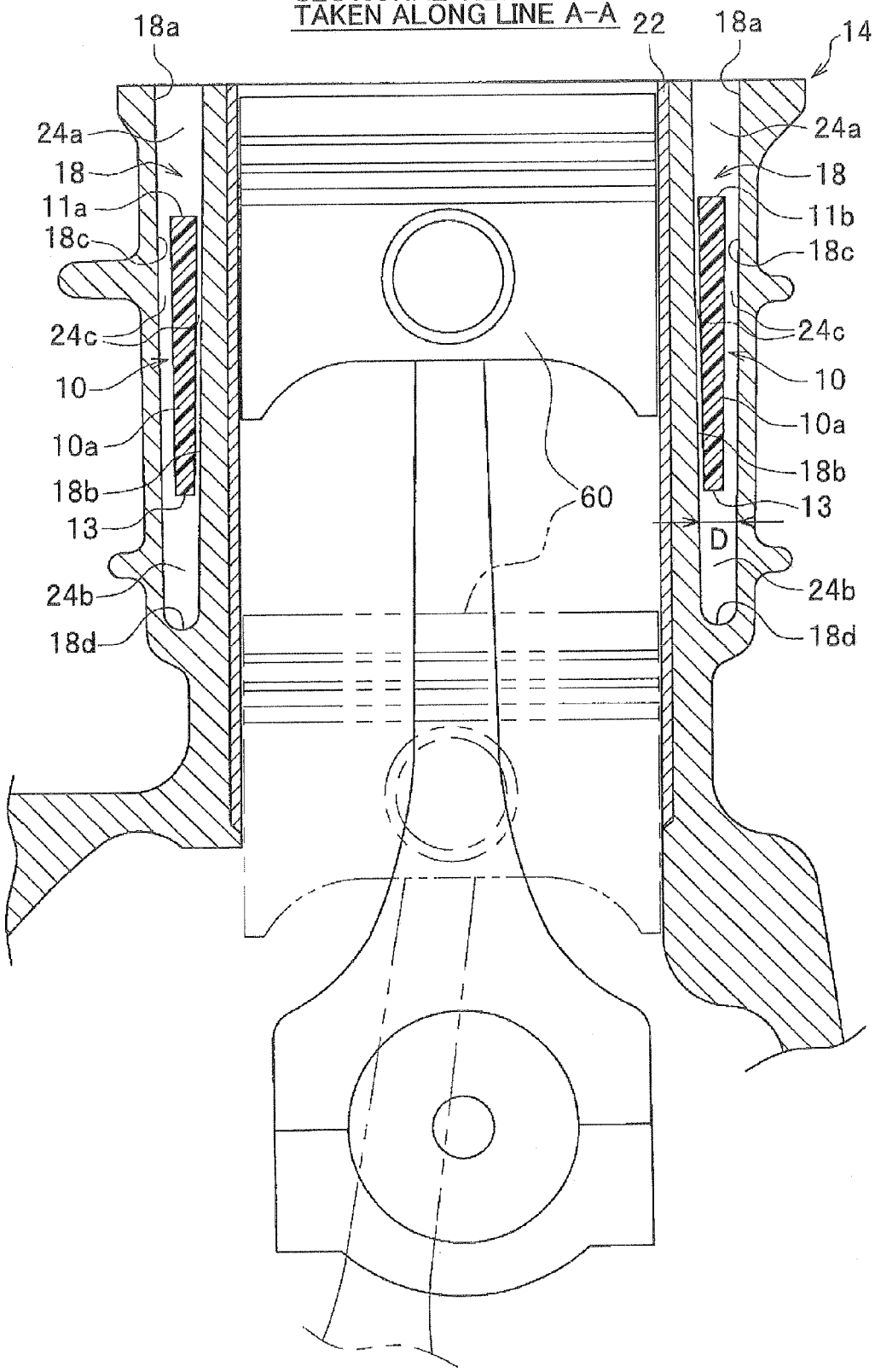

FIG. 17 is a longitudinal sectional view of the cylinder block taken along the line A-A in FIG. 16. In this case, as shown in FIG. 17, the water jacket 18 includes an opening part 18*a* in its upper end surface of the cylinder block 14, and is formed from a space part surrounded by: an inner wall surface (inner wall situated closer to the cylinder bores) 18*b* and an outer wall surface (outer wall situated closer to the outer surface of the cylinder block) 18*c* which are formed opposed to each other and spaced out a predetermined distance apart inside the cylinder block 14; and a bottom wall 18*d* through which the inner wall surface 18*b* and the outer wall surface 18*c* are connected together in their lower portions.

In addition, when viewed in a longitudinal sectional view taken in the up-and-down direction of the cylinder block 14, the water jacket 18 is formed in such a tapered shape that a space-out distance D between the inner wall surface 18*b* and the outer wall surface 18*c* of the cylinder block 14 (see FIG. 17) becomes gradually smaller from the upper end surface toward the lower end surface (bottom surface) of the cylinder block 14. In other words, the water jacket 18 is formed to taper gradually in its depth direction from the opening part 18*a* to the bottom wall 18*d* of the cylinder block 14.

A cylinder liner 22 made of a thin cylinder body is attached to each cylinder bore, and forms a bore wall. Furthermore, a gasket 70 (see FIG. 14) is installed between the cylinder block 14 and the cylinder head 16. The upper end surface of the cylinder block 14 is sealed with the gasket 70.

A resin-made spacer 10 is inserted in the water jacket 18 of the cylinder block 14. A passage in which the cooling water is made to flow is formed among the spacer 10, the wall surfaces of the water jacket 18, and the gasket 70. This passage is formed in the water jacket 18, and includes: an upper portion-side passage 24*a* and a lower portion-side passage 24*b* both functioning as main passages in which much or most of the cooling water is made to flow; and intermediate passages 24*c* formed between the upper portion-side passage 24*a* and the lower portion-side passage 24*b*, and functioning as auxiliary passages (see FIGS. 17, 22, 24 and 25 on which descriptions will be provided later). Note that, although the resin-made spacer 10 produced by injection molding using a molding die is shown as an instance of the spacer according to this embodiment, a metal-made spacer produced by forging-molding, blowing-molding or the like may be used instead.

As shown in FIGS. 15A, 15B and 16, the spacer 10 is formed from a cylinder-shaped body obtained by connecting four belt-shaped rings continuingly and integrally when viewed in a plan view. The spacer 10 includes: a spacer main body part 10*a* having constriction-shaped parts 25; and paired elastic bodies 28. The spacer main body part 10*a* is constricted between each two corresponding constriction-shaped parts 25 in such a way that the two constriction-shaped parts 25 are inwardly closer to each other. The paired elastic bodies 28 are respectively attached to long grooves 26 (see FIG. 14) in the opposite end portions of the spacer main body part 10*a* in the cylinder row line direction. Note that the thickness dimension of the spacer main body part 10*a* is set slightly smaller than, but almost equal to, the width dimension of the water jacket 18 (the space-out distance D between the inner wall surface 18*b* and the outer wall surface 18*c* in the horizontal direction), for example. Nevertheless, it suffices if the spacer main body part 10*a* has a thickness dimension which enables the spacer main body part 10*a* to be disposed close to the cylinder bore-side inner wall surface 18*b*.

An extended part 30 extending upward is provided in one end portion of an upper surface 11 of the spacer main body part 10*a* in the cylinder row line direction. A first hook part 32 opposed to the extended part 30 is provided in the other end portion thereof in the cylinder row line direction to extend upward. A second hook part 34 extending upward is provided in another portion of the upper surface 11 of the spacer main body part 10*a*, which is near the extended part 30. Note that the height dimensions of the respective first and second hook parts 32, 34 are set equal to each other (see FIG. 18).

The lower surface portion of the spacer main body part 10*a* includes paired leg parts 36*a*, paired leg parts 36*b*, and a leg part 36*c*. The paired leg parts 36*a* extend downward below the extended part 30, and the paired leg parts 36*b* extend downward below the first hook part 32. The paired leg parts 36*a* are opposed to the paired leg parts 36*b* in the cylinder row line direction. The leg part 36*c* is provided below the second hook part 34 in the up-and-down direction, and extends downward. The paired leg parts 36*a* are provided extending in parallel to each other in the peripheral direction, and the paired legs parts 36*b* are provided extending in parallel to each other in the peripheral direction. A slit 38 extending in the up-and-down direction in the form of a rectangle is formed between each paired leg parts extending in parallel to each other. A window part 40, which is formed of a horizontally-long-rectangle-shape, is formed above each slit 38 to penetrate the spacer main body part. A lock part 28*d* of the corresponding elastic body 28 is locked to the window part 40, which will be described later.

Figure 18:
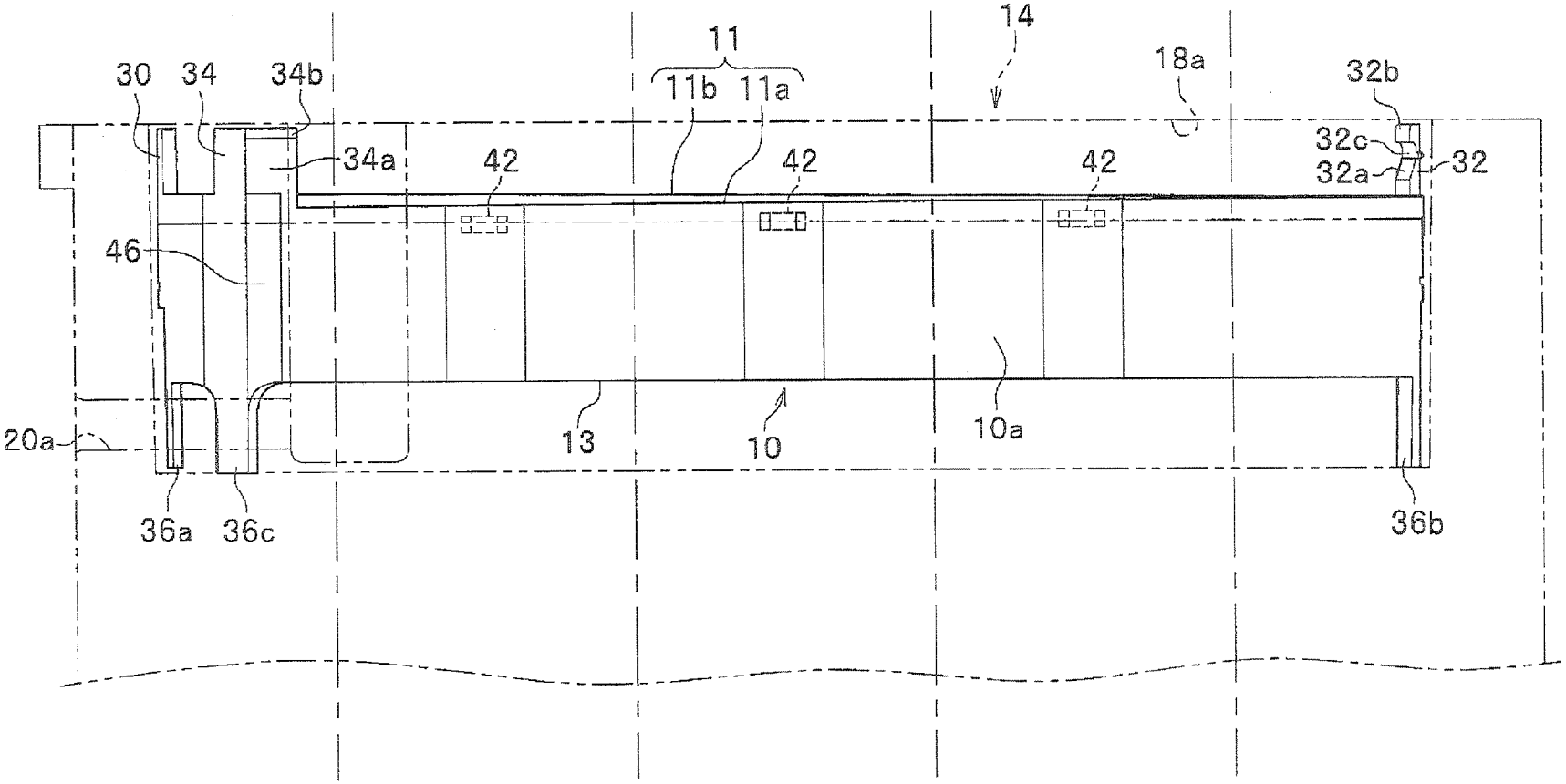

Multiple protrusions 42 are provided in portions of the inner periphery of the spacer main body part 10*a*, which correspond to the constriction-shaped parts 25, and which are near the upper surface 11, in such a way that the protrusions 42 are opposed to the inter-cylinder areas which are connecting areas between the adjacent cylinder bores. The protrusions 42 protrude toward the inner wall surface 18*b* of the water jacket 18, and are each formed of substantially-rectangle-shape, as shown in FIG. 18, when viewed from the side in a see-through manner.

Figure 19A:
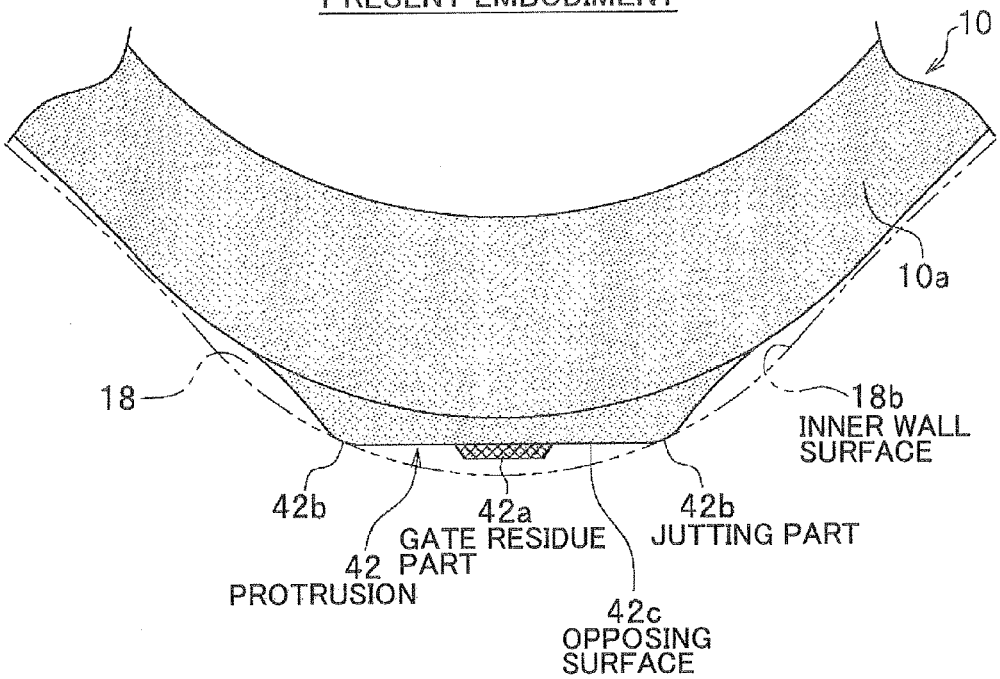
FIG. 19A is an enlarged plan view of a protrusion provided on an inner periphery of the spacer according to the embodiment.
Figure 23A:
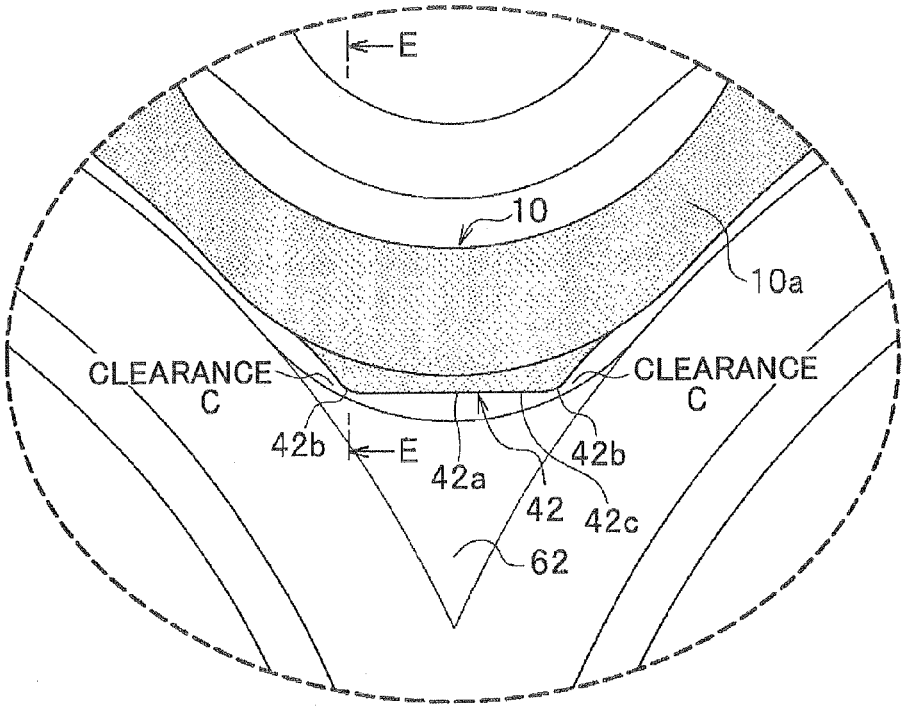
FIG. 23A is an enlarged view of a portion indicated by an arrow C in FIG. 16.
Figure 23B:
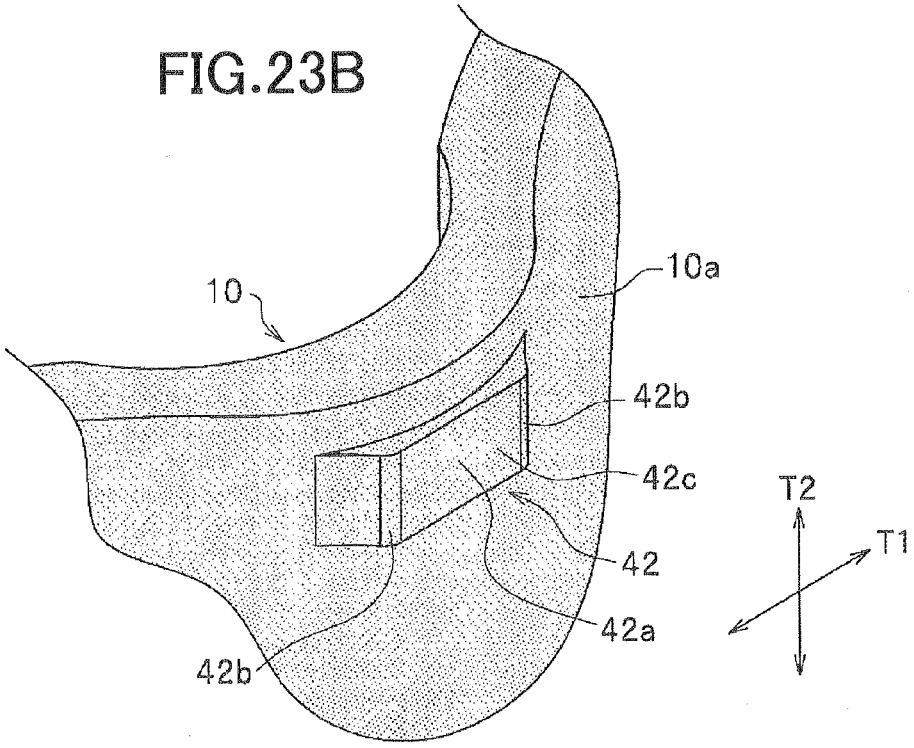
FIG. 23B is an enlarged perspective view of the protrusion provided on the inner periphery of the spacer main body part.
Figure 24:
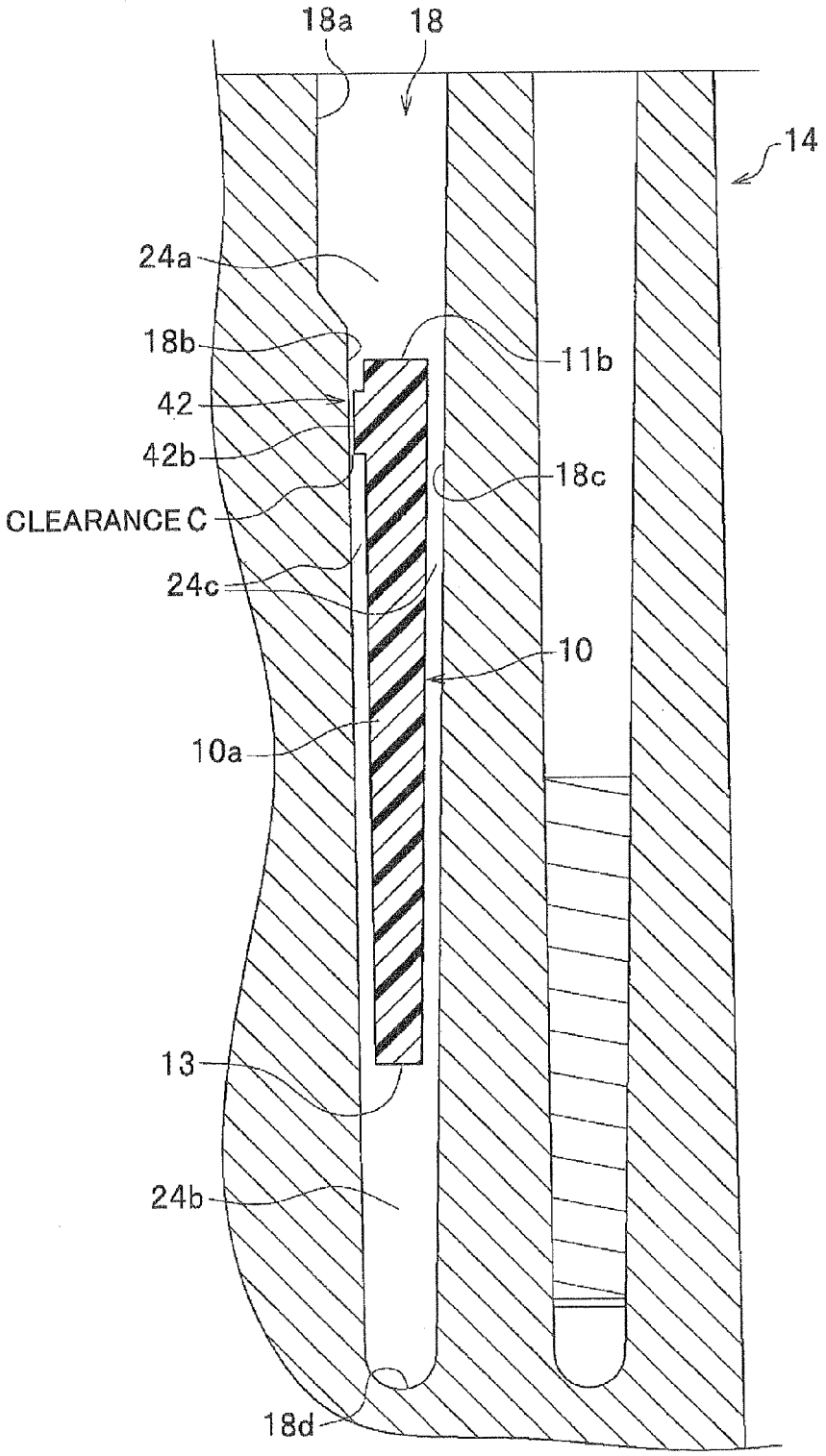
Figure 25:
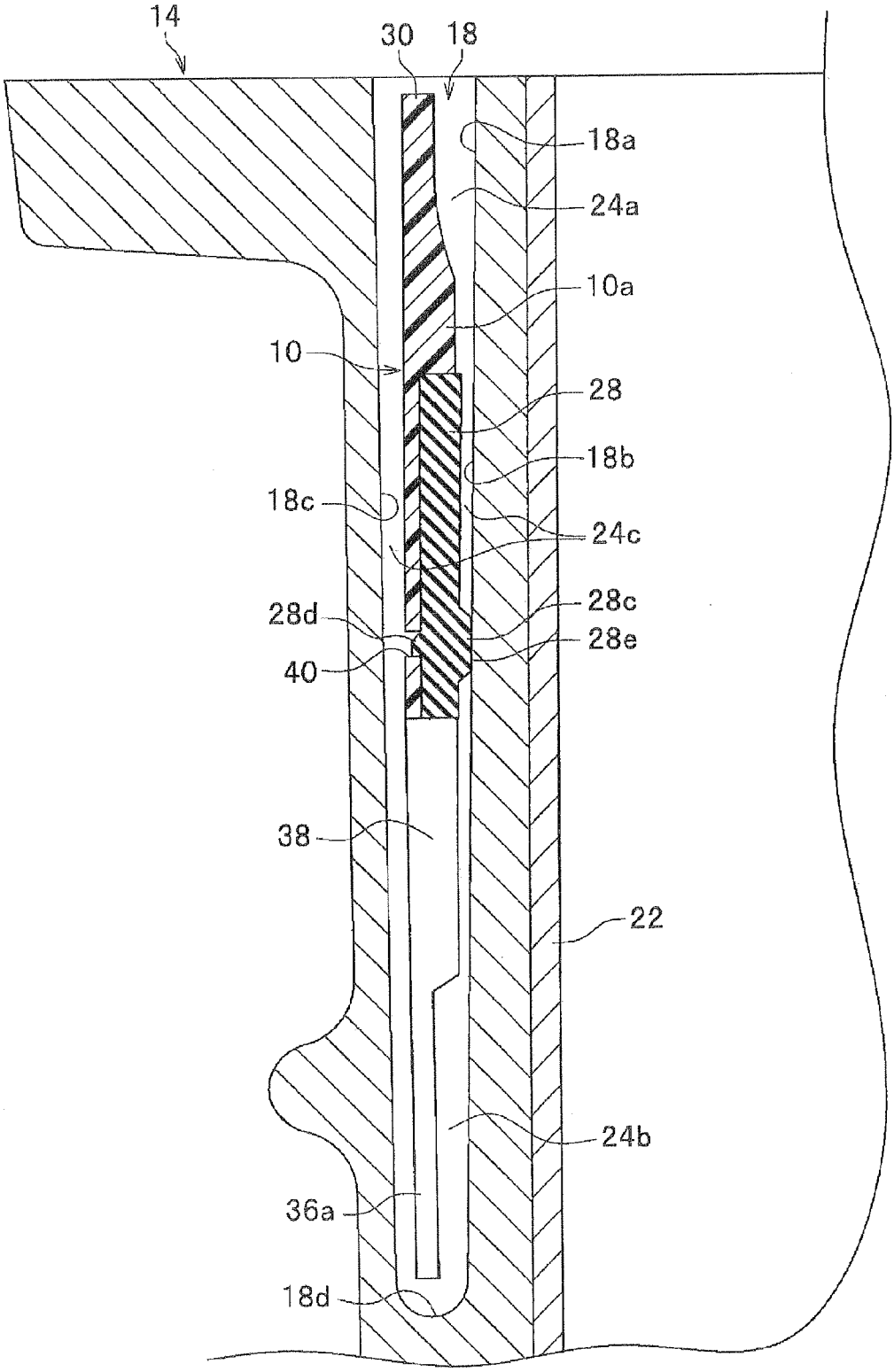

The protrusions 42 are formed in the same shape. As shown in FIGS. 19A, 23A and 23B, each protrusion 42 includes a gate residue part (material introduction part) 42*a*, jutting parts 42*b*, 42*b* and an opposing surface 42*c*. As a below-described gate remnant, the gate residue part 42*a* is formed in a substantially central portion of the protrusion 42. The jutting parts 42*b*, 42*b* are provided in the respective opposite corner portions of the protrusion 42 in the cylinder row line direction across the gate residue part 42*a*, and are put in contact with the inner wall surface 18*b* of the water jacket 18. The opposing surface 42*c* is formed between the two jutting parts 42*b*, 42*b* arranged in the cylinder row line direction.

Note that the multiple protrusions 42 function as "protruding parts which protrude from the spacer main body part toward the wall surface of the water jacket," and also function as "abutment means on the one side which are provided so as to oppose to the connecting areas between the adjacent cylinder bores".

As shown in FIG. 23B, the jutting parts 42*b*, 42*b* are provided in the respective opposite corner portions of each protrusion 42 in the cylinder row line direction (T1), and to extend in the up-and-down direction along the cylinder axis line direction (T2). These jutting parts 42*b*, 42*b* are provided so that: when viewed in a plan view as shown in FIG. 19A, the jutting parts 42*b*, 42*b* are each in point contact with the inner wall surface 18*b* of the water jacket 18; and the jutting parts 42*b*, 42*b* are each in line contact with the inner wall surface 18*b* of the water jacket 18 in the E-E cross section shown in FIG. 24, when the jutting parts 42*b*, 42*b* come closer to, and into contact with, the inner wall surface 18*b* of the water jacket 18.

Figure 19B:
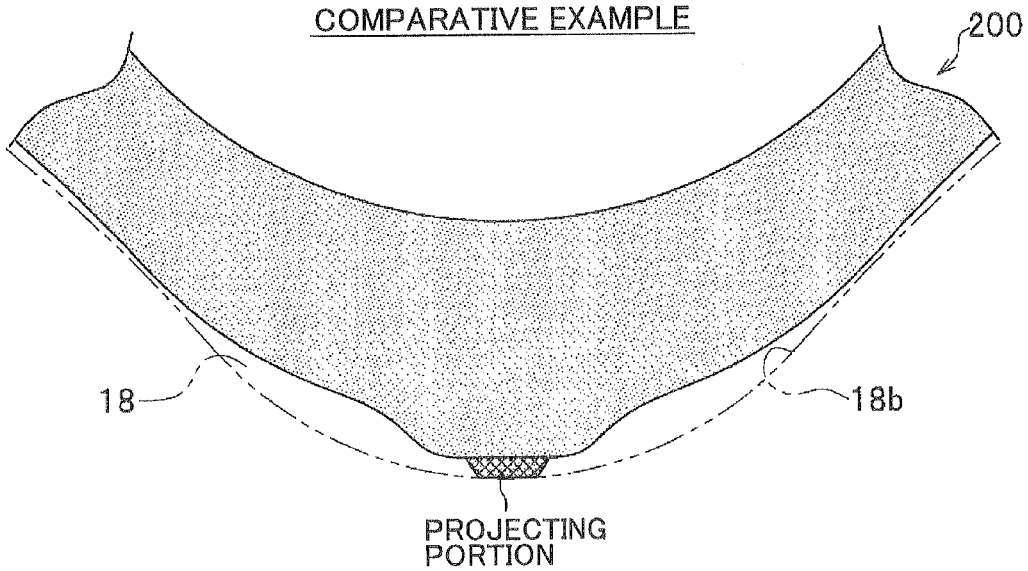
FIG. 19B is an enlarged plan view of a projecting portion provided in an inner periphery of a spacer according to a comparative example.

The contact of the jutting parts 42*b*, 42*b* with the inner wall surface 18*b* of the water jacket 18 in this manner makes it possible to suppress the looseness of the spacer 10 in the bore orthogonal direction (T3), and concurrently to suppress the looseness of the spacer 10 in the cylinder row line direction (T1). FIG. 19B shows a spacer 200 according to a comparative example, in which a projecting portion remaining on a gate residue part 42*a* is made to abut on an inner wall surface 18*b* of a water jacket 18.

As described later, the gate residue parts 42*a* will be removed by polishing, grinding or the like after the spacer 10 is molded. When the spacers 10 are mass-produced, it is troublesome and difficult to give dimensional precision to the protrusion of the gate residue parts 42*a* toward the inner wall surface 18*b* (to make the dimension of the protrusions equal). For this reason, the present embodiment enables the spacer 10 to be held with higher precision by making the jutting parts 42*b*, 42*b*, which are provided in the respective opposite corners flanked with each gate residue part 42*a*, abut on the inner wall surface 18*b* of the water jacket 18 without making the gate residue part 42*a* abut on the inner wall surface 18*b* of the water jacket 18 than the comparative example which makes the projecting portion of each gate residue part 42*a* abut on the inner wall surface 18*b* of the water jacket 18. Note that, as described later, the jutting parts 42*b*, 42*b* do not necessarily have to be in contact with the inner wall surface 18*b*. It suffices that the jutting parts 42*b*, 42*b* provide only displacement closer to the inner wall surface 18*b* in such a way that the space-out distance (clearance C) between the jutting parts 42*b*, 42*b* and the inner wall surface 18*b* becomes narrower.

Moreover, the jutting parts 42*b*, 42*b* are set to abut on the inner wall surface 18*b* of the water jacket 18 ahead of the gate residue part 42*a*. For this reason, even if the gate residue part 42*a* protrudes slightly, its influence can be reduced or ignored.

In addition, multiple (two) jutting parts 42*b*, 42*b* are provided in the respective opposite corner portions of each protrusion 42 in the cylinder row line direction with the gate residue part 42*a* interposed in between, and multiple protrusions 42 (six protrusions illustrated in this embodiment) are disposed so that the protrusions 42 are opposed to the two sides of the respective connecting areas between the adjacent cylinder bores.

In this case, the multiple protrusions 42 (jutting parts 42*b*, 42*b*) are not always in contact with the inner wall surface 18*b*. The protrusions 42 narrow the clearance (space, space-out distance) C between the spacer 10 and the inner wall surface 18*b* of the water jacket 18, and restrict the range of rotational movement of the spacer 10, thereby preventing the transmission of the hitting sounds of the pistons. To put it specifically, if the spacer 10 would be able to move freely inside the water jacket 18, the spacer 10 would come into contact with both the inner wall surface 18*b* and the outer wall surface 18*c* of the water jacket 18 due to the flow of the cooling water, and the hitting sounds of the pistons (including the vibrations of the internal combustion engine) would be accordingly transmitted. With this taken into consideration, the present embodiment narrows the clearance C between the inner wall surface 18*b* of the water jacket 18 and the spacer 10 by use of the protrusions 42 provided on the inner side of the spacer main body part 10*a*, and reduces the clearance C as much as possible, thereby restricting the range of the movement of the spacer 10. The present embodiment avoids the contact of the spacer 10 with the outer wall surface 18*c*, and thus prevents the transmission of the hitting sounds of the pistons.

Furthermore, as described later, the jutting parts 42*b*, 42*b* are formed from a flat surface which joins the paired jutting parts 42*b*, 42*b* in a straight line with a gate, which functions as an inlet port through which to inject a molten resin, interposed in between (see FIGS. 19A and 23B). As a result, the present embodiment can makes the flow of the molten resin from the gate to the two jutting parts 42*b*, 42*b* better than a case where the surface between the paired jutting parts 42*b*, 42*b* is formed, for example, in a complicated shape including dents. For this reason, the present embodiment makes it possible to form the jutting parts 42*b*, 42*b* with higher dimensional precision, and to enhance the precision with which the spacer 10 is restricted inside the water jacket 18.

Figure 20:
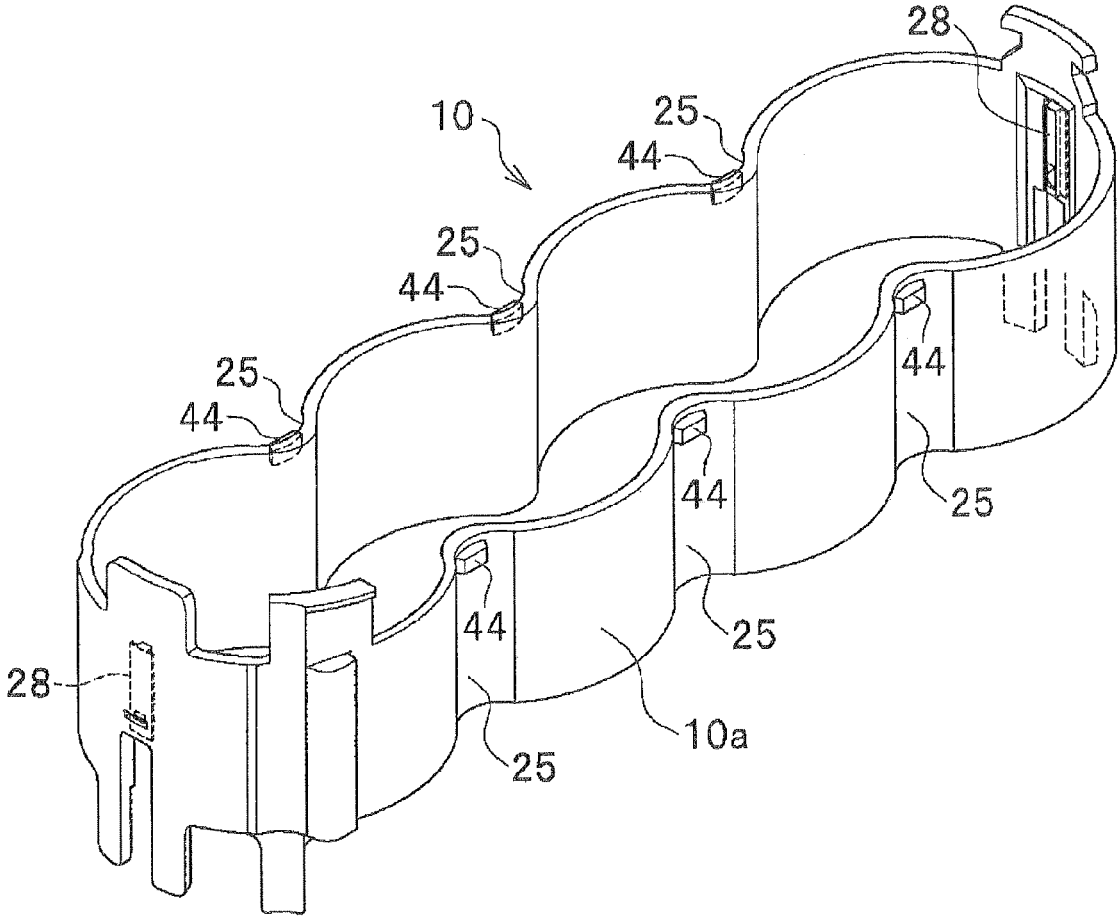

Moreover, the opposing surface 42*c* formed between the two jutting parts 42, 42*b* is formed from a flat surface substantially parallel to the cylinder row line direction, and the gate residue part 42*a* which functions as the material introduction part when the spacer is produced is provided protruding from the opposing surface 42*c*. Note that as illustrated in the spacer 10 according to a modification which is shown in FIG. 20, a configuration may be used in which: multiple protrusions are formed, for example, by adhering or bonding elastic members 44 of rubber or the like to the constriction-shaped parts 25 in the outer peripheral surface of the spacer main body part 10*a*; and the elastic members 44 are made to abut on the outer wall surface 18*c* of the water jacket 18. In this case, it is desirable that the elastic members 44 should be formed from members which blocks the transmission of the hitting sounds of the pistons. In addition, although FIG. 20 depicts the paired elastic bodies 28, 28, which are provided in the respective opposite end portions in the cylinder row line direction, as abutting on the inner wall surface of the 18*b*, the paired elastic bodies 28, 28 may be provided to abut on the outer wall surface 18*c* by reversing the protruding directions of the respective paired elastic bodies 28, 28.

Figure 21A:
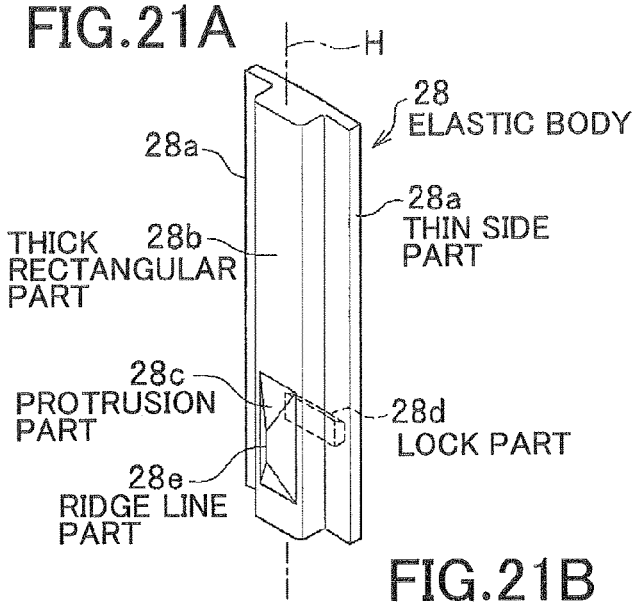
FIG. 21A is a perspective view of an elastic body.
Figure 21C:
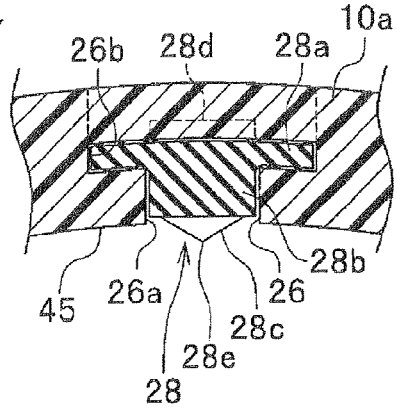
FIG. 21C is an enlarged transverse sectional view taken along a line G-G in FIG. 21B.
Figure 21B:
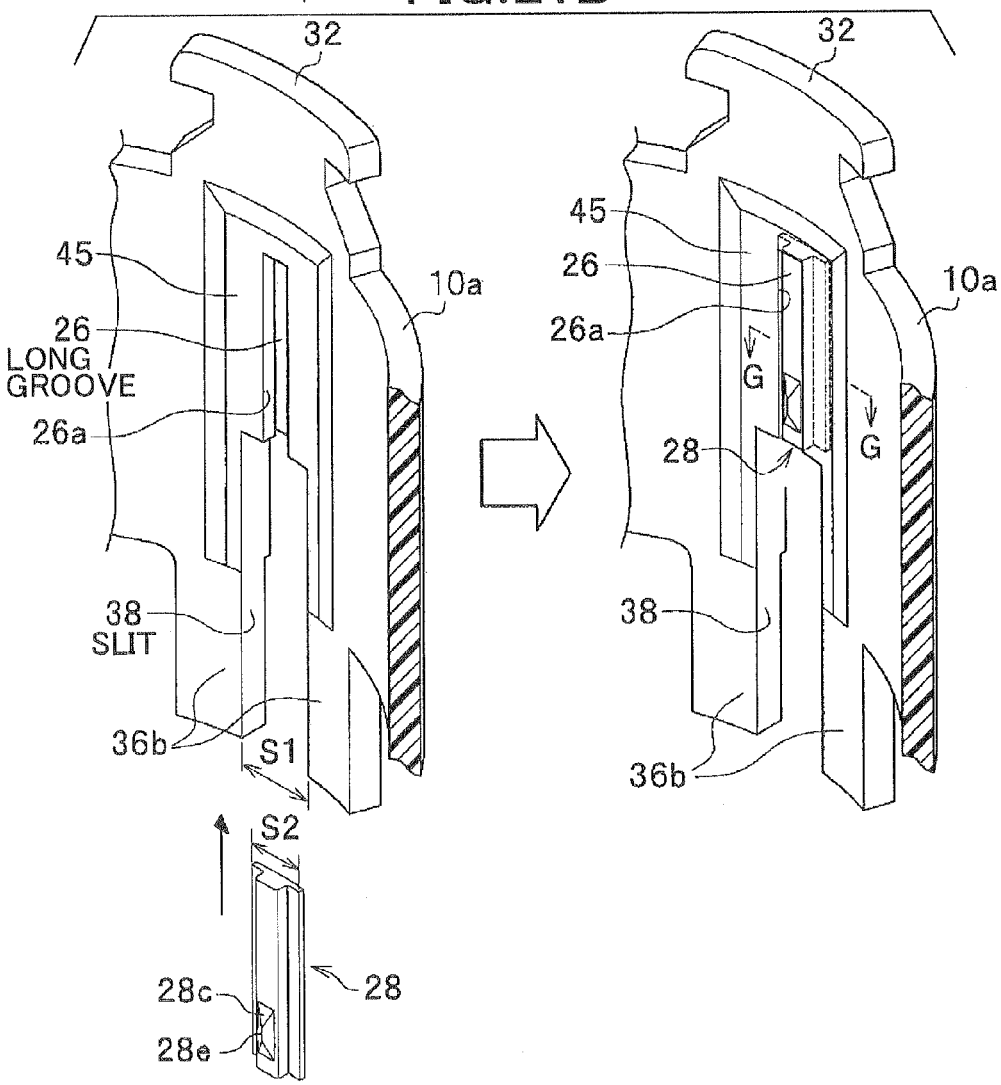
FIG. 21B is a partially-broken enlarged perspective view showing how the elastic body is attached to a long groove of a spacer main body part.

Expanded parts 45 expanding out toward the inner wall surface 18*b* of the water jacket 18 are formed in the respective opposite end portions of the spacer main body part 10*a* in the cylinder row line direction. Because the two expanded parts 45 in the respective opposite end portions of the spacer main body part 10*a* in the cylinder row line direction are formed in the same shape, the shape of one expanded part 45 alone is illustrated in FIGS. 21B and 21C, and the descriptions for the shape of the other expanded part 45 will be omitted. As shown in FIG. 21B, the long groove 26 is formed in the extended part 45. A transverse cross section of the long groove 26 in the horizontal direction is formed of a substantially T-shape, and the long groove 26 extends in the up-and-down direction. In the transverse cross section shown in FIG. 21C, this long groove 26 includes: a longitudinally-long opening parts 26*a* opened toward the inner wall surface 18*b* of the water jacket 18; and paired side grooves parts 26*b* continuing with the longitudinally-long opening part 26*a* interposed in between.

The long groove 26 is provided so that: its lower end portion communicates with the slit 38 provided between the paired leg parts 36*b*, 36*b*, which are formed of two-forks; and its upper end portion closes in an area substantially coinciding with the upper surface 11 of the spacer main body part 10*a*. In this case, as shown in FIG. 21B, a widthwise dimension (S1) of the slit 38 is formed slightly larger than a widthwise dimension (S2) of the elastic body 28 which will be described later (S1>S2). For this reason, when the elastic body 28 is engaged with the slit 38 from the lower side toward the upper side of the slit 38, the elastic body 28 can be smoothly inserted into the long groove 26 communicating with the slit 38. As a result, the assemblability can be enhanced.

Each elastic body 28 is formed from a rectangular body made of a rubber-made material, for example. As shown in FIG. 21A, the elastic body 28 includes: thin-shaped thin side parts 28*a*, 28*a* provided on the respective opposite sides of a center axis line H, and extending along the center axis line H; a thick-shaped thick rectangular part 28*b* provided between the thin side parts 28*a*, 28*a*, and extending along the center axis line H; a protrusion part (abutment means) 28*c* provided in a lower portion of the thick rectangular part 28*b* in a protruding manner; and the lock part 28*d* provided on the opposite side (at the back) of the elastic body 28 from the side on which the protrusion part 28*c* is provided, and extending in a direction orthogonal to the center axis line H. As shown in FIG. 21C, the transverse cross section of the elastic body 28 is formed of a substantially T-shape, which coincides with the long groove 26 (which corresponds to the shape of the long groove 26).

Note that the protrusion parts 28*c* of the elastic bodies 28 function as "protruding parts protruding from the spacer main body part toward the wall surface of the water jacket," and also function as "abutment mean on the other side provided so as to oppose to the respective opposite ends in the cylinder row line direction".

The protrusion part 28*c* of each elastic body 28 has a top portion which protrudes outward from the thick rectangular part 28*b*, and is provided with a straight-shaped ridge line part 28*e* which is in contact with the inner wall surface 18*b* of the water jacket 18. Descriptions will be later provided for how (a condition in which) the ridge line part 28*e* of the protrusion part 28*c* and the inner wall surface 18*b* of the water jacket 18 are in contact with each other. This protrusion part 28*c* is formed of a triangular-column-shape (see FIG. 21C), and functions as a close-contact portion. The inclination angle of the ridge line part 28*e* of the protrusion part 28*c* is set different from the inclination angle of the longitudinal cross section (which passes the center of the corresponding cylinder bore) of the inner wall surface 18*b* of the water jacket 18. In other words, the ridge line of the ridge line part 28*e* of the protrusion part 28*c* is set unparallel with the longitudinal cross section (which passes the center of the corresponding cylinder bore) of the inner wall surface 18*b* of the water jacket 18 in an intersecting manner.

In this case, the protrusion part 28*c* of the elastic body 28 is provided so that, when attached to the inside of the long groove 26 of the spacer main body part 10*a*, the protrusion part 28*c* of the elastic body 28 is exposed to the inner peripheral side through the longitudinally-long opening part 26*a*, and is in contact with the inner wall surface 18*b* constituting a part of the water jacket 18.

In addition, because the ridge line of the ridge line part 28*e* of the protrusion part 28*c* is set unparallel with the longitudinal cross section of the inner wall surface 18*b* of the water jacket 18 in the intersecting manner, a degree of close contact of the protrusion part 28*c* with the inner wall surface 18*b* of the water jacket 18 and a load imposed on the inner wall surface 18*b* thereof by the protrusion part 28*c* gradually increase in response to how far the spacer 10 is inserted in the water jacket 18. For this reason, the insertion performance can be enhanced, and the influence on the elastic body 28 can be inhibited by preventing as much as possible the deformation of the elastic body 28 including the protrusion part 28*c*.

For example, when the spacer 10, to which the elastic body 28 is attached, is inserted into the water jacket 18, the protrusion part 28*c* of the elastic body 28 is put in point contact with the inner wall surface 18*b* in an area of the opening part 18*a* in the upper portion of the water jacket 18 immediately after the inner wall surface 18*b* and the protrusion part 28*c* of the elastic body 28 start to contact each other. As the spacer 10 is inserted gradually deeper toward the lower portion of the water jacket 18, the contact of the protrusion part 28*c* of the elastic body 28 with the inner wall surface 18*b* is changed from the point contact mode to a line contact mode. Finally, the protrusion part 28*c* of the elastic body 28 elastically deforms, and comes into surface contact with the inner wall surface 18*b*. Because the protrusion part 28*c* of the elastic body 28 is provided so that, as described above, the contact load gradually increases in response to how far the spacer 10 is inserted toward the deep portion of the water jacket 18 without augmenting the load resulting from the insertion of the spacer 10 in the water jacket 18 from the beginning of the insertion, the better insertion performance can be obtained by reducing a load (sliding resistance) which occurs when the spacer 10 is inserted in the water jacket 18. As a result, the assemblability can be enhanced.

Furthermore, the elastic body 28 is provided so that: its portion which is put into contact with the inner wall surface 18*b* of the water jacket 18 is limited to the protrusion part 28*c* supported by the thick rectangular part 28*b*; and the ridge line part 28*e* formed in the top portion of the protrusion part 28*c* and its vicinity alone come into contact (the point contact, followed by the line contact, and followed by the surface contact) with the inner wall surface 18*b* of the water jacket 18. For this reason, the durability of the elastic body 28 can be enhanced by inhibiting the deformation of the elastic body 28 by itself to a small amount.

Moreover, the spacer 10 is held by the paired elastic bodies 28, 28 provided in the respective opposite end portions of the spacer main body part 10*a* in the cylinder row line direction, and thus fixed in a predetermined position inside the water jacket 18. Even in a case where the spacer 10 strays from the predetermined position in which the spacer 10 is placed beforehand, for example, due to the water pressure of the cooling water, the vibrations of the internal combustion engine, and the like so that any one of the extended part 30, the first hook part 32 and the second hook part 34, which will be described later, comes in abutment with the undersurface of the gasket 70, an abutment load applied to the gasket 70 can be preferably mitigated by frictional resistance which occurs between the inner wall surface 18*b* of the water jacket 18 and the elastic bodies 28, 28.

When the elastic body 28 is assembled to the inside of the long groove 26 of the spacer main body part 10*a*, the lock part 28*d* provided at the back of the protrusion part 28*c* elastically deforms, and is thus locked to the window part 40 (see FIG. 14) formed in the spacer main body part 10*a*. Because, as described above, the lock part 28*d* of the elastic body 28 is locked to the window part 40 of the spacer main body part 10*a*, the elastic body 28 having been inserted in the long groove 26 is positioned in the predetermined position in the spacer main body part 10*a* when assembled to the long groove 26.

Note that the elastic body 28 may be configured so that the protrusion part 28*c* comes into point contact or line contact with the outer wall surface 18*c* constituting a part of the water jacket 18 by making the protrusion part 28*c* exposed toward the outer peripheral side with the elastic body 28 turned inside out. In this case, the window part 40 to which the lock part 28*d* is locked is provide in an inner side of the spacer main body part 10*a*.

Returning to FIGS. 15A and 15B, the first hook part 32 protrudes from the upper surface 11 of the spacer main body part 10*a*, and is provided in the opposite end in the cylinder row line direction and above the elastic body 28. This first hook part 32 includes: a tapered part 32*a* which extends upward from the upper surface 11, and whose width dimension becomes gradually smaller toward the upper portion of the tapered part 32*a*; a head part 32*b* which extends upward from the tapered part 32*a*, and whose width dimension becomes larger toward the upper portion of the head part 32*b*; and a constricted part 32*c* which is provided between the tapered part 32*a* and the head part 32*b*, and which is formed with a narrower width. In this case, the first hook part 32 is provided extending along the elastic body 28 functioning as the fixation part, and in the cylinder axis line direction (in the up-and-down direction).

Figure 27A:
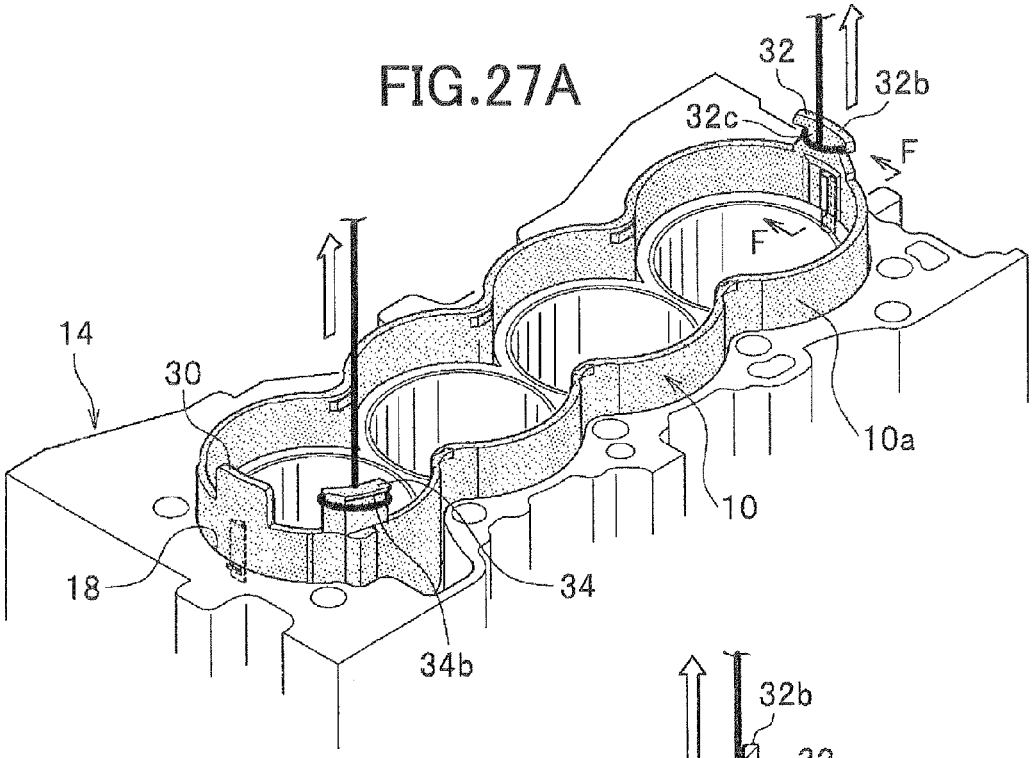
FIG. 27A is an explanatory drawing showing how the spacer is pulled out of the water jacket by use of a tool.
Figure 27B:
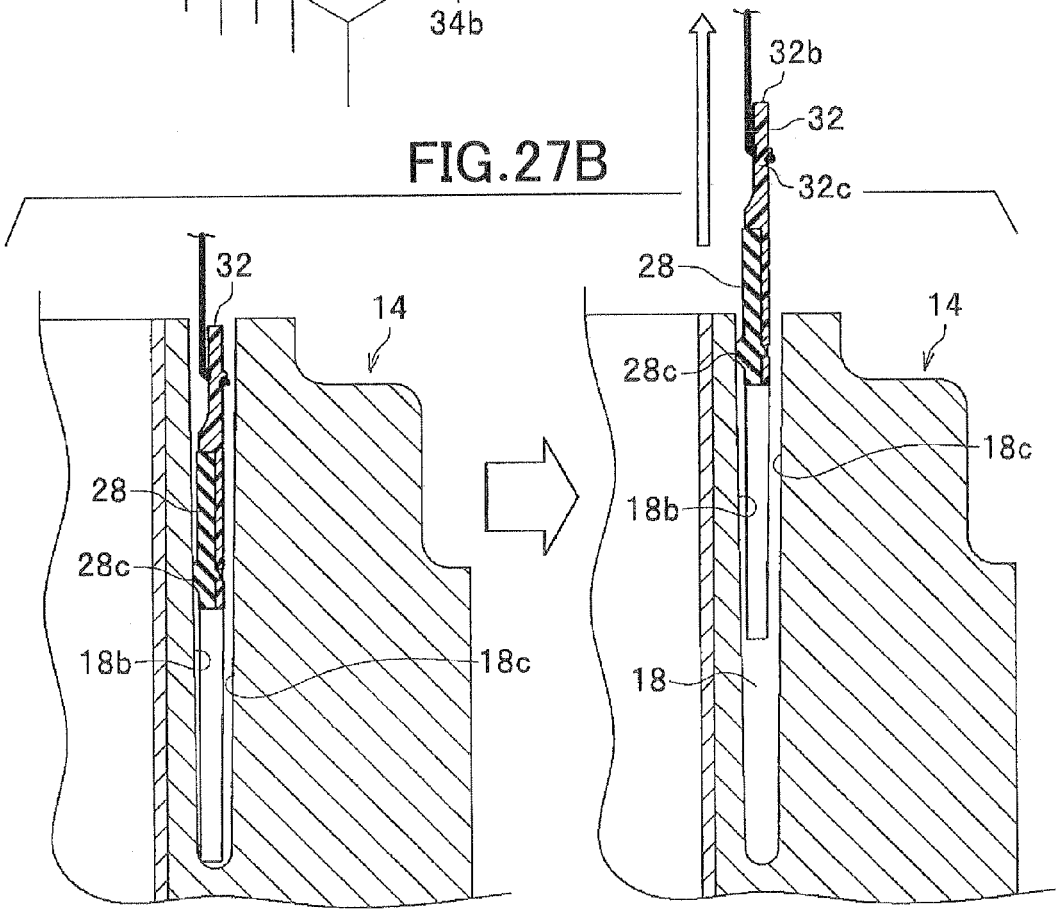
FIG. 27B is a longitudinal sectional view of the spacer in the process of being pulled out of the water jacket, which is taken along a line F-F in FIG. 27A.
Figure 28:
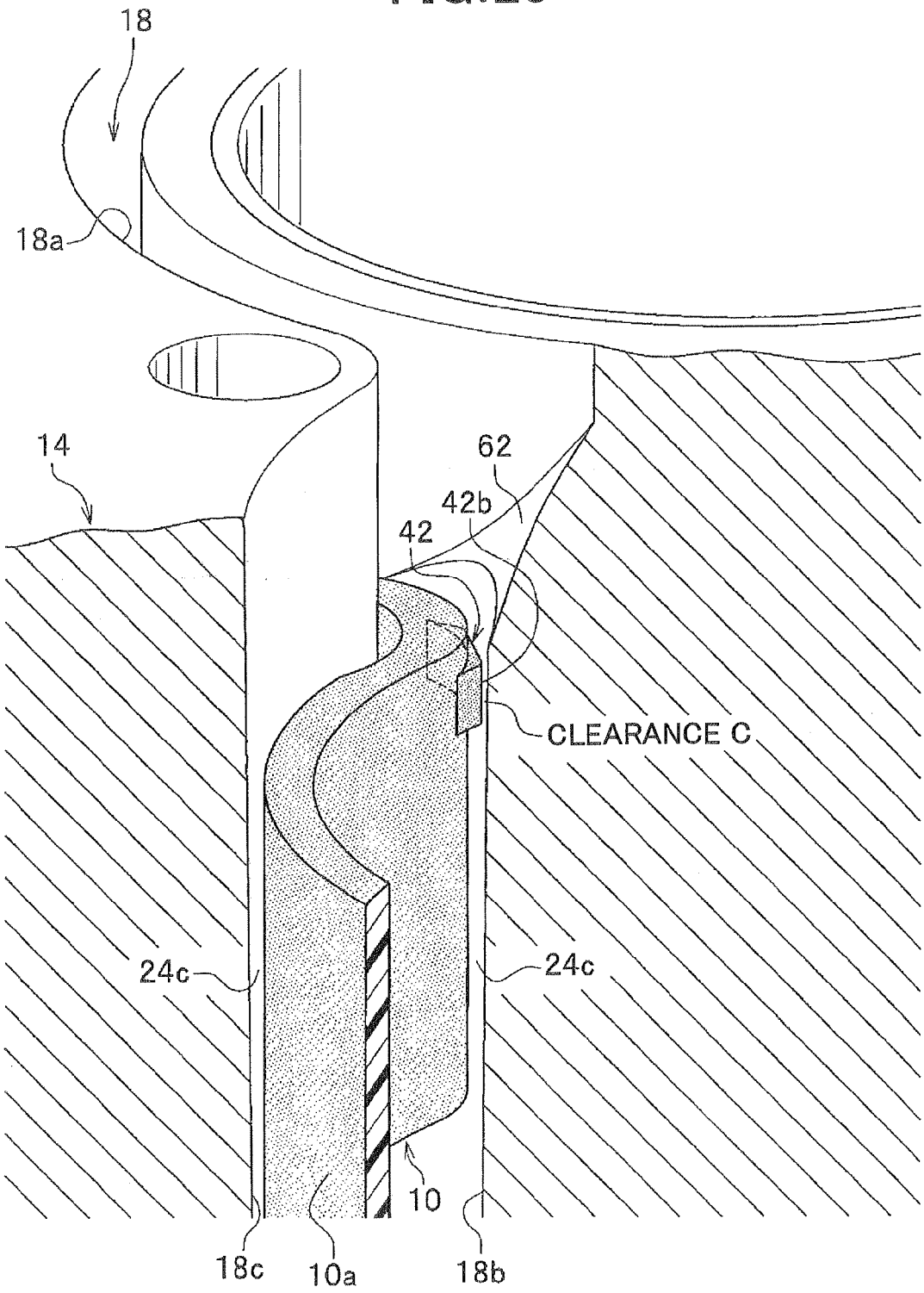

As shown in FIGS. 27A and 27B, the spacer 10 can be easily pulled (drawn) out of the water jacket 18, for example, by: engaging a tool (for example, a member including a ring part which is formed from a wire or the like) with the constricted part 32*c*; and thus hooking the ring part to the head part 32*b*.

In this case, when the spacer 10 is pulled out of the water jacket 18 upward with the first hook part 32 locked by use of the tool or the like, the elastic body 28 is located on an extension line of a force for pulling the first hook part 32 because the first hook part 32 is provided in a position along the elastic body 28 (the fixing part) in the cylinder axis line direction. For this reason, the spacer 10 can be easily pulled out while avoiding the deformation of the spacer 10 (see FIGS. 27A and 27B).

As shown in FIG. 18, the upper surface 11 of the spacer 10 is formed with an inclined surface which inclines upward at a certain gradient in such a way that the inclined surface becomes gradually closer to the opening part 18*a* of the water jacket 18 in the cylinder block 14 from a place opposed to the cooling water inlet port 20*a* through a place opposed to the cooling water outlet port 20*b* in the cylinder block 14, in other words, from the upstream to the downstream of the cooling water flowing along the water jacket 18. Because the upper surface 11 of the spacer 10 is formed as the inclined surface inclining upward at the certain gradient, the flow of the cooling water from the upstream to the downstream in the water jacket 18 acts a force, which pushes the spacer 10 downward, on the spacer 10. Accordingly, the spacer 10 can be stabilized. On the other hand, the undersurface 13 of the spacer 10 is formed with a horizontal surface which does not incline from the upstream to the downstream of the cooling water flowing along the water jacket 18. Note that, for the sake of convenience, FIG. 18 shows: a part of the upper surface 11 of the spacer 10, which extends from the place opposed to the cooling water inlet port 20*a* in the cylinder block 14 through the first hook part 32, as an "upper surface 11*a* of the spacer 10"; and a part of the upper surface 11 of the spacer 10, which extends from the first hook part 32 through the place opposed to the cooling water outlet port 20*b*, as an "upper surface 11*b* of the spacer 10."

The first hook part 32 provided to the spacer 10 is formed so that the flow of the cooling water is not obstructed by: forming the first hook part 32 in the peripheral direction of the corresponding cylinder bore; and thereby making the first hook part 32 extend in the same direction as, or in substantially the same direction as, the cooling water flows. In other words, if the first hook part 32 would be formed as a hook projecting, for example, in the radial direction (the thickness direction of the spacer 10) as in the second hook part 34, the portion projecting in the radial direction would act to obstruct the flow of the cooling water. For this reason, the head part 32*b* of the first hooked part 32 is formed in a shape, which extends in the peripheral direction of the corresponding cylinder bore so as not to obstruct the flow of the cooling water as much as possible, by providing a half of the head part 32*b* to extend toward the upstream of the water jacket 18 and the other half of the head part 32*b* to extend toward the downstream of the water jacket 18.

Note that the first hook part 32 is provided in an end portion in the cylinder row line direction (an area where the cooling water makes a U-turn, which will be described later), where the flow speed of the cooling water is slower (see FIG. 13). For this reason, the first hook part 32 can be provided in the area which does not obstruct the flow of the cooling water as much as possible.

Furthermore, the first hook part 32 is provided in the area which extends up to the vicinity of the opening part 18*a* of the water jacket 18 (see FIG. 18). For this reason, the tool can be easily hooked to the constricted part 32*c* (head part 32*b*), for example, without inserting the tool and the like in a deeper portion of the water jacket 18.

Moreover, the first hook part 32 is provided closer to the opening part 18*a* side of the water jacket 18 than the spacer main body part 10*a* is (see FIGS. 13 and 18). For this reason, the spacer main body part 10*a* does not constitute an interference member, and the constricted part 32*c* (head part 32*b*) can be easily locked.

The extended part 30 which protrudes upward from the upper surface 11 of the spacer main body part 10*a*, and which is formed in one end portion in the cylinder row line direction is formed of a substantially rectangle-shape, and is formed by beveling its corner portions. The providing of this extended part 30 enables the extended part 30 to come into abutment on the gasket 70, and the dislocation of the spacer 10 to be restricted, even if the spacer 10 is dislocated from the predetermined position inside the water jacket 18 due to the water pressure of the cooling water, the vibrations of the internal combustion engine, and the like.

The second hook part 34 protrudes from the upper surface 11 of the spacer main body part 10*a*, as well as is provided close to one end portion in the cylinder row line direction, and above a partition part 46 which is formed with a larger thickness integrally with the spacer main body part 10*a* for the purpose of partitioning the cooling water inlet port 20*a* and the cooling water outlet port 20*b* of the water jacket 18 (see FIGS. 13, 14, 15A and 15B). This second hook part 34 is provided with: a body part 34*a* whose longitudinal cross section is formed of substantially L-shape, and which protrudes from an upper end surface of the spacer main body part 10*a*; and a clasp part 34*b* which protrudes in a substantially horizontal direction from an upper end surface of the body part 34*a* by a predetermined length. This second hook part 34 is provided above the partition part 46 formed thicker and thus having a larger rigidity than an ordinary portion of the spacer main body part 10*a* which surrounds the peripheries of the cylinder bores, and which is formed thinner.

Because the second hook part 34 is provided in a portion above the partition part 46, which is formed thicker and has the larger rigidity than the ordinary portion, in the cylinder axis line direction, the pullout of the spacer 10 by use of a tool or like can be easily achieved while inhibiting the deformation of the spacer 10.

In this case, the spacer 10 can be easily pulled out of the water jacket 18 by: engaging a hand or a tool (for example, a member including a ring part which is formed from a wire or the like) with the clasp part 34*b*; and hooking the clasp part 34*b* (see FIG. 27A). A space which enables the clasp part 34*b* to be pulled out with a finger of a hand is provided by opening a communication hole 48 (see FIG. 13), which communicates with the cooling water inlet port 20*a* of the water jacket 18, in the vicinity of the clasp part 34*b* of the second hook part 34.

Note that, although the pulling of the spacer 10 out of the water jacket 18 can be achieved by pulling out either of the first hook part 32 or the second hook part 34, it is desirable that the pulling of the spacer out of the water jacket 18 should be achieved by pulling out the first hook part 32 and the second hook part 34 substantially simultaneously. To put it specifically, because the first and second hook parts 32, 34 provided above the spacer main body part 10*a* are placed respectively in one and the other ends in the cylinder row line direction, the substantially simultaneous pullout of the first and second hook parts 32, 34 enables the pullout load to be substantially equally distributed between and imparted to one and the other ends in the cylinder row line direction. Accordingly, the deformation of the spacer 10 in the longitudinal direction can be suppressed more.

The internal combustion engine 12 in which the spacer 10 according to this embodiment is fitted is basically configured as described above. Next, descriptions will be provided for its operation/working effect.

Figure 26:
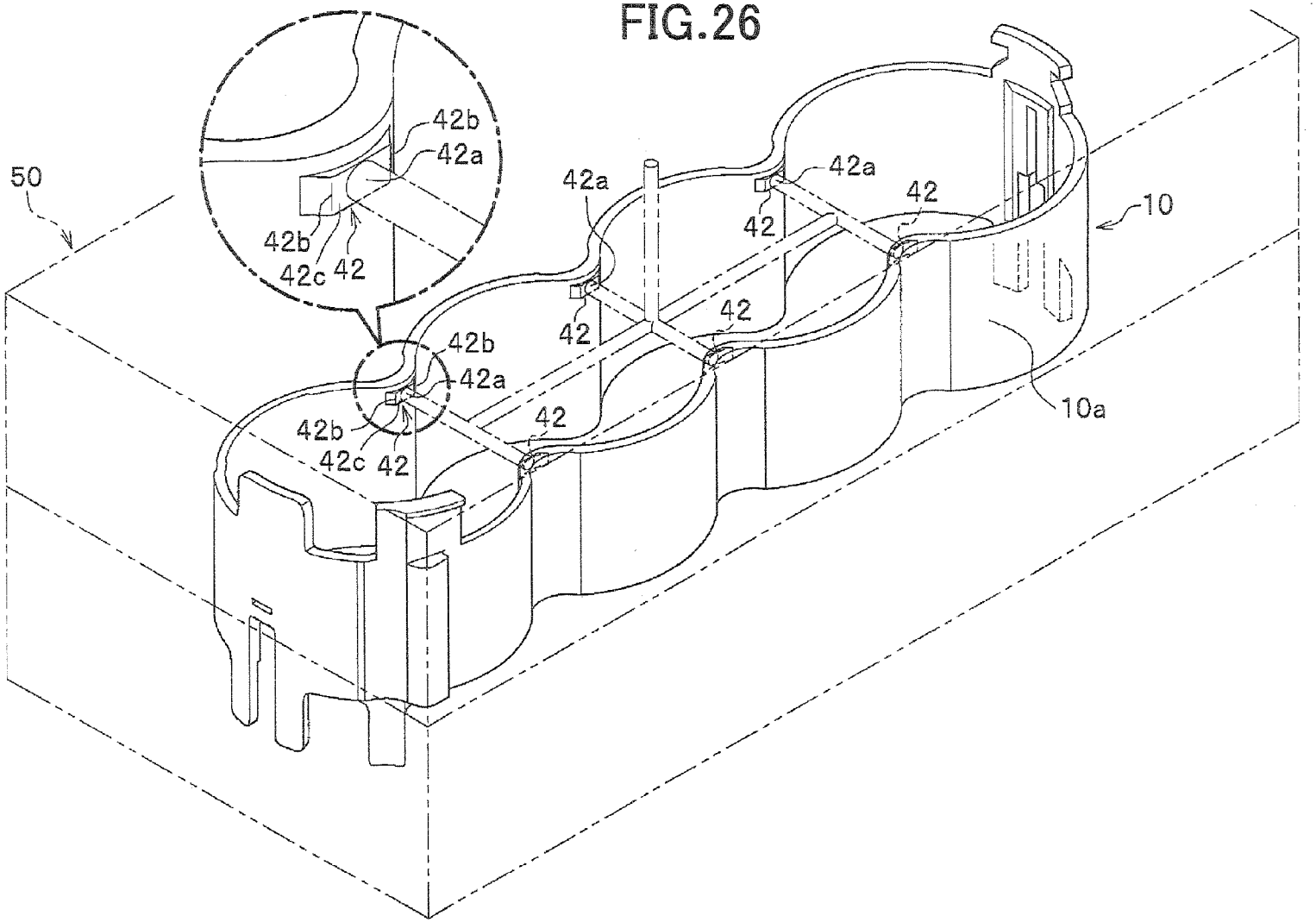

First of all, descriptions will be provided for a process of manufacturing the spacer 10. FIG. 26 is an explanatory drawing showing the process of producing the spacer by hardening a molten resin material which has been injected in the cavities of a molding die. Note that, for the sake of convenience, FIG. 26 shows the spacer 10 with continuous lines, and gates and runner channels, through which the molten resin material is injected in the cavities of the molding die 50, with two-dot chain lines.

The spacer is produced by: injecting the molten resin material into the cavities of the molding die 50 through the multiple gates as shown in FIG. 26; and hardening the molten resin material which is filled in the cavities. Cores are used for the molding die 50 as appropriate depending on the necessity. As the gate remnant, the gate residue part 42*a* which remains protruding with burr and the like is provided in each protrusion 42 of the spacer main body part 10*a* which has been molded from the resin. Note, however, that the gate residue part 42*a* is removed as appropriate, for example, by use of a polishing mechanism or a grinding mechanism (not illustrated) during the finishing process.

In this case, the paired jutting parts 42*b*, 42*b* provided in each protrusion 42 of the spacer main body part 10*a* are provided to be in contact with the inner wall surface 18*b* of the water jacket 18. For this reason, it suffices if the amount of protrusion of the gate residue part 42*a* including burr and the like is less than a predetermined value so that the gate residual part 42*a* does not contact the inner wall surface 18*b* of the water jacket 18. Accordingly, the dimensional precision of the gate residue part 42*a* may be set roughly.

In addition, the multiple gates used to inject the molten resin material in the cavities of the molding die 50 are formed in the vicinity of the inner peripheral upper edge of the spacer main body part 10*a* which has been molded. For this reason, the every corner of the cavities, including the leg parts 36*a* to 36*c* and the like in the lowermost portion of the cavities, can be filled with the injected molten resin material. In other words, the molten resin can be made to smoothly flow even into portions of the leg parts 36*a*, 36*b* formed of two-forks, which are in the vicinity of the long groove 26 and in the lowermost area. For this reason, the dimensional precision (shape precision) of the leg parts 36*a* to 36*c* extending downward from the spacer main body part 10*a* can be enhanced.

Furthermore, the multiple protrusions 42 provided in the vicinity of the inner peripheral upper edge of the spacer main body part 10*a* are provided in the locations of the gates serving as the inlet ports through which the molten resin material is injected into the cavities of the molding die 50 when the spacer 10 is produced. This embodiment uses the multiple protrusions 42, which are provided in the locations of the gates, as the abutment means which come into abutment on the inner wall surface 18*b* of the water jacket 18 (the jutting parts 42*b*, 42*b* provided in the respective opposite sides of each protrusion 42 come into abutment on the inner wall surface 18*b*, but the gate residue part 42*a* in the center portion of each protrusion 42 does not come into abutment thereon). Thereby, this embodiment can smoothly control the flow of the cooling water inside the water jacket 18 without providing unnecessary protrusions.

The gate residue part 42*a* including burr and the like is removed during the finishing process which is a post-stage process. However, the protrusion 42 is not always carved into a flat surface even when the entire gate residue part 42*a* is removed. For this reason, this embodiment does not aim at enhancing the dimensional precision by using a removed surface, which is obtained by removing the gate residue part 42*a*, as a reference surface. This embodiment instead makes the jutting parts 42*b*, 42*b*, which are provided on the respective opposite sides of the gate residue part 42*a*, come into abutment on the inner wall surface 18*b* of the water jacket 18. Thereby, this embodiment can hold the spacer 10 while positioning the spacer 10 in the predetermined position with higher precision (see FIGS. 19A and 19B).

Next, descriptions will be provided for an assembling process for assembling the thus-produced spacer 10 as a cooling structure of the internal combustion engine. Here, let us assume that the elastic bodies 28 are beforehand formed from a rubber material, such as a synthetic rubber or natural rubber, into a predetermined shape shown in FIG. 21A.

The long grooves 26 extending in the up-and-down direction are formed in the respective opposite ends of the spacer 10, which is formed from a resin by use of the molding die 50, in the cylinder row line direction. Subsequently, as shown in FIG. 21B, the elastic bodies 28 are inserted into the long grooves 26, which communicate with the slits 38, by sliding the elastic bodies 28 along the slits 38 with their protrusion parts 28*c* faced downward and toward the inner periphery of the spacer main body part 10*a*, respectively. In this case, the thick rectangular parts 28*b* of the elastic bodies 28 are engaged with the longitudinally-long opening parts 26*a* of the long grooves 26, and the thin side parts 28*a* of the elastic bodies 28 are engaged with the side groove part 26*b* of the long grooves 26, respectively.

The elastic bodies 28 are attached to the spacer main body part 10*a* while positioned in the predetermined position by sliding the elastic bodies 28 upward along the long grooves 26, as described above, to lock the lock parts 28*d*, which are formed in the back of the elastic bodies 28, to the insides of the window parts 40 formed in the spacer main body part 10*a*.

After the spacer 10 is completed with the elastic bodies 28 attached to the spacer main body part 10*a*, this completed spacer 10 is inserted into the water jacket 18 of the cylinder block 14. The insertion of the spacer 10 into the water jacket 18 may be achieved, for example, by pressing the spacer 10 into the water jacket 18 by use of a robotic hand (not illustrated) which is capable of providing displacement along multiple axes including the X-, Y-, Z-axes orthogonal to one another. Otherwise, the insertion may be achieved, for example, by: manually inserting the spacer 10 into the upper surface opening part 18*a* of the water jacket 18; and thereafter pressing the spacer 10 into the deeper portion of the water jacket 18 by use of a jig (not illustrated).

The insertion of the spacer 10 into the water jacket 18 is restricted, for example, by abutment of the legs part 36*b*, 36*b* and another leg part 36*c*, which are provided in the lower portion of the spacer 10, on the bottom wall 18*d* of the water jacket 18. In this occasion, the spacer main body part 10*a* does not come into abutment on the bottom wall 18*d* of the water jacket 18. Instead, the multiple protrusions 42 provided on the inner periphery of the spacer 10 come into abutment on the inner wall surface 18*b* of the water jacket 18, and the protrusion parts 28*c* (the ridge line parts 28*e*) of the elastic bodies 28 provided in the opposite end portions in the cylinder row line direction come into abutment on the inner wall surface 18*b* of the water jacket 18. Thereby, the spacer main body part 10*a* is fixed in the intermediate position of the water jacket 18 in the depth direction.

Note that the leg parts 36*a*, 36*a* provided in the lower portion of the spacer 10 in the cylinder axis line direction are set slightly shorter in the length in the up-and-down direction than the leg parts 36*b*, 36*b*, which are opposed to the leg parts 36*a*, 36*a* in the cylinder row line direction, and the other leg part 36*c*. For this reason, the leg parts 36*a*, 36*a* do not come into abutment on the bottom wall 18*d* of the water jacket 18, and are thus inserted into the water jacket while suspended in the water jacket (see FIG. 18). In this case, the spacer 10 is supported by three points including the leg parts 36*b*, 36*b* and the other leg part 36*c* which are provided in the lower portion thereof (in a three-point support structure). For this reason, even if production errors (dimensional errors) and the like occur, the spacer 10 can be supported stably. This can contribute to the stability of the behavior of the spacer 10.

When the spacer 10 is inserted into the water jacket 18, the elastic bodies 28 are disposed in the opposite end portions of the spacer 10 in the cylinder row line direction, and the protrusion parts 28*c* of the elastic bodies 28 thus come in intimate contact with the inner wall surface 18*b* of the water jacket 18. This intimate contact causes forces which press the spacer 10 outward in the cylinder row line direction. As a result, forces act, which make intermediate portions of the spacer 10, except for the end portions of the spacer 10 in the cylinder row line direction, deform inward. Accordingly, the multiple protrusions 42 provided on the inner side of the spacer main body part 10*a* come closer to the inner wall surface 18*b* of the water jacket 18, and the space-out distance (clearance) C between the inner wall surface 18*b* of the water jacket 18 and the protrusions 42 becomes narrower.

When the protrusions 42 abut on (contact) the inner wall surface 18*b* following the space-out distance becoming zero, the spacer 10 can be uniformly held throughout the entire periphery of the water jacket 18 by: controlling the quantity of deformation (the amount of deformation) of the elastic bodies 28 disposed in the respective opposite end portions of the spacer 10 in the cylinder row line direction with respect to the inner wall surface 18*b* of the water jacket 18; and thus increasing the forces with which the multiple protrusions 42 provided on the inner side of the spacer main body part 10*a* abut on the inner wall surface 18*b* of the water jacket 18.

In addition, because the water jacket 18 is formed in such a tapered shape that the longitudinal cross section of the water jacket 18 in the up-and-down direction becomes gradually narrower from the opening part 18*a* in the upper surface 11 toward the bottom wall 18*d*, the space-out distance D in the upper portion-side passage 24*a* of the water jacket 18 is larger than the space-out distance D in the lower portion-side passage 24*b* of the water jacket 18. Accordingly, the space-out distance D in the upper portion-side passage 24*a* can be set easily.

In this case, the multiple protrusions 42 which are provided on the upper side in the cylinder axis line direction and which are disposed so as to oppose to the connecting area (inter-cylinder area) between the adjacent cylinder bores, abut on the inner wall surface 18*b* of the water jacket 18, while the protrusion parts 28*c* of the paired elastic bodies 28 which are provided on the lower side in the cylinder axis line direction and which are disposed so as to oppose to the respective opposite end portions in the cylinder row line direction, abut on the inner wall surface 18*b* of the water jacket 18. Thereby, it is possible to preferably avoid the rotational movement (sliding movement) of spacer 10 which would otherwise stem from the cooling water flowing in the passage 24, the vibrations of the internal combustion engine 12, and the like.

For this reason, the behavior of the spacer 10 can be stabilized by holding the spacer 10 with the protrusions 42, which are disposed on the upper side in the cylinder axis line direction, and the protrusion parts 28*c*, which are disposed on the lower side in the cylinder axis line direction, caused to abut on the inner wall surface 18*b* or the outer wall surface 18*c* of the water jacket 18.

As a result, it is possible to suppress the occurrence of the hitting sounds which stein from the abutment of the spacer 10 itself on the inner wall surface 18*b* or the outer wall surface 18*c*, and thus to enhance the quietness inside the vehicle compartment while the internal combustion engine 12 is mounted on the vehicle. Note that the present embodiment makes the protrusions 42 and the protrusion parts 28*c*, which protrude from the spacer main body part 10*a* toward the wall surfaces of the water jacket 18, function as the protruding parts. Thereby, in a case where the wall surfaces of the water jacket 18 are formed, for example, in a complicated shape, the spacer 10 can be preferably held and fixed by making the foregoing protruding parts abut on the wall surfaces of the water jacket 18.

Next, descriptions will be provided for the cooling water passage (cooling passage structure) where the spacer 10 is inserted in the water jacket 18 of the cylinder block 14.

The cooling water supplied to the cooling water inlet port 20*a* in the cylinder block 14 by the water pump (not illustrated) flows in the water jacket 18 in one of the cylinder row line direction (on the front side in FIG. 13), and makes the U-turn in an end portion in the cylinder row line direction which is farther from the cooling water inlet port 20*a*. Thereafter, the cooling water flows in the water jacket 18 in the other of the cylinder row line direction (on the back side in FIG. 13), and is guided out to the water jacket (not illustrated) in the cylinder head 16 from the cooling water outlet port 20*b*. The flow of the cooling water along the water jacket 18 as described above can cool the bore walls around the respective cylinder bores, and thus can preferably cool the combustion chambers (not illustrated) through the outside.

Note that the cooling water passage is not limited to what has been described above. For example, the cooling water passage may be designed so that: the cooling water is introduced through one end portion of the cylinder block 14 in the cylinder row line direction; the cooling water parallel flows along two sides (two flanks) of the water jacket 18 in the cylinder row line direction with the multiple cylinder bores interposed in between; and thereafter the cooling water is guided out through the other end portion of the cylinder block 14 in the cylinder row line direction.

Next, descriptions will be provided for how the cooling water flows in predetermined areas in the water jacket 18 in which the spacer 10 is inserted.

Figure 22:
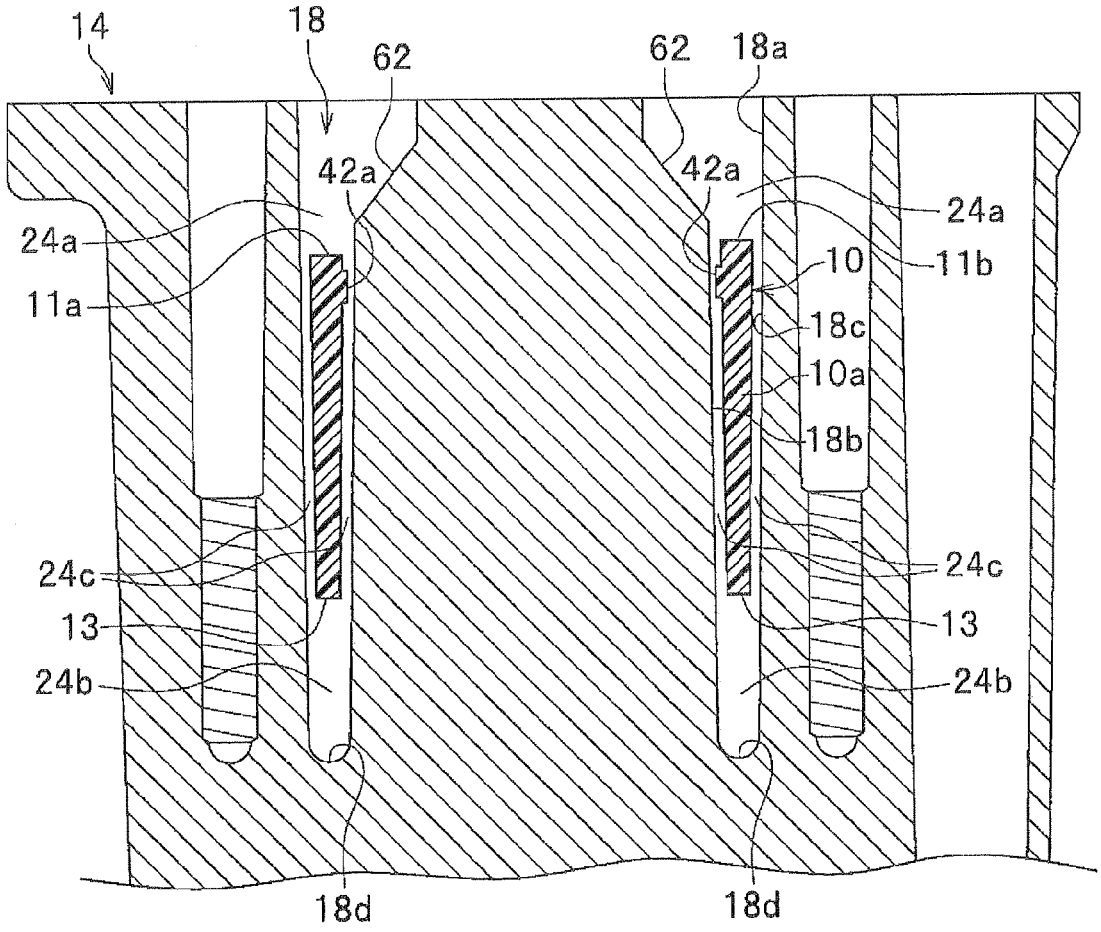

FIG. 22 is a longitudinal sectional view of an area between two adjacent cylinders (between two adjacent cylinder bores) taken along the line B-B in FIG. 16. FIG. 17 shows an ordinary area other than the inter-cylinder area, and is a longitudinal sectional view of a cylinder bore in the cylinder block taken along the line A-A in FIG. 16.

In each ordinary area, as shown in FIG. 17, the spacer 10 (the spacer main body part 10*a*) is disposed in an intermediate region between a region in the vicinity of the top dead center (the position of the top dead center of the piston 60 being illustrated with a continuous line) and a region in the vicinity of the bottom dead center (the position of the bottom dead center being illustrated with a two-dot and dash line) in the cylinder axis line direction. In addition, the region in the vicinity of the top dead center and the region in the vicinity of the bottom dead center respectively form space portions in which the spacer 10 (the spacer main body part 10*a*) is never provided. With this taken into consideration, main passages (the upper portion-side passage 24*a* and the lower portion-side passage 24*b*) in which the cooling water flows are respectively formed in the upper portion of the water jacket 18, above the spacer main body part 10*a*, and in the lower portion of the water jacket 18, below the spacer main body part 10*a*, both of which correspond to the space portions. In other words, the upper portion-side passage 24*a* and the lower portion-side passage 24*b* are formed corresponding to the positions of the top dead center and the bottom dead center of each piston 60 which provides sliding displacement in the corresponding cylinder bore. In each inter-cylinder area shown in FIG. 22, similarly, the upper portion-side passage 24*a* and the lower portion-side passage 24*b* are respectively formed corresponding to the positions of the top dead center and the bottom dead center of the corresponding piston 60.

In this case, the amount of flow of the cooling water is set larger in the upper portion-side passage 24*a* above, and the lower portion-side passage 24*b* below, the spacer main body part 10*a*, whereas the amount of flow of the cooling water is set smaller in the intermediate passage 24*c* provided in the intermediate region (center region) between the region in the vicinity of the top dead center and the region in the vicinity of the bottom dead center, where the spacer main body part 10*a* is disposed.

As a result, in the intermediate region (center region) in which the amount of flow of the cooling water is set smaller, each bore wall in the range in which the sliding speed is higher than in the top dead center and the bottom dead center is surrounded by the spacer 10 (the spacer main body part 10*a*), and is thus warmed (thermally insulated). Thereby, the clearance between the piston 60, which provides the sliding displacement in the cylinder bore, and the bore wall is enlarged. Accordingly, it is possible to reduce friction (frictional resistance) which occurs between the piston 60 and the bore wall. Furthermore, in the intermediate region (center region), because the bore wall in the range in which the sliding speed of the piston is higher than in the top dead center and the bottom dead center is warmed (thermally insulated), the viscosity (degree of viscosity) of the lubricating oil between the piston 60 and the bore wall is reduced. Accordingly, it is possible to decrease the sliding resistance therebetween. Note that the overall amount of cooling water can be made smaller in this embodiment in which the spacer 10 is inserted in the water jacket 18 than in a case where the spacer 10 is not inserted in the water jacket 18. Thus, a quick warm-up of the internal combustion engine 12 can be achieved when the internal combustion engine 12 is started.

In each inter-cylinder area, as shown in FIG. 22, tapered surfaces 62 made up of paired inclined surfaces, which are inclined in the form of the truncated inverse V, are formed in a region in the vicinity of the upper portion of the inner wall surface 18*b* of the water jacket 18. These tapered surfaces 62 are set in positions which make the lower portions of the respective tapered surfaces 62 substantially coincide with or close to the upper surface 11 of the spacer 10 in the horizontal direction. While the cooling water is flowing along the upper portion-side passage 24*a* of the water jacket 18, the cooling water meanders toward the inner side of the upper portion-side passage 24*a* along each tapered surface 62 (each inclined surface), and thus flows to curve to a large extent. This makes the amount of flow of the cooling water (the area of the passage) larger (see FIG. 28). Accordingly, the region between each two corresponding adjacent cylinder bores (the region in the vicinity of the corresponding top dead center), whose temperature especially tend to be higher, can be preferably cooled.

According to this embodiment, the jutting parts 42*b*, 42*b* protruding toward the inner wall surface 18*b* (the cylinder bore-side inner wall) of the water jacket 18 are provided on the respective opposite sides of each gate residue part 42*a* (each material introduction part) on the spacer 10 in the cylinder row line direction, and these jutting parts 42*b*, 42*b* thus support the spacer 10 at their respective two points while abutting on the inner wall surface 18*b*. Thereby, the looseness of the spacer 10 can be suppressed. As a result, this embodiment can stabilize the behavior of the spacer 10 inserted in the water jacket 18. Furthermore, because it is difficult to make the dimension of the protrusion toward the inner wall surface 18*b* equal among the gate residue parts 42*a* each functioning as the material introduction part, the spacer 10 can be supported in the predetermined position with higher precision by making the jutting parts 42*b*, 42*b* abut on the cylinder bore-side inner wall surface 18*b* than by making the gate residue parts 42*a* abut on the inner wall surface 18*b* of the water jacket 18.

According to this embodiment, because the jutting parts 42*b*, 42*b* are provided closer to the cylinder bore-side inner wall surface 18*b* of the water jacket 18 than the corresponding gate residue part 42*a* (the material introduction part) is, the jutting parts 42*b*, 42*b* can be made to abut on the cylinder bore-side inner wall surface 18*b* ahead of the gate residue part 42*a* (the material introduction part). For this reason, even if the gate residue part 42*a* (the material introduction part) protrudes to some extent, its influence can be reduced.

Furthermore, the multiple protrusions 42 provided in one side (the upper side) in the cylinder axis line direction, which are disposed opposed to the connecting areas (the inter-cylinder areas) between the adjacent cylinder bores, abut on the inner wall surface 18*b* of the water jacket 18, while the protrusion parts 28*c* of the respective paired elastic bodies 28 provided in the other side (the lower side) in the cylinder axis line direction, which are disposed opposed to each other in the opposite end portions in the cylinder row line direction, abut on the inner wall surface 18*b* of the water jacket 18. Thereby, it is possible to preferably avoid the rotational movement (sliding movement) of the spacer 10 which would otherwise stem from the cooling water flowing in the passage 24, the vibrations of the internal combustion engine 12, and the like.

Accordingly, this embodiment causes the spacer 10 to be held by making the protrusions 42, which are disposed on the upper side in the cylinder axis line direction, and the protrusion parts 28*c*, which are disposed on the lower side in the cylinder axis line direction, abut on the inner wall surface 18*b* or the outer wall surface 18*c* of the water jacket 18, and thereby can stabilize the behavior of the spacer 10.

As a result of this, the present embodiment inhibits the occurrence of the hitting sounds due to the abutment of the spacer 10 itself on the inner wall surface 18*b* or the outer wall surface 18*c*, and thus can enhance the quietness inside the vehicle compartment when the internal combustion engine 12 is mounted on the vehicle. Note that the present embodiment causes the protrusions 42 and the protrusion parts 28*c*, which protrude from the spacer main body part 10*a* toward the wall surfaces of the water jacket 18, to function as the protruding parts. Thereby, even if the wall surfaces of the water jacket 18 are formed, for example, in a complicated shape, the spacer 10 can be preferably held and fixed by making the foregoing protruding parts abut thereon.

Moreover, the opposing surface 42*c*, which extends substantially in parallel with the cylinder row line direction between the corresponding jutting parts 42*b*, 42*b*, and which is opposed to the corresponding inter-cylinder area (connecting area), is formed, while the gate residue part 42*a* (the material introduction part) is made to protrude on the opposing surface 42*c*. Thereby, it is possible to preferably inhibit the inclination and looseness of the spacer 10 by making the jutting parts 42*b*, 42*b*, which are disposed on the opposite sides in the cylinder row line direction, abut uniformly on the cylinder bore-side inner wall surface 18*b*.

In addition, the present embodiment forms each paired jutting parts 42*b*, 42*b* from the flat surface which joins the jutting parts 42*b*, 42*b* in a straight line with the gate, which functions as the inlet port through which the molten resin is injected, interposed in between (see FIGS. 19A and 23B). For this reason, when the spacer 10 is produced by injection molding using the molding die 50, the present embodiment can makes the flow of the molten resin from the gate to the two jutting parts 42*b*, 42*b* better than the case where the surface between the paired jutting parts 42*b*, 42*b* is formed, for example, in a complicated shape including dents. For this reason, the present embodiment makes it possible to form the jutting parts 42*b*, 42*b* with higher dimensional precision, and to enhance the precision with which the spacer 10 is restricted inside the water jacket 18. As a result, the present embodiment can support the spacer 10 more stably by forming the shapes of the respective jutting parts 42*b*, 42*b* with higher precision.

The foregoing descriptions have been provided to the embodiments of the present invention. However, various design modifications can be made within the scope not departing from the gist of the present invention.

For example, what includes both the characteristics of the first embodiment and the characteristics of the second embodiment can be another embodiment of the present invention.

In addition, the in-line 4-cylinder internal combustion engine has been shown as the instance of the embodiments. Nevertheless, the present invention may be applied to an internal combustion engine of an arbitrary mode having an arbitrary number of cylinders.

Furthermore, the present invention can be applied to an internal combustion engine which bifurcates the cooling water, which is supplied from one end side in the cylinder row line L1 direction, into the intake-side side surface stream and the exhaust-side side surface stream, and which discharges the cooling water after gathering the two side surface streams in the other end in the cylinder row line L1 direction.

Moreover, in a case where the spacer 14 may deform due to swelling and thermal expansion in conjunction with the regular operation of the internal combustion engine, the relative size relationship between the spaces $\alpha$, $\beta$ needs to be in the predetermined condition when the deformation occurs.

What is claimed is:

1. A cooling structure for an internal combustion engine in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer, wherein a first space formed between an inner peripheral surface of the spacer and an inner wall surface of the water jacket is smaller than a second space formed between an outer peripheral surface of the spacer and an outer wall surface of the water jacket; and the inner peripheral surface of the spacer is provided with a plurality of protruding parts which protrude toward the inner wall surface of the water jacket that is opposed to the inner peripheral surface of the spacer and a third space between a tip end portion of each of the protruding parts and the inner wall surface of the water jacket is set smaller than said second space, wherein said protruding parts are positioned on an intake side and an exhaust side of the cylinder bore.

2. A cooling structure for an internal combustion engine in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer, wherein a first space formed between an inner peripheral surface of the spacer and an inner wall surface of the water jacket is smaller than a second space formed between an outer peripheral surface of the spacer and an outer wall surface of the water jacket; and the inner peripheral surface of the spacer is provided with a protruding part which protrudes toward the inner wall surface of the water jacket that is opposed to the inner peripheral surface of the spacer and a third space between a tip end portion of the protruding part and the inner wall surface of the water jacket is set smaller than said second space, wherein as said cylinder bore there are provided two cylinder bores and the protruding part is provided near an area where the two cylinder bores are closest to each other.

3. A cooling structure for an internal combustion engine, in which: a spacer is fitted inside a water jacket formed to surround a periphery of a cylinder bore of a cylinder block in the internal combustion engine; and a cooling condition of the cylinder bore is controlled by regulating a flow of cooling water in the water jacket by use of the spacer, wherein a first space formed between an inner peripheral surface of the spacer and an inner wall surface of the water jacket is smaller than a second space formed between an outer peripheral surface of the spacer and an outer wall surface of the water jacket; and the inner peripheral surface of the spacer is provided with a protruding part which protrudes toward the inner wall surface of the water jacket that is opposed to the inner peripheral surface of the spacer and a third space between a tip end portion of the protruding part and the inner wall surface of the water jacket is set smaller than said second space, wherein the spacer is provided with abutment means which abuts on at least one of the inner wall surface and the outer wall surface in each of positions on one and the other of opposite sides in a direction of a cylinder axis.

4. The cooling structure for an internal combustion engine according to claim 3, wherein the abutment means is a further protruding part which protrudes from a spacer main body part, which forms a main body part of the spacer, toward the wall surface of the water jacket.

5. The cooling structure for an internal combustion engine according to claim 4, wherein the spacer includes the spacer main body part covering only an intermediate position of the water jacket in a depth direction, and extending portions which extend upwardly and downwardly from the spacer main body part, respectively, in the direction of the cylinder axis, and the abutment means is provided to the spacer main body part.

6. The cooling structure for an internal combustion engine according to claim 5, wherein as said cylinder bore there are provided a plurality of cylinder bores and the water jacket is formed around the plurality of cylinder bores disposed in a straight line, the abutment means on the one side in the cylinder axis direction are provided so as to oppose to connecting areas between the adjacent cylinder bores, and the abutment means on the other side are provided so as to oppose to opposite end portions of the plurality of the cylinder bores in a direction of a cylinder row line.

7. The cooling structure for an internal combustion engine according to claim 4, wherein as said cylinder bore there are provided a plurality of cylinder bores and the water jacket is formed around the plurality of cylinder bores disposed in a straight line, the abutment means on the one side in the cylinder axis direction are provided so as to oppose to connecting areas between the adjacent cylinder bores, and the abutment means on the other side are provided so as to oppose to opposite end portions of the plurality of the cylinder bores in a direction of a cylinder row line.

8. The cooling structure for an internal combustion engine according to claim 3, wherein the spacer includes a spacer main body part covering only an intermediate position of the water jacket in a depth direction, and extending portions which extend upwardly and downwardly from the spacer main body part, respectively, in the direction of the cylinder axis, and the abutment means is provided to the spacer main body part.

9. The cooling structure for an internal combustion engine according to claim 8, wherein as said cylinder bore there are provided a plurality of cylinder bores and the water jacket is formed around the plurality of cylinder bores disposed in a straight line, the abutment means on the one side in the cylinder axis direction are provided so as to oppose to connecting areas between the adjacent cylinder bores, and the abutment means on the other side are provided so as to oppose to opposite end portions of the plurality of the cylinder bores in a direction of a cylinder row line.

10. The cooling structure for an internal combustion engine according to claim 3, wherein as said cylinder bore there are provided a plurality of cylinder bores and the water jacket is formed around the plurality of cylinder bores disposed in a straight line, the abutment means on the one side in the cylinder axis direction are provided so as to oppose to connecting areas between the adjacent cylinder bores, and the abutment means on the other side are provided so as to oppose to opposite end portions of the plurality of the cylinder bores in a direction of a cylinder row line.

11. The cooling structure for an internal combustion engine according to any of claims 2 or 10 to 6, wherein the spacer is provided with a material introduction part used when the spacer is produced, the material introduction part being opposed to a connecting area between the adjacent cylinder bores, and jutting parts protruding toward the inner wall surface of the water jacket are provided respectively on opposite sides of the material introduction part in a direction of a cylinder row line.

12. The cooling structure for an internal combustion engine according to claim 11, wherein the jutting parts are provided closer to the inner wall surface of the water jacket than the material introduction part is.

13. The cooling structure for an internal combustion engine according to claim 11, wherein an opposing surface is formed between the jutting parts, the opposing surface extending substantially in parallel with the cylinder row line direction and being opposed to the connecting area, and the material introduction part is protrudingly provided on the opposing surface.

14. A cooling structure for an internal combustion engine in which: a spacer is fitted inside a water jacket formed to surround a periphery of a plurality of cylinder bores of a cylinder block in the internal combustion engine; and a cooling condition of the plurality of cylinder bores is controlled by regulating a flow of cooling water in the water jacket by use of the spacer, wherein a first space formed between an inner peripheral surface of the spacer and an inner wall surface of the water jacket is smaller than a second space formed between an outer peripheral surface of the spacer and an outer wall surface of the water jacket; and the inner peripheral surface of the spacer is provided with a protruding part near an area where two of the cylinder bores are closest to each other, which protruding part protrudes toward the inner wall surface of the water jacket, wherein a third space between a tip end portion of the protruding part and the inner wall surface of the water jacket is smaller than the first space.

* * * * *